US007439011B2

(12) United States Patent
Inoue

(10) Patent No.: US 7,439,011 B2
(45) **Date of Patent: *Oct. 21, 2008**

(54) PHOTOTHERMOGRAPHIC MATERIAL

(75) Inventor: Rikio Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/510,617

(22) Filed: Aug. 28, 2006

(65) Prior Publication Data

US 2007/0003887 A1 Jan. 4, 2007

Related U.S. Application Data

(63) Continuation of application No. 10/408,574, filed on Apr. 8, 2003, now Pat. No. 7,138,223.

(30) Foreign Application Priority Data

Apr. 11, 2002 (JP) ..... 2002-109687
Sep. 26, 2002 (JP) ..... 2002-281391
Sep. 27, 2002 (JP) ..... 2002-284387

(51) Int. Cl.
*G03C 1/76* (2006.01)
*G03C 1/498* (2006.01)

(52) U.S. Cl. ..... 430/523; 430/513; 430/530; 430/531; 430/536; 430/540

(58) Field of Classification Search ..... 430/523, 430/619, 513, 530, 539, 531, 536, 640, 540
See application file for complete search history.

(56) References Cited

U.S. PATENT DOCUMENTS 3,623,877 A 11/1971 Langley et al.
4,152,160 A 5/1979 Ikienoue et al.
4,332,889 A 6/1982 Siga et al.
5,360,707 A * 11/1994 Kato et al. ..... 430/538
5,415,986 A 5/1995 Fujita et al.
6,132,949 A 10/2000 Fujita et al.
6,228,571 B1 * 5/2001 Hatakeyama ..... 430/531
6,316,172 B1 11/2001 Hashimoto
6,329,127 B1 12/2001 Ito et al.
6,458,505 B2 10/2002 Ito
6,468,720 B1 10/2002 Hirabayashi et al.
6,468,725 B2 10/2002 Takamuki
6,485,898 B2 11/2002 Yoshioka et al.
2001/0029000 A1 10/2001 Yoshioka et al.
2001/0038981 A1 11/2001 Arimoto
2001/0038982 A1 * 11/2001 Uehara et al. ..... 430/549
2004/0033449 A1 2/2004 Inoue
2004/0185389 A1 9/2004 Yoshioka et al.
2004/0229173 A1 11/2004 Oyamada
2004/0234910 A1 11/2004 Nakagawa et al.
2007/0003887 A1 * 1/2007 Inoue ..... 430/619

FOREIGN PATENT DOCUMENTS

EP 1096310 5/2001
JP 11-352625 12/1999
JP 11-352626 12/1999
JP 2000-171935 6/2000
JP 2002-162713 6/2002

* cited by examiner

*Primary Examiner*—Thorl Chea
(74) *Attorney, Agent, or Firm*—Margaret A. Burke; Sheldon J. Moss

(57) ABSTRACT

A photothermographic material including, on one side of a support, an image forming layer containing at least a photosensitive silver halide, a non-photosensitive organic silver salt, a reducing agent and a binder, and, on the other side of the support, a non-photosensitive back side layer. The total quantity of an alkaline earth metal contained in the non-photosensitive back side layer is $1\times10^{-5}$ mol/m$^2$ to $1\times10^{-3}$ mol/m$^2$.

12 Claims, No Drawings

PHOTOTHERMOGRAPHIC MATERIAL

CROSS-REFERENCE TO RELATED APPLICATION

This application is a continuation application of application Ser. No. 10/408,574 (publication No. 2004-0033449-A1) filed on Apr. 8, 2003, which is now U.S. Pat. No. 7,138,233, the disclosure of which is incorporated herein by reference in its entirety.

BACKGROUND OF THE INVENTION

1. Field of the Invention

The present invention relates to a photothermographic material (hereinafter referred to as simply "photosensitive material") and more specifically relates to a preferable photothermographic material for medical diagnosis, industrial diagnosis, industrial photography, printing and COM use.

2. Description of the Related Art

Recently, in the field of medical diagnosis films and photoengraving films, a strong need for reducing the volume of waste process liquid has arisen from the viewpoint of environmental preservation and space saving. Thus, a technology related to a photothermographic material as medical diagnosis film and photoengraving film has been desired, the material being such that it allows efficient light exposure with a laser image setter or laser imager, and providing a black image with a high resolution and sharpness. Such photothermographic material can provide the user with a more simple and environment-conscious thermal developing system using no solution-based process chemicals.

While a similar need has arisen in the field of general image forming materials, images used in the medical diagnosis field particularly require a high image quality such as excellent sharpness and graininess for fine depiction, and favor a blue-black tone for facilitating diagnosis. Although various hard copy systems using pigment or dye, exemplified as an inkjet printer and electronic photograph system, prevail as a general image forming system, none of these are satisfactory as an output system for medical images.

Organic silver salt-utilising thermally processed image forming systems are described in U.S. Pat. Nos. 3,152,904 and 3,457,075 as well as on page 279, Chapter 9, "Thermally Processed Silver Systems," (Imaging Processes and Materials) Neblette, 8th edition, authored by D. Klosterboer, compiled by J. Sturge, V. Walworth and A. Shepp (1989).

In general, photothermographic materials are provided with a photosensitive layer in which a photo catalyst in a catalytically active quantity (for example silver halide), a reducing agent, a reducible silver salt (for example, organic silver salt) and an color tone modifier for controlling silver tone when necessary are dispersed in the matrix of a binder.

Photothermographic materials are heated to higher temperatures (for example, 80° C. or greater) after images are exposed to light to cause an oxidation-reduction reaction between or reducible silver salt (acting as an oxidizing agent) and reducing agent, thus providing black silver image. Silver halide produced on exposure to light catalytically acts on a latent image to promote the oxidation-reduction reaction, thus producing the black silver image on exposed areas. This process has been disclosed in various literatures including U.S. Pat. No. 2,910,377 and JP-B No. 43-4924.

Photothermographic materials have enjoyed a favorable response from the market due to the above-explained favorable characteristics, finding various applications, which also entails further improvement in performance. Among other things, it has been a great challenge to improve the coating quality and raise the productivity during the coating process.

In the case of conventional photosensitive materials which were developed by chemical solutions, since the film is swollen at the time of treatment with chemical solutions and dried again, a slight uneven thickness of the membrane due to variation in coating is eased and not recognized at the time of image formation. In contrast, in the case of photothermographic materials which do not undergo swelling due to treatment with chemical solution, a slight uneven thickness of the film at the manufacturing stage may result in an interference band depending on the species of light source to affect diagnosis imaging.

Cissing defects will affect diagnosis imaging and must be removed at the manufacturing stage. Thus, prevention of cissing defects is always an important challenge in improving the productivity. Cissing defects should be removed not only in preparing the image-forming side but also in preparing the back side.

Conventionally, a binder similar to the binder used for the surface having an image-forming layer has been used as a binder for the non-photosensitive back side layer of photothermographic materials. For example, when an organic solvent is used as a coating solvent, cellulose esters are used as a binder for protecting the image-forming layer and also as a binder for the back layer.

It has been proposed recently that water-soluble polymers such as gelatin and polyvinyl alcohol are used on either side of the image-forming layer for the purpose of increasing film strength and image storability. Use of gelatin is desired because when gelatin is used as a binder, high-speed coating properties can be particularly improved, in addition to an increase in said properties. It has been known that polymer latexes are added for easing rigidity and imparting flexibility as a film, when gelatin is used as a binder. Since polymer latexes with a less glass transition temperature are more effective in imparting flexibility, commonly used are latexes such as polyethylacrylate with glass transition a temperature of −20° C. or less.

However, in photothermographic materials that are thermally developed at high temperatures (approximately 80 to 250° C.), an edge of the photosensitive material is curled upon thermal development, thus potentially making the development uneven and affecting development uniformity.

Further, photothermographic materials often include a dye that can be discolored upon thermal development so as to avoid color remaining and to attain clearness of an image. Thus, especially when such a discolorable dye is included in a photothermographic material, the discoloring effect does not work well on the edge, raising a problem of residual color.

Under these circumstances, the technology for controlling the curl of photosensitive materials upon thermal development is important and has been long awaited.

JP-A No. 11-352625 has described a non-photosensitive layer containing a dye that can be bleached with a base precursor and technology by which a water-soluble polymer such as polyacrylamides and dextrans as preferable examples are contained in a composition layer on the same side of the non-photosensitive layer. However, the present inventor evaluated the technology, finding that it was not very effective in improving residual color and unable to solve the above problems.

Conventionally, dyes are added to photography photosensitive materials for controlling filtration property and preventing halation or irradiation. In particular, medical diagnosis imaging requires very minute depiction, a high-quality image has been long desired that is excellent in sharpness and graininess. Thus, it is a common practice that these dyes provide functions on image exposure and are completely removed during development processes so that the image is not colored by absorption of the dye at a visible region after the image is formed.

In conventional wet developing processes, it is possible to elute out the dyes from a photosensitive material into a processing liquid, thus making it relatively easy to remove the dye from the photosensitive material. However, said removal is difficult in dry developing processes such as thermal development. Therefore, such a method has been already proposed that discolors a dye by using heat upon thermal development. For example, JP-A No. 11-352626 has disclosed a technology in that the melting point of base precursor is controlled to generate a base upon thermal development, thus attaining discoloring of the dye.

However, this technology is insufficient in discoloring the dye when photosensitive materials are much speedily subjected to thermal development, and is disadvantageous in that the color remaining of a dye occurs in the photothermographic material after processing.

Further, adding an excessive base precursors for improving the discoloration could cause another problem: heat during storage gradually deteriorates dye's absorption to improve filtration property and to prevent halation and irradiation when photosensitive materials are stored in an environment at high temperature.

SUMMARY OF THE INVENTION

An object of the present invention is to solve said problems and to attain specifically the following. The first object of the invention is to provide a photothermographic material having reduced reflection gloss irregularity on a non-photosensitive back side and fewer cissing defects.

The second object of the invention is to provide a photothermographic material having reduced curl at the edge of the photosensitive material upon thermal development and also exhibiting a discoloring effect of a discolorable dye even at the edge.

The third object of the invention is to provide a photothermographic material wherein light absorption of the dye for improving the sharpness and graininess at image exposure can be immediately discolored upon thermal development.

The fourth object of the invention is to provide a photothermographic material wherein the light absorption of the dye can be maintained stably and a good sharpness and graininess can be attained when the photothermographic material is stored.

These objects of the invention were achieved by the following photothermographic material.

Specifically, the first aspect of the invention is to provide a photothermographic material comprising, on one side of a support, an image forming layer containing at least a photosensitive silver halide, a non-photosensitive organic silver salt, a reducing agent and a binder and, on the other side of the support, a non-photosensitive back side layer, wherein a total quantity of one or more alkaline earth metals contained in the non-photosensitive back side layer is in a range from $1\times10^{-5}$ mol/m$^2$ to $1\times10^{-3}$ mol/m$^2$.

The second aspect of the invention is to provide a photothermographic material comprising, on one side of the support, an image forming layer containing at least a photosensitive silver halide, a non-photosensitive organic silver salt, a reducing agent and a binder and, on the other side of the support, a non-photosensitive back layer, wherein a total coating quantity of gelatin on a non-photosensitive back side is 0.5 times to 1.5 times a total coating quantity of gelatin on the side having the image forming layer, and the non-photosensitive back side possesses at least one polymer latex having a glass transition temperature in a range from −10° C. to 120° C.

The third aspect of the invention is to provide a photothermographic material comprising, on one side of a support, an optically functional layer that contains at least one dye that can be discolored by thermal development processing, wherein at least one of the optically functional layer and a layer adjacent thereto contains at least one polymer having a glass transition temperature in a range from −10° C. to 120° C.

DETAILED DESCRIPTION OF THE INVENTION

The photothermographic material as described in the first aspect of the invention is preferably a so-called single-sided photosensitive material comprising, on one side of the support, an image forming layer containing at least a silver halide emulsion and, on the other side of the support, a back layer. In the invention, one side of the support having the image-forming layer is designated as an image-forming side, and the side having the back layer is designated as a non-photosensitive back side.

The following is a detailed explanation regarding the first aspect of the invention.

1-1. Non-Photosensitive Back Side

1-1-1. Layer Composition

The non-photosensitive back side is provided with a back protective layer, whenever necessary, in addition to a non-photosensitive back layer. In some cases, the back layer or the back protective layer serves as an anti-halation layer.

In the invention, all the layers present on the non-photosensitive back side are collectively called as "non-photosensitive back side layer." To be more specific, for example, when the non-photosensitive back side possesses one back layer, the non-photosensitive back side layer means the one back layer, and when it possesses one back layer and one protective layer, the non-photosensitive back side layer means all these layers.

1-1-2. Composition

In the non-photosensitive back side layer of the invention, it is important that one or more alkaline earth metals are present in a total quantity of $1\times10^{-5}$ mol/m$^2$ or more and $1\times10^{-3}$ mol/m$^2$ or less.

When the non-photosensitive back side layer is composed of a plurality of layers, such as being made up with 2 layers or having a protective layer, it is necessary that a sum of coating quantity of an alkaline earth metal in all layers on the non-photosensitive back side is in the above range.

There are no restrictions on the composition of other non-photosensitive back side layers, as long as a total quantity of alkaline earth metals falls under the above range. In most cases, the non-photosensitive back side layer is preferably a coated layer that contains a binder as well as a matting agent and surfactant.

When desired, the back side layer may be provided with known materials such as a coloring agent, ultra-violet absorbing agent, crosslinking agent or antioxidant in a quantity that will not affect the characteristics of the photothermographic material of the invention.

The following is an explanation regarding the individual compositions.

1-1-3. Alkaline Earth Metal

Alkaline earth metal is a general term of beryllium, magnesium, calcium, strontium, barium and radium that fall under Group II of the Periodic Table.

In the invention, a total quantity of alkaline earth metals in the non-photosensitive back side layer is preferably $1\times10^{-5}$ mol/m$^2$ to $1\times10^{-3}$ mol/m$^2$, more preferably $2\times10^{-5}$ mol/m$^2$ to $8\times10^{-4}$ mol/m$^2$ and particularly preferably $5\times10^{-5}$ mol/m$^2$ to $5\times10^{-4}$ mol/m$^2$. The total quantity of alkaline earth metals is a sum of all said elements contained in the non-photosensitive back side layer. When the non-photosensitive back side layer is composed of 2 or more layers, it is a sum of alkaline earth metals contained in all the layers.

Further, regarding alkaline earth metals, it is preferable that a total combined quantity of magnesium and calcium is higher in the above range, and it is most preferable that a total quantity of calcium is higher in the above range.

Regarding alkaline earth metals, an aqueous solution of bases such as calcium nitrate, calcium chloride, magnesium nitrate and magnesium chloride may be added to a coating liquid and calcium can be appropriately adjusted by adding the aqueous solution to gelatin used as a binder.

Gelatin is ordinarily treated by lime solution and calcium may be included during said treatment.

Gelatins in which the calcium content is decreased by ion exchange treatment have been commonly used within the industry.

It is preferable that alkaline earth metals in a coating liquid is incorporated in a total quantity of alkaline earth metals ranging from $1\times10^{-5}$ mol/m$^2$ or greater and $1\times10^{-3}$ mol/m$^2$ or less in preparing not only a non-photosensitive back side but also an image forming side.

A quantity of alkaline earth metals can be determined from gelatin powder to be used according to a method wherein a diluted solution of gelatin decomposed by addition of nitric acid and heat treatment is subjected to spectrophotometry by using a flame-type atomic absorption photometer to obtain absorption for sample solutions prepared for each alkaline earth metal, and Thus obtained absorption results are used to determine the quantity.

Regarding the above method, please refer to "Determination Method of Metal Content," Item 18, on page 28, "Photography gelatin test method (PAGI method), 7th edition (Joint Meeting from Photography Gelatin Test Method. Published October 1992)

When the quantity is determined from a photosensitive material, a gelatin layer on a fixed area of the side to be determined is removed in an enzymatic method, and the removed layer containing liquid (diluted if necessary or after further decomposition by addition of nitric acid and heat) is subjected to atomic absorption spectrophotometry in the same manner as in the above gelatin determination.

1-1-4. Binder (Species)

Any polymer can be used as a binder for a non-photosensitive back side layer of the invention. Preferable binders are transparent or semi-transparent and generally colorless, and such polymers include vehicles which form natural resins, polymers and copolymers, synthesized resins, polymers and copolymers and other films, for example, gelatins, rubbers, poly (vinyl alcohols), hydroxyethyl celluloses, cellulose acetates, cellulose acetate butylates, poly (vinyl pyrrolidones), caseins, starches, poly (acrylic acids), poly (methyl methacrylic acids), poly (vinyl chlorides), poly (methacrylic acids), styrene-anhydrous maleic acid copolymers, styrene-acrylonitrile copolymers, styrene-butadiene copolymers, poly (vinyl acetals) (for example, poly (vinyl formals) and poly (vinyl butyrals), poly (esters), poly (urethanes), phenoxy resins, poly (vinylidene chlorides), poly (epoxides), poly (carbonates), poly (vinyl acetates), poly (olefins), cellulose esters and poly (amides). The binders may be formed by coating with water, organic solvents or emulsions.

In this invention, binders usable in organic silver salt-containing layers preferably have a glass transition temperature exceeding 0° C. and not more than 80° C. (hereinafter, called high Tg binder), more preferably exceeding 10° C. and not more than 70° C. and still more preferably exceeding 15° C. and not more than 60° C.

In the specification of the invention, Tg was calculated by referring to the following formula.

$$1/Tg=\Sigma(Xi/Tgi)$$

Wherein the polymer is considered to havecopolymerization of n-number of monomers ranging from i=1 to n. Xi is the mass fraction of the first monomer ($\Sigma xi=1$), Tgi is the glass transition temperature of i-numbered monomer as photopolymer (absolute temperature). However, $\Sigma$ is a sum of the numbers from i=1 to i=n. The value of the glass transition temperature of each monomer as a photopolymer (Tgi) was adopted from that in the Polymer Handtext (3rd edition) (J. Brand rup, E. H. Immergut) (Wiley-Interscience, 1989).

The binder may be used in combination with 2 or more species when necessary. It is also preferable to use a polymer whose glass transition temperature is 20° C. or higher together with that whose glass transition temperature is not more than 20° C. When two or more species of polymers with different Tg are blended, it is preferable that the weight average Tg falls under the above range.

The following is an explanation regarding gelatins that can be used as a binder and polymers other than gelatins.

(1) Gelatin (i) Species

Various species of gelatins may be used as the gelatin of the invention. It is preferable to use a gelatin with a molecular weight of 10,000 to 1,000,000, although there are no specific restrictions on the use of gelatins. The molecular weight hereof the mean number average molecular weight calculated by referring to styrene conversion by gel permeation chromatography (GPC).

(ii) Preferable Species

The photothermographic material of the invention preferably contains on the non-photosensitive back side layer of the invention a gelatin whose isoelectric point is 5.0 to 9.5 (hereinafter referred to as "specific gelatin").

The following is an explanation regarding the specific gelatin of the invention.

In the specific gelatin of the invention, a desirable range of the isoelectric point is fundamentally determined by the performance required for photothermographic materials. An excessively high isoelectric point may restrict a pH range of coating liquid, depending on the type of additive agents to the coating liquid, because of the necessity for avoiding aggregation of the coating liquid. In the specific gelatin of the invention, the isoelectric point is 5.0 to 9.5, preferably 5.5 to 8.5 and still more preferably 5.5 to 8.0, with this point of view taken into account.

In said gelatin, the isoelectric point can be determined by referring to a pH measured after a 1% gelatin solution is filtered through an ion exchange resin of a mixed bed consisting of cation and anion, which is described in "Isoelectric Focusing" (Maxey, C. R (1976; Phitogr.Gelatin 2, Editor Cox, P.J. Academic, London, Engl. Reference) or "Photography Gelatin Test Method (PAGI method), 7th edition published October 1992, by PAGI Method Joint Meeting).

Examples of said specific gelatin include lime-treated gelatin, acid-treated gelatin or other gelatins whose isoelectric point is controlled by chemical modification of a functional group of the gelatin.

In the invention, the preferable specific gelatin includes acid-treated gelatin, because in general, acid treated gelatin is higher in the isoelectric point than lime-treated gelatin.

The acid-treated gelatin is generally produced by soaking raw materials such as pig skin, cattle skin, cattle bone or ossein into a solution of acid such as hydrochloric acid, sulfuric acid, sulfurous acid and phosphoric acid or their mixture solution. Particularly for the purpose of controlling the isoelectric point, it is preferable to carry out soaking with lime solution or caustic soda in combination with soaking with acid solution. A specific method for manufacturing gelatin is described in "The Macromolecular Chemistry of Gelatin" authored by Arther Vice (Academic Press, published 1964).

Gelatins preferably used in the invention include acid-treated gelatin, such as 950 gelatin (manufactured by Nitta Gelatin Inc.), PS Gelatin and ABA Gelatin (both manufactured by Nippi Inc.), all of which are commercially available.

In the invention, preferably used are esterified gelatins (methyesterification) or amide-treated gelatins (ethylamide conversion), which were elevated for the isoelectric point of lime treated gelatins, in addition to said acid-treated gelatin.

Esterification is effected by an hydrochloric acid-methanol method described in H. Fraenkel-Conrat, H. S. Olcott, J. Biol. Chem., 161/259 (1945), thionyl chloride methanol method described in J. Bello, Bio Chem. Biophys. Acta., 20,456 (1956), Sulfuric acid-methanol method described in A. W. Kenchington, Biochem. J., 68,458 (1958) and hydrochloric acid-methanol method described in E. Kein, E. Moioar, E. Roche, J. Photongr. Sci., 19,55 (1971).

Amide conversion can be effected by amide-converted gelatin by using water soluble carbodiimide described in D. G. Hoare, D. E. Koshland Jr., J. Am. Chem. Soc., 88, 2057 (1966).

In the specific gelatin of the invention, the physical properties require that the isoelectric point should fall under the above range and other preferable physical properties are described below.

Jelly strength (defined according to PAGI method) is preferably 200 g to 350 g and more preferably 250 g to 350 g. The strength is specifically determined by a broom-type jelly intensimeter or texture analyzer, as described in the PAGI method the 7th edition (published 1992).

Viscosity (defined by PAGI method) is preferably 20 mp to 120 mp and more preferably 35 mp to 90 mp.

Permeability (defined by PAGI method) is preferably 50% or greater and more preferably 80% or greater.

Electric conductivity (defined by PAGI method) is preferably 800 μS/cm or less, more preferably 400 μS/cm or less and most preferably 200 μS/cm or less.

PH value (defined by PAGI method)is preferably 4.0 to 7.0 and more preferably 5.0 to 6.5.

(iii) Added Quantity

It is preferable that gelatin is added to a binder contained in the non-photosensitive back side layer in a range from 50% by mass to 100% by mass. When the non-photosensitive back side layer is composed of 2 or more layers, it is preferable that gelatin is added to the binder contained in all the layers in a total quantity from 50% by mass to 100% by mass. It is particularly preferable that gelatin is added in a quantity of 60 to 90% by mass. When the non-photosensitive back side layer is composed of 2 or more layers, it is preferable that a coating liquid for forming the farthest layer from the support (hereinafter, outermost layer) is 3.0 to 10.0% by mass in gelatin concentration. Particularly preferable concentration is 3.5 to 8.0% by mass.

(iv) Coating Quantity

In the photothermographic material of the invention, it is preferable that a total gelatin coating quantity of the non-photosensitive back side layer is 0.5 times to 1.5 times a total gelatin coating quantity of the layer that forms an image-forming side. Still more preferable is 0.7 times to 1.3 times.

When the non-photosensitive back side layer is composed of 2 or more layers, the mass for a unit area of total gelatin contained in all the layers is defined as "total gelatin coating quantity of a non-photosensitive back side. Similarly, when the image-forming layer is composed of 2 or more layers, the mass for a unit area of total gelatin contained in all the layers is defined as a "total gelatin coating quantity of image forming layer."

Gelatin coating quantity of the non-photosensitive back side is preferably 1.0 $g/m^2$ or greater and 3.0 $g/m^2$ or less, and more preferably 1.5 $g/m^2$ or greater and 3.0 $g/m^2$ or less. When the non-photosensitive back side layer is composed of 2 or more layers, a total coating quantity of gelatin contained in all the layers is preferably in said range.

(2) Polymers Other Than Gelatin (i) Species

It is preferable that at least one species of polymer other than a gelatin whose glass transition temperature (hereinafter abbreviated as Tg when necessary)is −10° C. or higher and 120° C. or less is contained in the back side layer of the photothermographic material of the invention.

Said polymers may include any polymers other than gelatin as long as the glass transmission temperature is −10° C. or higher and 120° C. or less. The preferable polymers are transparent or semi-transparent, in general, colorless. Preferable polymers whose glass transition temperature is −10° C. or higher and 120° C. or less include a natural resins, polymer or copolymer, synthesized resins, polymer or copolymers, and other film-forming medium. Their examples include rubbers, poly (vinyl alcohols), hydroxyethyl celluloses, cellulose acetates, cellulose acetate butylates, poly (vinyl pyrrolidones), caseins, starches, poly (acrylic acids), poly (methyl methacrylic acids), poly (vinyl chlorides), poly (methacrylic acids), styrene-anhydrous maleic acid copolymers, styrene-acrylonitrile copolymers, styrene-butadiene copolymers, poly (vinyl acetals) (for example, poly (vinyl formals) and poly (vinyl butyrals), poly (esters), poly (urethanes), phenoxy resins, poly (vinylidene chlorides), poly (epoxides), poly (carbonates), poly (vinyl acetates), poly (olefins), cellulose esters and poly (amides).

(ii) Species of Preferable Polymers

In the invention, the preferable polymer to be contained in the back side layer is polymer latex due to its good color remaining property of a thermally discolorable dye.

Particularly, regarding example in a state of dispersion, latexes in which a water-insoluble hydrophobic polymer is dispersed in a state of micro-particle or those in which polymer molecules are dispersed in a state of molecules or micelle may be usable and preferably in a state of latex-dispersion particles. The mean size of dispersed particles is 1 to 50000 nm, preferably 5 to 1000 nm, more preferably 10 to 500 nm and still more preferably 50 to 200 nm. There are no particular restrictions on the particle size distribution of dispersed particles. More particularly, particle size distribution of said polymers may be used that is wider or of monodispersion. Mixing of 2 or more species with particle size distribution that is of monodispersion is also preferable in controlling physical properties of a coating liquid.

In the invention, preferable examples of aqueous solvent-dispersible polymers include hydrophobic polymers such as acrylic polymer, poly (esters), rubbers (for example, SBR resin), poly (urethanes), poly (vinyl chlorides), poly (vinyl acetates), poly (vinylidene chlorides) and poly (olefins). Further, the following polymers can be used in the invention; straight chain polymers, branched chain polymers, or cross-like polymers, a so-called homopolymer made through polymerization of monomers and copolymers made through polymerization of 2 or more types of monomers. In the case of copolymers, either a random copolymer or block copolymer may be employed. These polymers are preferably 5,000 to 1,000,000 in number average molecular weight and more preferably 10,000 to 200,000. Particularly suitable polymers are cross-link polymer latexes.

(iii) Example of Preferable Polymer Latexes

Examples of preferable polymer latexes include the following, which are shown in the form of starting material monomers. The number given in parentheses means % by mass, and the molecular weight is number average molecular weight. When multifunctional monomers are used, the word, crosslinking, is described and the molecular weight is omitted, because a concept of molecular weight for building cross-link structure is not applicable.

B-1;-MMA(70)-EA(27)-MAA(3)-latex (Molecular weight 37000, Tg 61° C.)

B-2;-MMA(70)-2EHA(20)-St(5)AA(5)-latex (Molecular weight 40000, Tg 59° C.)

B-3;-MMA(63)-EA(35)-AA(2)-latex (Molecular weight 33000, Tg 47° C.)

B-4;-St(67)-Bu(30)-DVB(0.5)-HEMA(2.5)-latex (crosslinking, Tg 14° C.)

B-5;-St(75)-Bu(24)-AA(1)-latex (crosslinking, Tg 29° C.)

B-6;-St(68)-Bu(29)-AA(3)-latex (crosslinking, Tg 18° C.)

B-7;-St(71)-Bu(26)-AA(3)-latex (crosslinking, Tg 24° C.)

B-8;-St(74)-Bu(23)-AA(3)-latex (crosslinking, Tg 31° C.)

B-9;-St(77.5)-Bu(19.5)-AA(3)-latex (crosslinking, Tg 40° C.)

B-10;-St(81.3)-Bu(15.7)-AA(3)-latex (crosslinking, Tg 50° C.)

B-11;-St(84.8)-Bu(12.2)AA(3)-latex (crosslinking, Tg 60° C.)

B-12;-St(88)-Bu(9)-AA(3)-latex (crosslinking, Tg 70° C.)

B-13;-St(70)-2EHA(27)-AA(3)-latex (Molecular weight 130000, Tg 43° C.)

B-14;-St(57)-MMA(9)-BA(28)-HEHA(4)-AA(2)-latex (Tg 50° C.)

The abbreviations in the above structures correspond with monomers as follows:

EA: ethyl acrylate
BA: butyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
HEMA: hydroxyethyl methacrylate
Et: ethylene
IA: itaconic acid The above-described polymer latexes are commercially available, with the following brand names. Examples of acrylic polymers include Cevian A-4635, 4718 and 4601 (all produced by Daicel Chemical Industries Ltd.) and Nipol Lx811, 814, 821, 820 and 857 (all produced by Zeon Corporation). Examples of poly (esters) include FINETEX ES 650, 611, 675 and 850 (all produced by Dai Nippon Ink & Chemicals, Inc.) and WD-size WMS (all produced by Eastman Chemical, Ltd.). Examples of poly (urethanes) include HYDRAN AP10, 20 30 and 40 (all produced by Dai Nippon Ink & Chemicals, Inc.). Examples of rubbers include LACSTAR 7310K, 3370B 4700H and 7132C (all produced by Dai Nippon Ink & Chemicals, Inc.) and Nipol Lx416, 410, 438C and 2507 (all produced by Zeon Corporation). Examples of poly (vinyl chlorides) include G351 and G576 (all produced by Zeon Corporation). Example of poly (vinylidene chlorides) include L502 and L513 (all produced by Asahi Kasei Corporation). Example of poly (olefins) include CHEMIPEARL S120 and SA100 (all produced by Mitsui Chemicals, Inc.).

The polymer latex may be used solely or in combination with 2 or more species of polymers when necessary.

The polymer latex of the invention is preferably a polymer latex containing styrene, more preferably that having a mass ratio of a styrene monomer unit to copolymer in a range of 40 to 99% by mass and particularly preferably a latex of a styrene-butadiene copolymer. The weight ratio of a styrene monomer unit and butadiene monomer unit to a styrene-budadiene copolymer is preferably in a range of 40:60 to 95:5. The proportion of a styrene monomer unit and butadiene monomer unit to the copolymer is preferably 60 to 99% by mass. The polymer latex of the invention preferably contains a monomer having a hydrophilic group such as acrylic acid or methacrylic acid in a range of 1 to 15% by mass and more preferably in a range of 2 to 10% by mass based on a sum of styrene and butadiene.

Preferable styrene-butadienecopolymer latexes of the invention include the foregoing B-4 to B-13 and commercial products such as LACSTAR-3307B, 7132C, Nipol Lx416.

(iv) Content

The polymer whose glass transition temperature is −10° C. or higher and 120° C. or lower contained in the back side layer of the invention is preferably in a range of 10% to 50% by mass based on gelatin in the non-photosensitive back side layer and more preferably in a range of 20% to 40% by mass.

In this instance, when the non-photosensitive back side layer is composed of multiple layers, the polymer content is calculated by referring to a total mass of said polymer contained in all the layers of said polymer and a total mass of gelatin contained in all the layers.

When the non-photosensitive back side layer comprises two layers, it is preferable that a content ratio of polymer to gelatin is greater in the back side layer closer to the support than in the back side layer further from the support.

(v) Coating Quantity

In the invention, it is preferable that said polymer of the non-photosensitive back side layer is preferably 0.1 to 1.5 $g/m^2$ and more preferably 0.2 to 1.2 $g/m^2$ based on the total coating quantity.

(vi) Glass Transition Temperature

In the invention, the glass transition temperature to a polymer is preferably −10° C. to 120° C., and more preferably 0° C. to 80° C., and most preferably 0° C. to 60° C.

Two or more polymers may be used in a state of copolymerization when necessary. When 2 or more species of polymers with different Tg are blended, it is preferable that the weight average Tg falls under the above range.

(vii) Moisture Content

In the invention, the polymer contained in the back side layer is preferably 2% by mass or less (equilibrium moisture content) at 25° C. and 60% RH, because of a better color remaining of the thermally discolorable dye. More preferable is 0.01% by mass or higher and 1.5% by mass or lower, and still more preferable is 0.02% by mass or higher and 1% by mass or less.

The equilibrium moisture content at 25° C. and 60% RH can be expressed as follows by referring to W1, weight of polymer whose moisture is maintained at equilibrium at 25° C. and 60% RH, and to WO, weight of a polymer maintained absolutely dry at 25° C.

$$\text{Equilibrium moisture content at 25° C. and 60\% } RH = [(W1-WO)/WO]\times 100 \text{ (\% by mass)}$$

The definition and method for determining the moisture content can be, for example, referred to in High Molecular Engineering Courses 14 (compiled by the Society of Polymer Science, Japan, Chijinshokan).

(viii) Addition

Said polymers may be added to the layer compositions of the image forming side described below in Item: 1-2-1, (1) protective layer, (2) intermediate layer and (3) prime coat or undercoat layer, in addition to the back side layer.

1-1-5. Dye Discolorable by Thermal Development Processing

It is preferable that the non-photosensitive back side layer of the invention contains a dye that is discolorable by thermal development processing (hereinafter referred to as thermally discolorable dye from time to time).

The thermally discolorable dye of the invention is designated as a dye for attaining optical functions such as filtration, irradiation prevention or halation prevention, preferably available as a solid micro-particle dye. Further, the thermally discolorable dye of the invention may be used in combination with a dye not discolorable by thermal development processing.

The thermally discolorable dye can be added to the prime coat or undercoat layer provided between the non-photosensitive back side layer and the support or the image forming layer and the support.

Said thermally discolorable dye may be added solely or in combination with 2 or more species. When 2 or more layers are formed that contain the thermally discolorable dye, a different species of the thermally discolorable dye may be used individually in these layers, or the thermally discolorable dyes with different or same species may be added.

(1) Configuration

In the invention, the number of solid micro-particles in a solid micro-particle state of said thermally discolorable dye can be counted by removing the film of the photosensitive layer of the photothermographic material and photographing the transmittance image or reflection image for a unit area of 0.1 $mm^2$ under an optical microscope to obtain the particles with a 1 μm or longer circle equivalent diameter for a projected area. In this instance, the number of particles having a 1 μm or longer circle equivalent diameter for the project area is preferably 100 particles or fewer and more preferably 50 particles or fewer and particularly preferably 25 particles or fewer.

When said thermally discolorable dye is in a state of a solid micro-particle, volume weighted average size of solid micro-particle is preferably 1.0 μm or less, more preferably 0.6 μm or less and particularly preferably 0.3 μm or less.

In this instance, the volume weighted average of particle size can be calculated as follows: dye dispersion (a sample) is dry fixed on a mesh and given carbon evaporation, then subjected to electron-microscopic photography, with an appropriate slant position maintained, and the sphere equivalent diameter and particle volume of individual dye particles is determined to calculate the volume weighted average of particle size. When particles may be photographed in an overlapped state, such particles are counted as one particle. The number of particles in a sample is preferably approximately 500 to 1000.

(2) Added Quantity

Said thermally discolorable dye should be added in a quantity that allows the optical density (absorbance) measured at an intended wavelength to exceed 0.1. The optical density is preferably 0.15 to 2, more preferably 0.2 to 1. A quantity of dye for obtaining the optical density is ordinarily in a range of 0.001 to 1 $g/m^2$.

Further, after thermal development, the optical density is preferably 0.1 or less, in terms of the discoloring effect of the dye.

(3) Preferable Thermally Discolorable Dye

The following is a detailed explanation regarding the thermally discolorable dye of the invention.

Said thermally discolorable dye that are preferably used in the invention include a dye or a salt thereof, which can be discolored in particular by a base (hereinafter referred to as a discolorable dye). Preferable are cyanine dye or its salt shown in the general formula (1), General formula (1)

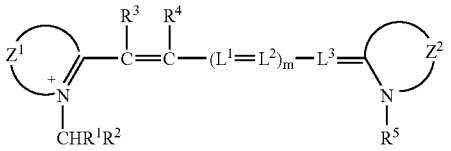

In the general formula (1), $R^1$ represents an electron attracting group, $R^2$ represent a hydrogen atom, an aliphatic group or an aromatic group, $R^3$ and $R^4$ independently represent a hydrogen atom, a halogen atom, an aliphatic group, an aromatic group, $—NR^6R^7$, $—OR^6$ or $—SR^7$, $R^6$ and $R^7$ independently represent a hydrogen atom, an aliphatic group or an aromatic group, $R^5$ represents an aliphatic group, $L^1$,$L^2$ and $L^3$ represent independently a methine that may be substituted. Methine substituents may bond to form an unsaturated aliphatic ring or unsaturated heterocycle. $Z^1$ and $Z^2$ respectively represent an atomic group that forms pentagonal or hexagonal nitrogen-containing a heterocycle, and the nitrogen-containing heterocycle may be condensed with an aromatic ring, and the nitrogen-containing heterocycle and the condensed ring may be provided with a substituent. m represents 0, 1, 2 or 3.

The following is a detailed explanation regarding the compound expressed by the general formula (1). In the general formula (1), $R^1$ represents an electron-attracting group. The Hammett substituent constant σm (for example, described in Chem. Rev., 91,165(1991)) is preferably 0.3 or more and 1.5 or less, and the substituent or cyano group represented by —C(=O)$R^{11}$, —SOp$R^{12}$ is an example, and —C(=O)$R^{11}$ is a preferable example. $R^{11}$ represents a hydrogen atom, an aliphatic group, an aromatic group, —$OR^{13}$, —$SR^{13}$ or $NR^{13}R^{14}$. $R^{12}$ represents an aliphatic group, an aromatic group, —$OR^{13}$, or $NR^{13}R^{14}$, and p represents 1 or 2. $R^{13}$ and $R^{14}$ each independently represent a hydrogen atom, an aliphatic group or an aromatic group, or otherwise $R^{13}$ and $R^{14}$ may bond to each other to form a nitrogen-containing heterocycle. $R^1$ is more preferably —C(=O)$R^{11}$ in which $R^{11}$ is —$OR^{13}$ or —$NR^{13}R^{14}$, and most preferably —C(=O)$R^{11}$ in which $R^{11}$ is —$NR^{13}R^{14}$, in view of storability of the photosensitive material.

In the general formula (1), an aliphatic group means an alkyl group, a substituted alkyl group, an alkenyl group, a substituted alkenyl group, an alkynyl group, a substituted alkynyl group, an aralkyl group or a substituted aralkyl group. In the invention, preferable are an alkyl group, a substituted alkyl group, an alkenyl group, a substituted alkenyl group, an aralkyl group and a substituted aralkyl group. More preferable are an alkyl group, a substituted alkyl group, an aralkyl group and a substituted aralkyl group. A cyclic aliphatic group is more preferable than a chain aliphatic group. A straight chain aliphatic group may be provided with branches. An alkyl group has preferably 1 to 30 carbon atoms, more preferably 1 to 20 and particularly preferably 1 to 15. An alkyl part of a substituted alkyl group is the same as an alkyl group.

In the general formula (1), an alkenyl group and an alkynyl group have preferably 2 to 30 carbon atoms, more preferably 2 to 20 and still more preferably 2 to 15. An alkenyl part of the substituted alkenyl group and an alkynyl part of the substituted alkynyl group are respectively the same as an alkenyl group and alkynyl group.

In the general formula (1), aralkyl group has preferably 2 to 30 carbon atoms, more preferably 2 to 20, and still more preferably 2 to 15. An aralkyl part of the substituted aralkyl group is the same as an aralkyl group.

In the general formula (1), an aromatic group means an aryl group or substituted aryl group. Aryl group has preferably 6 to 30 carbon atoms, more preferably 6 to 20 and still more preferably 6 to 15. An aryl part of the substituted aryl group is the same as an aryl group.

There are no particular restrictions on the substituents that the above-described groups may have. For example, they include a carboxyl group (or salt), sulfo group (or salt), sulfone amide group with 1 to 20 carbon atoms (for example, methane sulfone amide, benzene sulfone amide, butane sulfone amide, n-octane sulfone amide), a sulfamoyl group with 0 to 20 carbon atoms (for example, unsubstituted a sulfamoyl, methylsulfamoyl, phenyl sulfamoyl, butysulfamoyl), a sulfonylcarbamoyl group with 2 to 20 carbon atoms (for example, methane sulfonylcarbamoyl, propane sulfonylcarbamoyl, benzene sulfonylcarbamoyl), an acylsulfamoyl group with 1 to 20 carbon atoms (for example, acetylsulfamoyl, propionylsulfamoyl, benzyolsulfamoyl), a chain or cyclic alkyl group with 1 to 20 carbon atoms (for example, methyl, ethyl, cyclohexyl, trifluoromethyl, 2-hydroxyethyl, 4-carboxybutyl, 2-methoxyethyl, 2-ethoxyethyl, benzyl, 4-carboxybenzyl, 2-diethyl aminoethyl), an alkenyl group with 2 to 20 carbon atoms (for example, vinyl and aryl), alkoxy group with 1 to 20 carbon atoms (for example, methoxy, ethoxy, and butoxyl), a halogen atom (for example, F, Cl, Br), an amino group with 0 to 20 carbon atoms (for example, an unsubstituted amino group, dimethylamino, diethylamino, carboxyethylamino), an alkoxy carbonyl group with 2 to 20 carbon atoms (for example, methoxycarbonyl), an amide group with 1 to 20 carbon atoms (for example, acetoamide, benzamide, 4-chlorobenzamide), a carbamoyl group with 1 to 20 carbon atoms (for example, unsubstituted carbamoyl, methylcarbamoyl, phenylcarbamoyl, benzoimidazole-2-on carbamoyl), an aryl group with 6 to 20 carbon atoms (for example, phenyl, naphtyl, 4-carboxyphenyl, 4-methane sulfone amide phenyl, 3-benzoylamino phenyl), an aryloxy group with 6 to 20 carbon atoms (for example, phenoxy, 3-methylphenoxy, naphtoxy), an alkylthio group with 1 to 20 carbon atoms (for example, methylthio, octylthio), an arylthio group with 6 to 20 carbon atoms (for example, phenyl thio, naphtylthio), an acyl group with 1 to 20 carbon atoms (for example, acetyl, benzoyl, 4-chlorobenzoyl), a sulfonyl group with 1 to 20 carbon atoms (for example, methane sulfonyl and benzene sulfonyl), an ureido group with 1 to 20 carbon atoms (for example, methyl ureido and phenyl ureido), an alkoxy carbonylamino group with 2 to 20 carbon atoms (for example, methoxycarbonylamino, hexyloxycarbonylamino), a cyano group, hydroxyl group, a nitro group, a heterocyclic group (examples of heterocycles are 5-ethoxycarbonyl benzoxazole ring, pyridine ring, sulfolane ring, furan ring, pyrrole ring, pyrrolidine ring, morphorine ring, piperazine ring, pyrimidine ring, phthalimide ring, tetrachlorophthalimide ring, benzoisoquinoline dione ring).

In the general formula (1), $R^2$ represents a hydrogen atom, an aliphatic group or an aromatic group. An aliphatic group and aromatic group are the same as those defined previously. $R^2$ is preferably a hydrogen atom or an aliphatic group, more preferably a hydrogen atom or an alkyl group, still more preferably a hydrogen atom or an alkyl group with 1 to 15 carbon atoms, and most preferably a hydrogen atom.

In the general formula (1), $R^3$ and $R^4$ independently represent a hydrogen atom, a halogen atom, an aliphatic group, an aromatic group, —$NR^6R^7$, —$OR^6$ or $SR^7$. $R^6$ and $R^7$ independently represent a hydrogen atom, an aliphatic group or an aromatic group. The definition of an aliphatic group and aromatic group is the same as that described previously. $R^3$ and $R^4$ are preferably a hydrogen atom or an aliphatic group, more preferably a hydrogen atom, an alkyl group, a substituted alkyl group, an aralkyl group or a substituted aralkyl group, still more preferably a hydrogen atom, an alkyl group or an aralkyl group, most preferably a hydrogen atom.

In the general formula (1), $R^5$ is an aliphatic group. The definition of an aliphatic group is the same as that defined previously. $R^5$ is preferably a substituted alkyl group and particularly preferably a substituted alkyl group with the same definition as that defined for —$CHR^1R^2$ in view of easiness of synthesis.

In the general formula (1), $L^1$, $L^2$ and $L^3$ are independently a methine that may be substituted. Substituents of methine are exemplified as a halogen atom, an aliphatic group and an aromatic group. The definition of an aliphatic group and an aromatic group is the same as that defined previously. The substituents of methine may bond to form an unsaturated aliphatic ring or unsaturated heterocycle. An unsaturated aliphatic ring is more preferable than an unsaturated heterocycle. Preferable rings to be produced are a hexagonal or heptagonal ring, and more preferable are a cycloheptene ring or cyclohexene ring. It is particularly preferable that methine is unsubstituted or provided with a cyclohepten ring or cyclohexene ring.

In the general formula (1), $Z^1$ and $Z^2$ are independently an atomic group that forms pentagonal or hexagonal nitrogen-containing heterocycle. Examples of the nitrogen-containing heterocycle include an oxazole ring, thiazole ring, selenzole ring, pyrroline ring, imidazole ring and pyridine ring. A pentagonal ring is more preferable than a hexagonal ring. A nitrogen-containing heterocycle may be condensed with an aromatic ring (benzene ring and naphthalene ring). Nitrogen-containing heterocycle and the condensed ring may be provided with a substituent. The definition of a substituent is the same as that defined previously. In the general formula (1), m is 0, 1, 2 or 3.

The cyaninedye expressed by the general formula (1) preferably forms a base with anion. Where the cyaninedye expressed by the general formula (1) is provided with an anion base such as a carboxy group or sulfo group as a substituent, a dye is able to form intramolecular salt. Otherwise, it is preferable to form salt with an extramolecular anion. The anion is preferably monovalent or divalent and more preferably monovalent. Examples of anion include a halogen ion (Cl—, Br—, I—), p-toluene sulfononic acid ion, ethylsulfuric acid ion, 1,5-disulfonnaphthalene dianion, $PF_6$—, $BF_4$— and $ClO_4$—. Preferable cyanine dye is expressed by the general formula (1a) below.

General formula (1a)

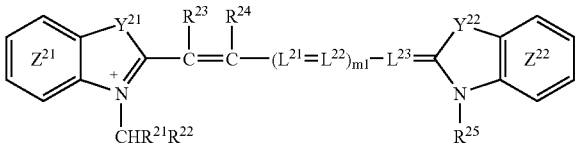

$R^{21}$, $R^{22}$, $R^{23}$, $R^{24}$, $R^{25}$, $L^{21}$, $L^{22}$, $L^{23}$ and $m_1$ expressed by the general formula (1a), are the same in meaning as $R^1$, $R^2$, $R^3$, $R^4$, $R^5$, $L^1$, $L^2$, $L^3$ and m expressed by the general formula (1).

In the general formula (1a), $Y^{21}$ and $Y^{22}$ are independently —$CR^{26}R^{27}$, —$NR^{26}$—, —O—, —S— or Se—. $R^{26}$ and $R^{27}$ are independently a hydrogen atom or an aliphatic group and may bond to each other to form a ring. An aliphatic group is particularly preferably an alkyl group or a substituted alkyl group.

In the general formula (1a), benzene rings $Z^{21}$ and $Z^{22}$ may be further condensed with other benzene rings. Benzene rings $Z^{21}$ and $Z^{22}$ as well as their condensed rings may be provided with a substituent. The definition of the subsistent is the same as that defined before.

In the general formula (1a), $m_1$ is 0, 1, 2 or 3. The cyaninedye expressed by the general formula (1a) preferably forms salt with an anion. The formation of the salt was as explained previously in the general formula (1).

The following shows examples of dyes and their salts [(1) to (43)] that can be discolored by base, which are not construed to limit the scope of the invention.

(1)

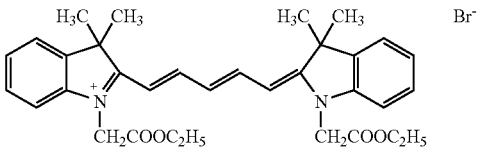

(2)

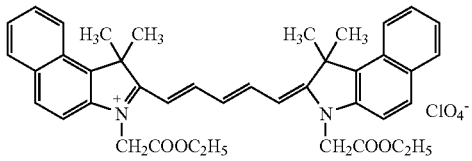

(3)

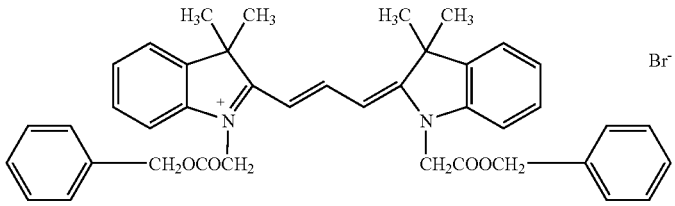

(4)

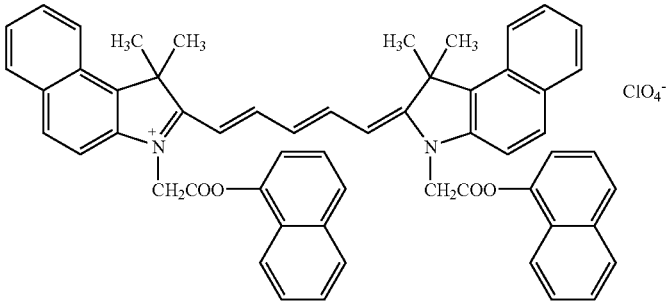

-continued
(5)
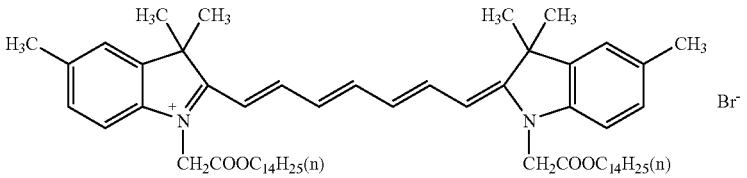
(6)
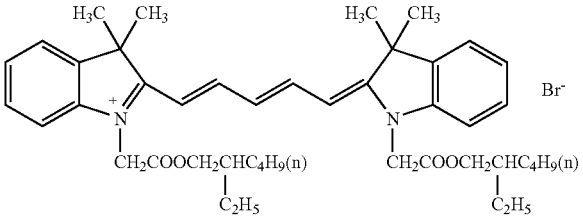
(7)
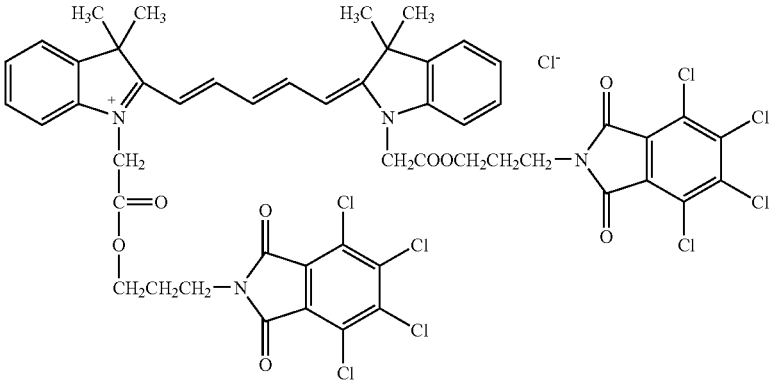
(8)
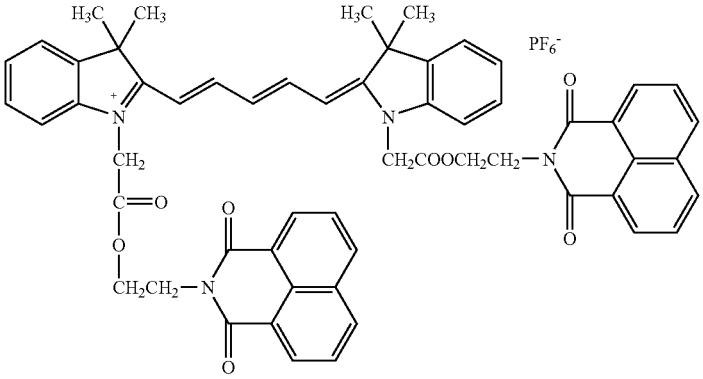
(9)
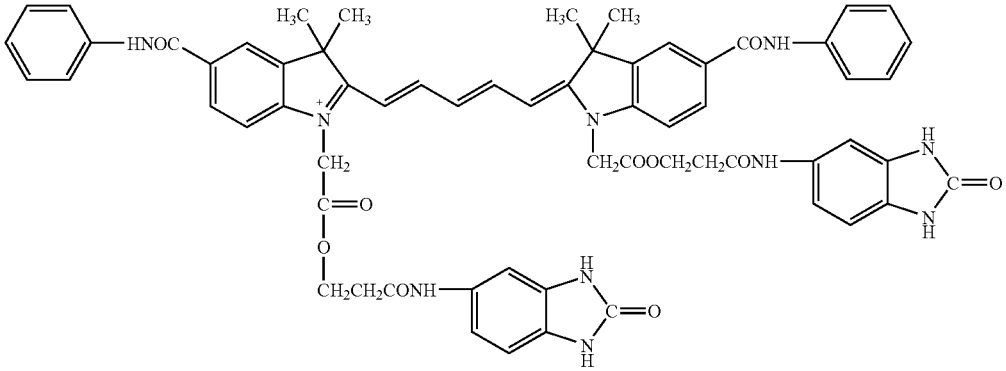

-continued
(10)
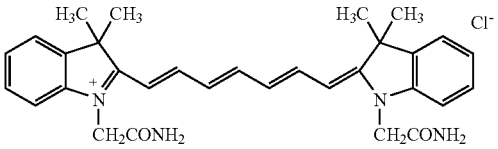
(11)
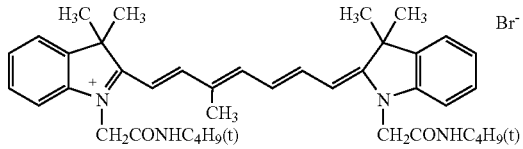
(12)
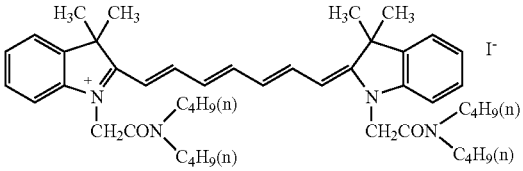
(13)
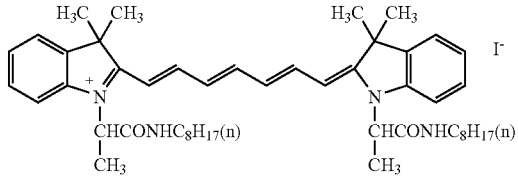
(14)
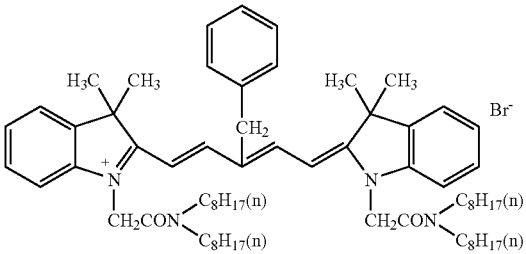
(15)
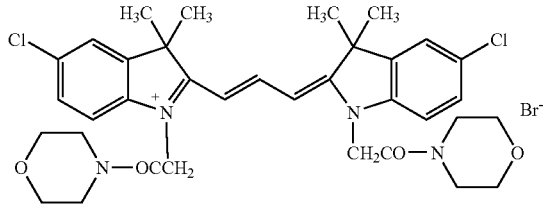
(16)
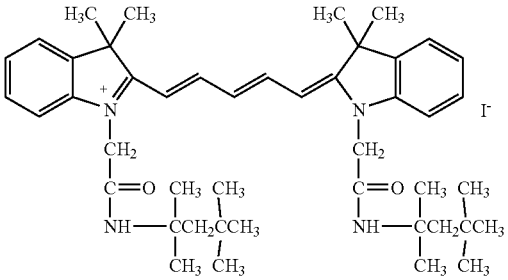
(17)
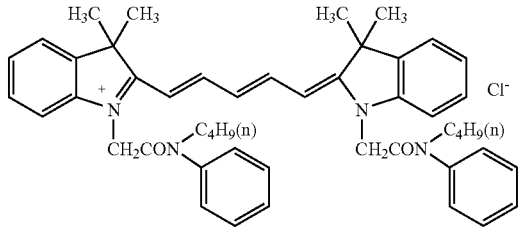
(18)
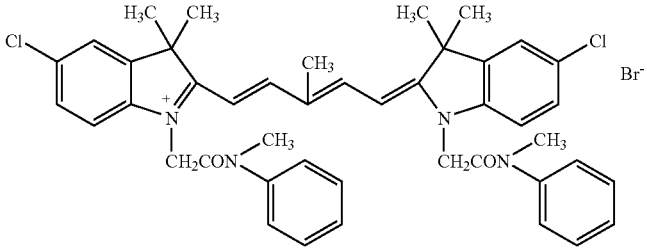
(19)
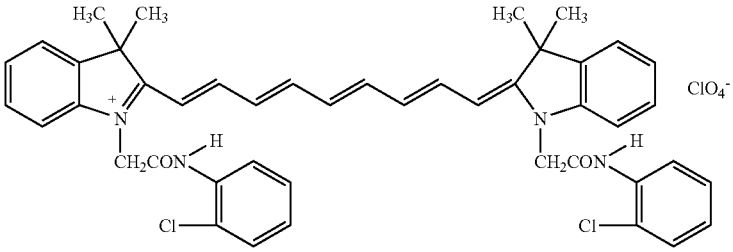

-continued
(20)
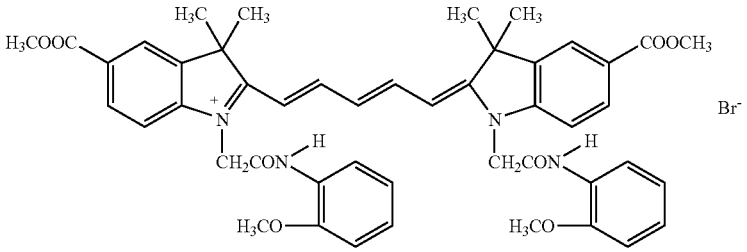
(21)
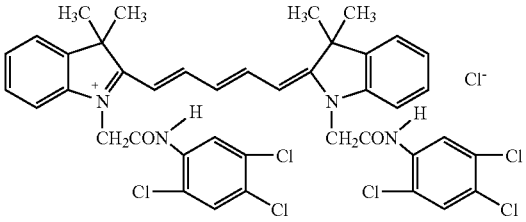
(22)
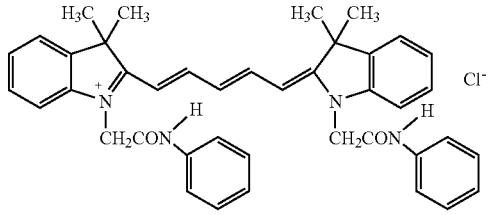
(23)
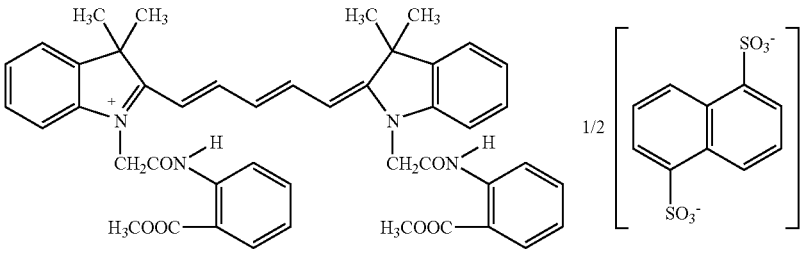
(24)
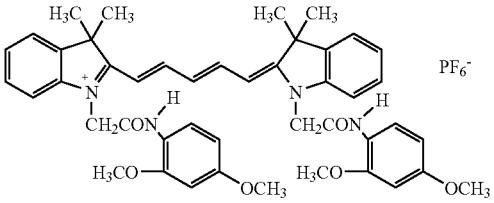
(25)
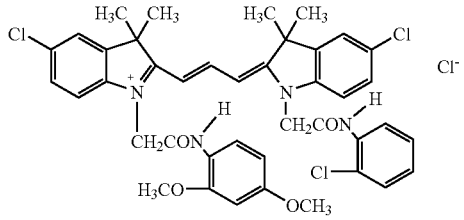
(26)
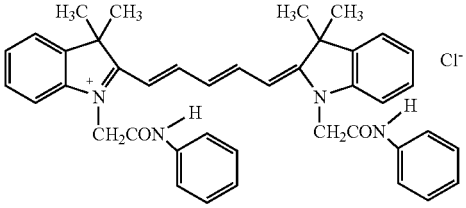
(27)
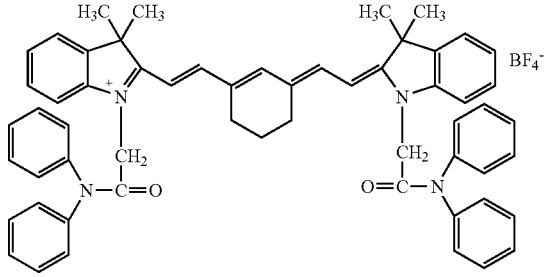

-continued
(28)
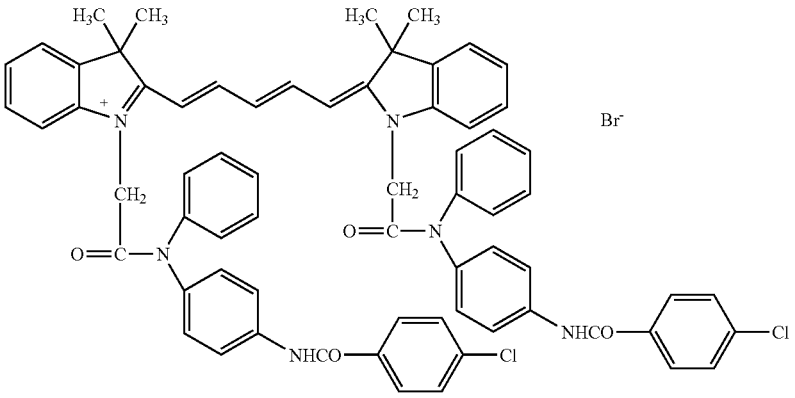
(29)
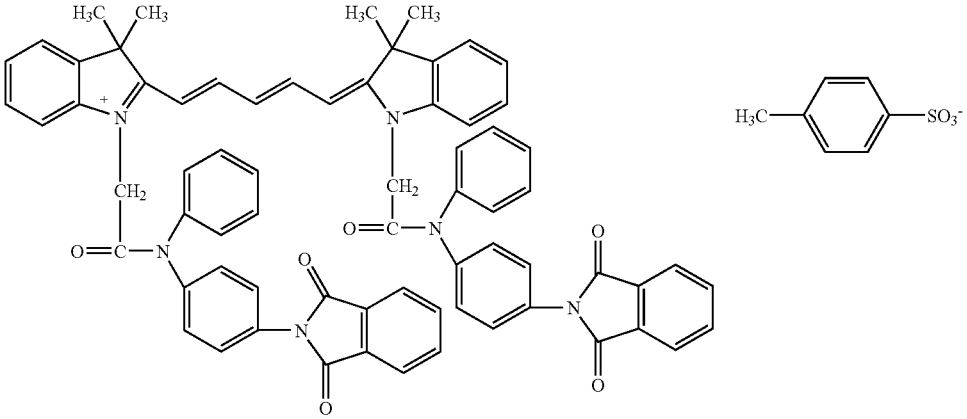
(30)
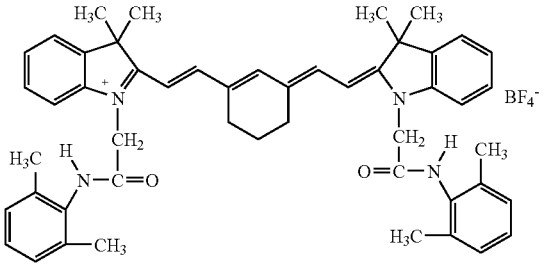
(31)
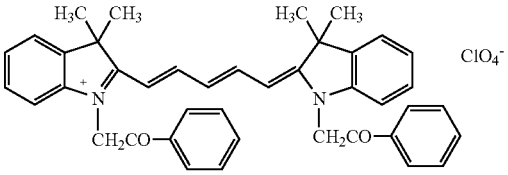
(32)
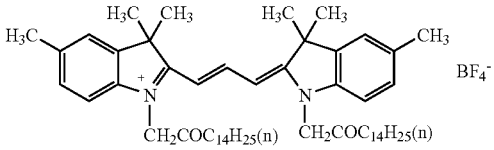
(33)
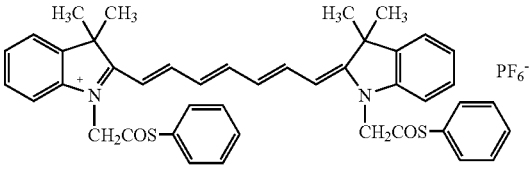
(34)
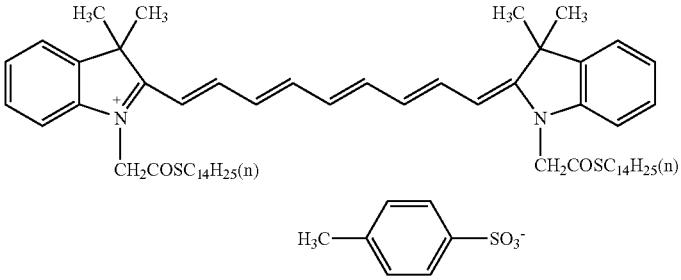

-continued
(35)
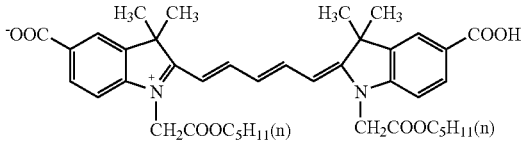
(36)
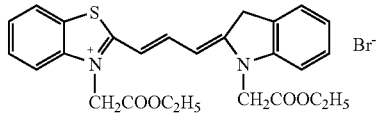
(37)
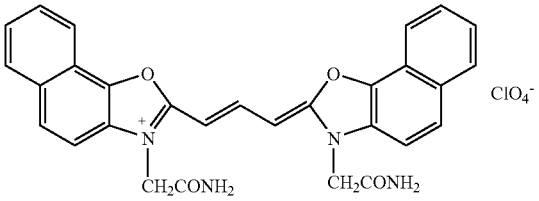
(38)
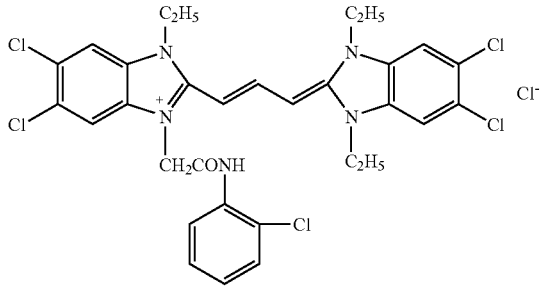
(39)
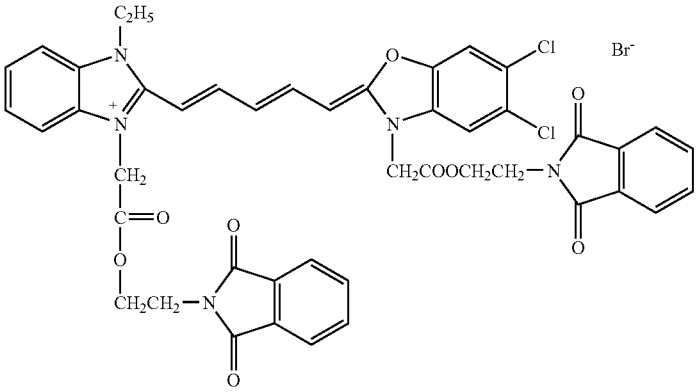
(40)
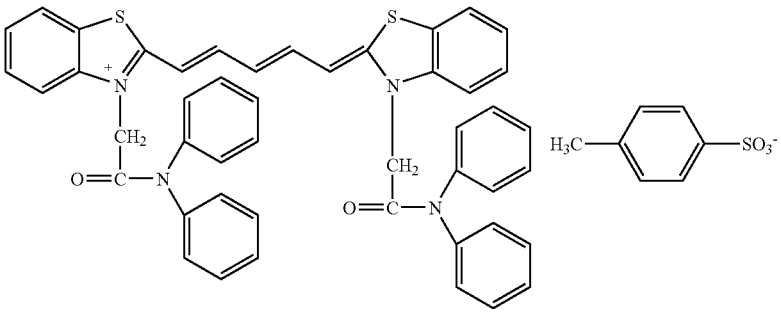
(41)
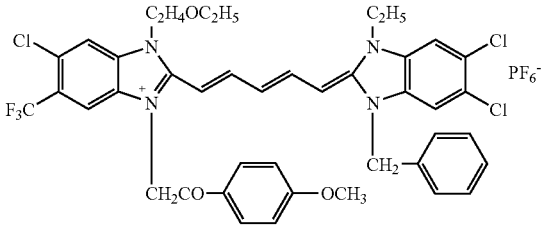
(42)
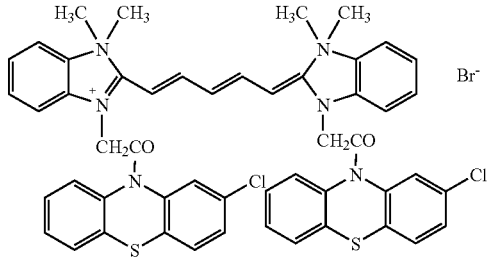

-continued (43)

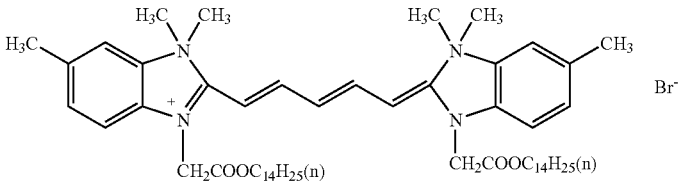

A coating quantity of the thermally discolorable dye is preferably 0.001 to 1.0 g/m$^2$ and more preferably 0.01 to 0.1 g/m$^2$.

1-1-6. Base Precursor

In the invention, when said thermally discolorable dye is added to the non-photosensitive back side layer, it is preferable that a base precursor is contained in the layer.

A variety of base precursors may be used in the invention. Since decolorization is carried out under heating conditions, it is preferable that a species of precursors that produce (or release) a base upon heating. A typical examples of base precursors that produce a base on heating is a thermolytic (decarboxylated) base precursor consisting of carbovylic acid and hydrochloric acid. When a decarboxylated base precursor is heated, a carboxy group of carboxylic acid undergoes decarboxylation to release organic salt. As carboxylic acid, a sulfonyl acetic acid or propiolic acid that undergoes decarboxylation easily is used. It is preferable that a sulfonyl acetic acid and propiolic acid have an aromatic group that accelerates decarboxylation (aryl group and unsaturated heterocyclic group) as a substituent. The base precursor of sulfonyl acetate is described in JP-A No. 59-168441, and the base precursor of propiolic phosphate is described in JP-A No. 59-180537.

A base part of a decarboxylated base precursor is preferably an organic base and more preferably amidine, guanidine or their derivatives. An organic base is preferably a diacid base, triacid base or tetracid base, more preferably a diacid base, and most preferably a diacid base of an amidine derivative or guanidine derivative.

Precursors of a diacid base, triacid base and tetracid base of amidine derivatives are described in JP-B No. 7-59545. Precursors of a diacid base, triacid base and tetracid base of guanidine derivatives are described in JP-B No. 8-10321.

A diacid base of an amidine derivative or guanidine derivative is composed of (A) two amidine parts or guanidine parts, (B) substituent of amidine part or guanidine part and (C) divalent group that connects two amidine parts or guanidine parts. Examples of (B) substituents include an alkyl group (including cycloalkyl group), alkenyl group, alkynyl group, aralkyl group and heterocycle residue. Two or more substituents may bind together to form a nitrogen-containing heterocycle. The linking group of (C) is preferably an alkylene group or phenylene group.

The following shows examples of diacid base precursors of an amidine derivative or guanidine derivative (BP-1 to BP-39).

(BP-1)

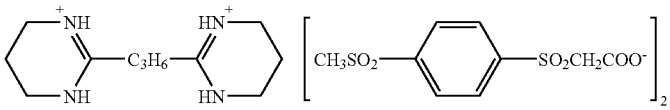

(BP-2)

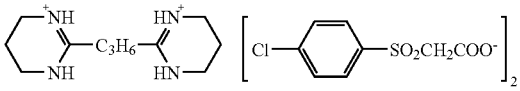

(BP-3)

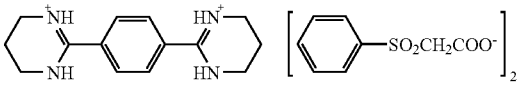

(BP-4)

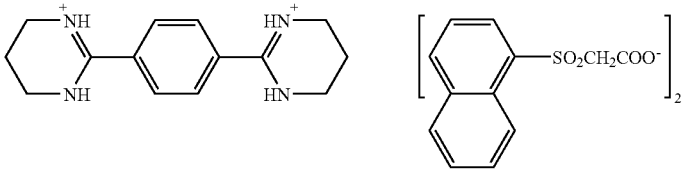

(BP-5)

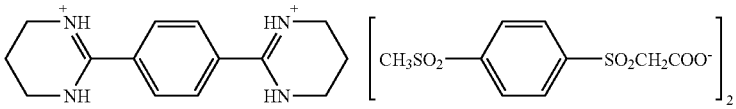

(BP-6)

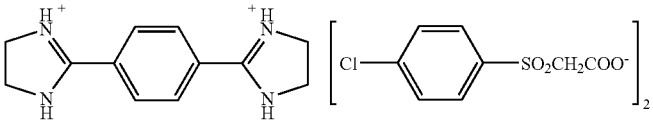

-continued
(BP-7)
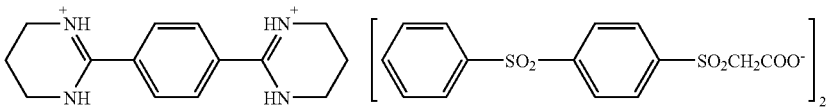
(BP-8)
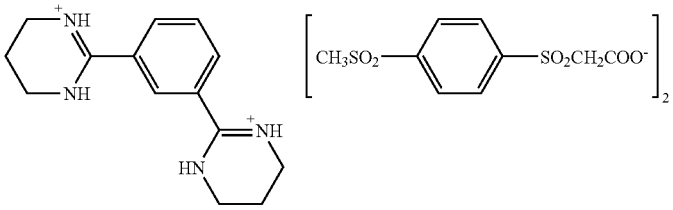
(BP-9)
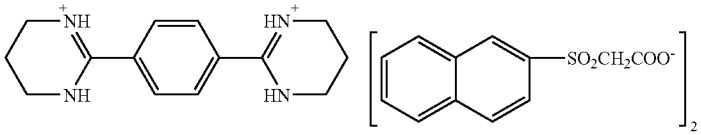
(BP-10)
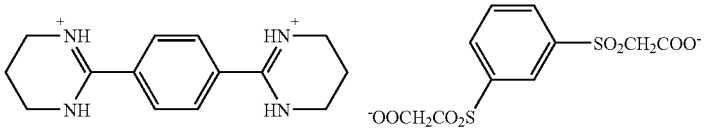
(BP-11)
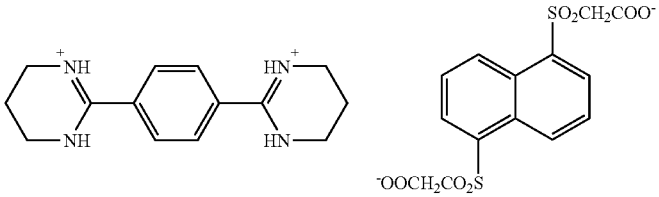
(BP-12)
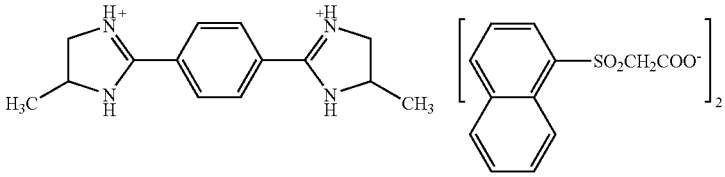
(BP-13)
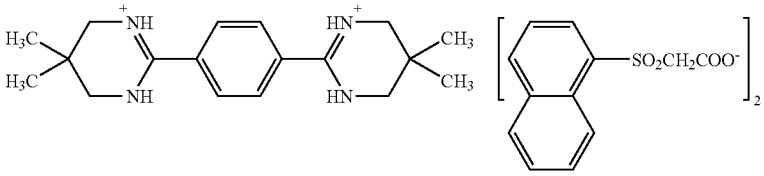
(BP-14)
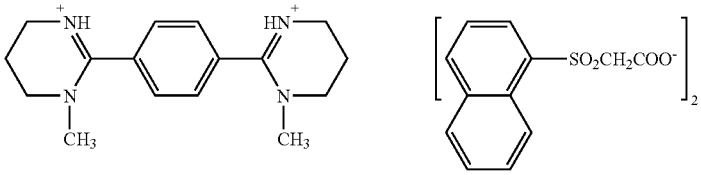
(BP-15)
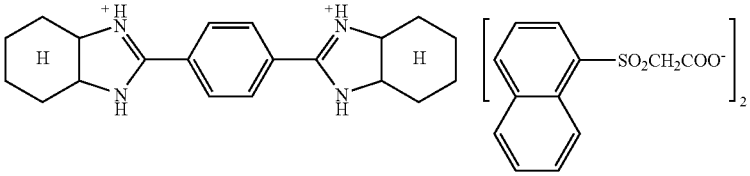

-continued
(BP-16)
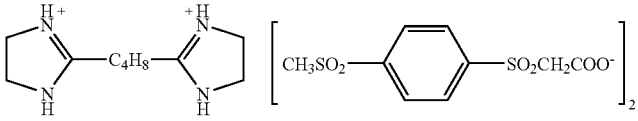
(BP-17)
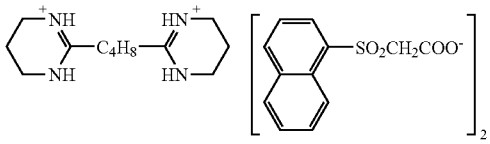
(BP-18)
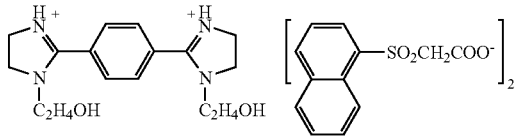
(BP-19)
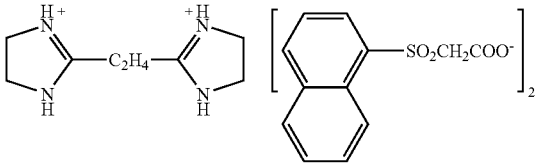
(BP-20)
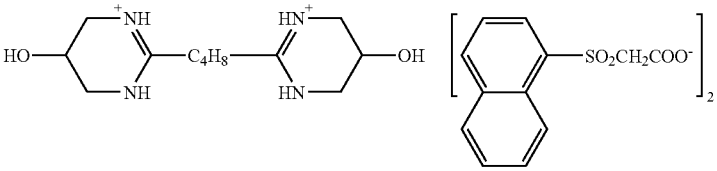
(BP-21)
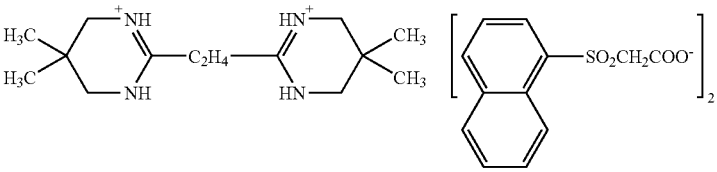
(BP-22)
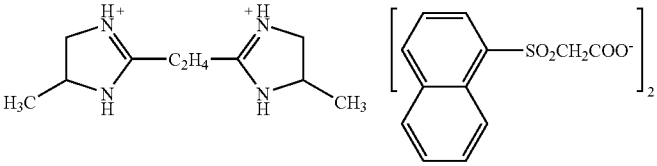
(BP-23)
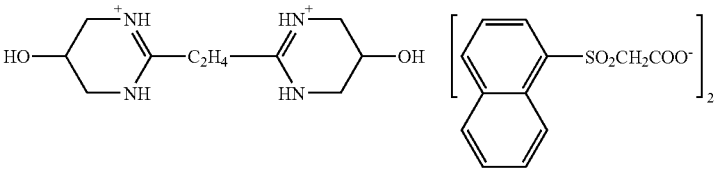
(BP-24)
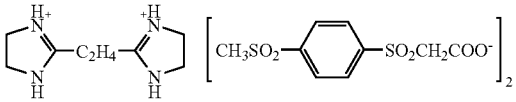
(BP-25)
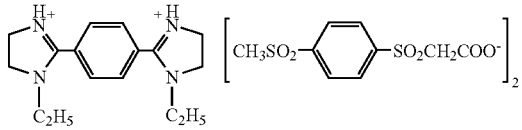
(BP-26)
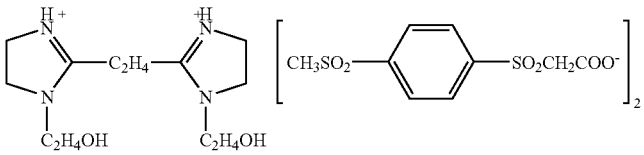

-continued
(BP-27)
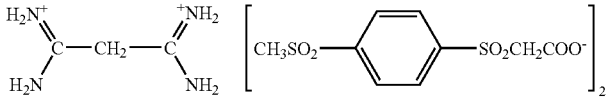
(BP-28)
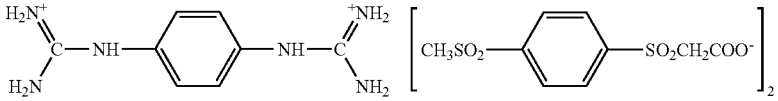
(BP-29)
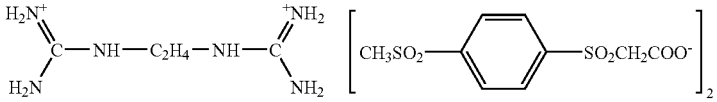
(BP-30)
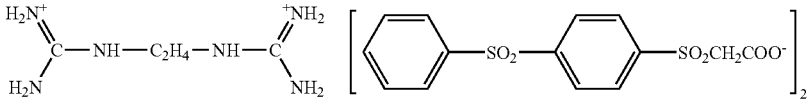
(BP-31)
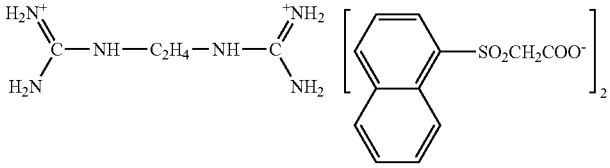
(BP-32)
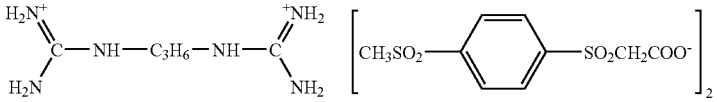
(BP-33)
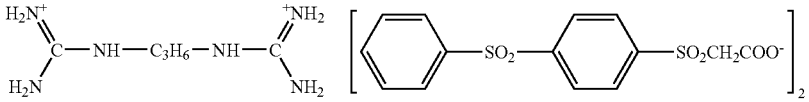
(BP-34)
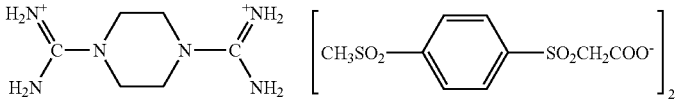
(BP-35)
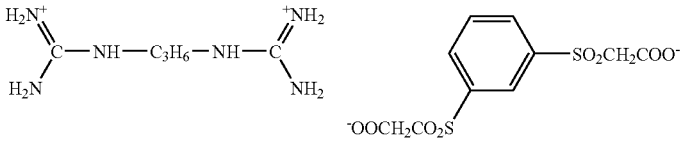
(BP-36)
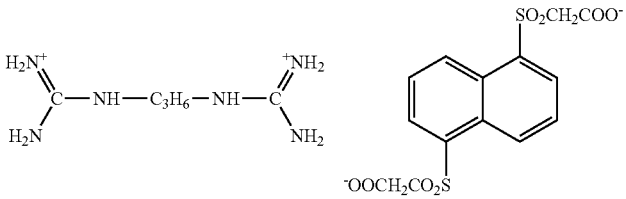
(BP-37)
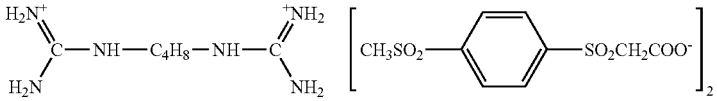
(BP-38)
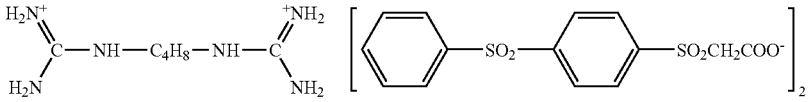

-continued (BP-39)

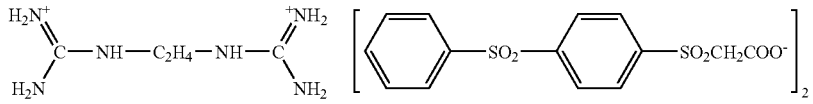

In the invention, a quantity of a base precursor (mol) is preferably 1 to 100 times and more preferably 3 to 30 times based on said thermally discolorable dye.

Said base precursor may be used solely or in combination of 2 or more species.

1-1-7. Melting Point Depressing Agent

In the invention, it is preferable to use a substance which depresses the melting point of a base precursor in a range of 3° C. to 30° C. when mixed with said base precursor (hereinafter referred to as melting point depressing agent.)

This agent depresses the melting point of the base precursor in a range from 3° C. to 30° C. when mixed with the base precursor than that of the base precursor only, preferably in a range of 3 to 20° C. and more preferably in a range of 5 to 15° C.

A change in the melting point can be observed by mixing a base precursor with a melting point depressing agent powder or preparing a dispersion, which is then mixed and dried at room temperature and subjecting Thus prepared sample to differential scanning calorimetry (DSC). Melting point depressing agents may be used in combination with 2 or more species.

A melting point depressing agent may be attained either by using one species of a compound that depresses the melting point in a range from 3° C. (deg) to 30° C. or by using 2 or more species of compounds that depress the melting point in a range from 3° C. to 30° C.

The agent is added preferably in a form of co-dispersion with mixture of a base precursor and particularly preferably in a form of a solid micro-particle dispersion. In this instance, the mean particle size of the micro-particle is preferably 0.03 to 0.3 μm.

In the invention, it is preferable to provide a non-photosensitive layer which contains a base-declarable dye or its salt and base precursor and allow a melting point depressing agent to be contained in the non-photosensitive layer that is adjacent to such layer, in view of a less residual color on photosensitive materials.

In the invention, it is also preferable to provide a non-photosensitive layer which contains a dye discolorable by a base, its salt, or base precursor and the first melting point depressing agent and allow the second melting point depressing agent to be contained in the non-photosensitive layer that is adjacent to such layer, in view of a less residual color on photosensitive materials.

The following is a detailed explanation regarding preferable melting point depressing agents of the invention.

Preferable melting point depressing agents include compounds expressed by the general formulae (M1) to (M3) below.

General formula (M1)

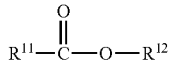

In the general formula (M1), $R^{11}$ and $R^{12}$ represent independently an aliphatic group, an aromatic group or a heterocyclic group. However, at least either $R^{11}$ or $R^{12}$ is an aromatic group or a heterocyclic group.

A detailed explanation is made regarding the compounds expressed by the general formula (M1).

In the general formula (M1), an aliphatic group means an alkyl group, a substituted alkenyl group, a substituted alkenyl group, an alkynyl group, a substituted alkynyl group, an aralkyl group and a substituted aralkyl group. In the invention, preferable are an alkyl group, a substituted alkyl group, an alkenyl group, a substituted alkenyl group, an aralkyl group and a substituted aralkyl group. More preferable are an alkyl group, a substituted alkyl group, an aralkyl group and a substituted aralkyl group. A chain aliphatic group may be provided with branches.

In the general formula (M1), an alkyl group has preferably 1 to 30 carbon atoms, more preferably 1 to 20 and still more preferably 1 to 15. The alkyl part of a substituted alkyl group is the same as an alkyl group.

In the general formula (M1), an alkenyl group and an alkynyl group have preferably 2 to 30 carbon atoms, more preferably 2 to 20, and still more preferably 2 to 15. The alkenyl part of a substituted alkenyl group and the alkynyl part of a substituted alkynyl group are the same as an alkenyl group and alkynyl group respectively.

In the general formula (M1), an aralkyl group has preferably 2 to 30 carbon atoms, more preferably 2 to 20, and still more preferably 2 to 15. The aralkyl part of a substituted aralkyl group is the same as an aralkyl group.

In the general formula (M1), an aromatic group may be substituted with a monocyclic or condensed-ring aryl group. An aryl group has preferably 6 to 30 carbon atoms, more preferably 6 to 20, and still more preferably 6 to 15. The aryl part of a substituted aryl group is the same as an aryl group. Examples thereof include a benzene ring and naphthalene ring.

In the general formula (M1), a heterocyclic group means a pentagonal or hexagonal heterocyclic group or a substituted heterocyclic group. A heterocycle part of a substituted heterocyclic group is the same as a heterocyclic group.

In the general formula (M1), the examples of heterocycle of a heterocyclic group include pyrrole, indole, furan, thiofen, imidazole, pyrazole, indridine, quinoline, carbazole, phenothiazine, indrine, thiazole, pyridine, pyridadien, pyridazine, thiadiazien, pyran, thiopyran, oxadiazole, benzoquinoline, thiadiazole, pyrrolothiazole, pyrrolopyridazine, tetrazole, oxazole, coumarin and chroman. They may be provided with each substituent.

There are no particular restrictions regarding substituents that the above groups may include, as long as they are other than a base of the carboxy group and salt of carboxy group. Examples of said substituents include a sulfone amide group with 1 to 20 carbon atoms (for example, methane sulfone amide, benzene sulfone amide, butane sulfone amide, n-octane sulfone amide), a sulfamoyl group with 0 to 20 carbon atoms (for example, unsubstituted sulfamoyl, methylsulfamoyl, phenyl sulfamoyl, butysulfamoyl), a sulfonylcarbamoyl group with 2 to 20 carbon atoms (for example, methane sulfonylcarbamoyl, propane sulfonylcarbamoyl, benzene sulfonylcarbamoyl, an acylsulfamoyl group with 1 to 20 carbon atoms (for example, acetylsulfamoyl, propionylsulfamoyl, benzoylsulfamoyl), a chain or circular alkyl group with 1 to 20 carbon atoms (for example, methyl, ethyl, cyclohexyl, 2-hydroxyethyl, 4-carboxybutyl, 2-methoxyethyl, benzyl, 4-carboxybenzyl,2-diethyl aminoethyl), an alkenyl group with 2 to 20 carbon atoms (for example, vinyl and aryl), an alkoxy group with 1 to 20 carbon atoms (for example, methoxy, ethoxy, and butoxy), halogen atom (for example, F,Cl, Br), an amino group with 0 to 20 carbon atoms (for example, an unsubstituted amino group, dimethylamino, diethylamino, carboxyethylamino), an alkoxy carbonyl group with 2 to 20 carbon atoms (for example, methoxycarbonyl), an amide group with 1 to 20 carbon atoms (for example, acetoamide, benzamide), a carbamoyl group with 1 to 20 carbon atoms (for example, an unsubstituted carbamoyl, methylcarbamoyl, phenylcarbamoyl), an aryl goup with 6 to 20 carbon atoms (for example, phenyl, naphtyl, 4-carboxyphenyl,4-methane sulfone amide phenyl, 3-benzoylamino phenyl), an aryloxy group with 6 to 20 carbon atoms (for example, phenoxy,3-methylphenoxy, naphtoxy), an alkylthio group with 1 to 20 carbon atoms (for example, methylthio, octylthio), an arylthio group with 6 to 20 carbon atoms (for example, phenylthio, naphtylthio), an acyl group with 1 to 20 carbon atoms (for example, acetyl, benzoyl, 4-chlorobenzoyl), a sulfonyl group with 1 to 20 carbon atoms (for example, methane sulfonyl, and benzene sulfonyl), an ureido group with 1 to 20 carbon atoms (for example, methyl ureido and phenyl ureido), an alkoxy carbonylamino group with 2 to 20 carbon atoms (for example, methoxycarbonylamino, hexyoxycarbonylamino), cyano group,hydroxyl group, nitro group, a heterocyclic group (examples of heterocycles include 5-ethoxycarbonyl benzoxazole ring, pyridine ring, sulfolane ring, furan ring, pyrrole ring, pyrrolidine ring, morphorine ring, piperazine ring, and pyrimidine ring).

In the general formula (M1), $R^{11}$ is preferably an aromatic group. More preferable example of a substituents of a substituted aryl group include a substituted or unsubstituted alkyl group, substituted or unsubstituted aryl group, substituted or unsubstituted aralkyl group, acyl group, sulfonyl group, alkoxycarbonyl group, alkoxy group, substituted or unsubstituted carbamoyl group and halogen atom. More preferable examples include a substituted or unsubstituted alkyl group, a substituted or unsubstituted aryl group, sulfonyl group, alkoxy group and halogen atom. The most preferable examples include a substituted or unsubstituted alkyl group, sulfonyl group and halogen atom.

In the general formula (M1), $R^{12}$ is preferably an aromatic group or heterocyclic group. Where $R^{12}$ is an aromatic group, preferable examples of substituents of a substituted aryl group include a substituted or unsubstituted alkyl group, substituted or unsubstituted aryl group, a substituted or unsubstituted aralkyl group, acyl group, a sulfonyl group, an alkoxycarbonyl group, an alkoxy group, a substituted or an unsubstituted carbamoyl group and halogen atom. More favorable examples include a substituted or unsubstituted alkyl group, substituted or unsubstituted aryl group, sulfonyl group, alkoxy group, and halogen atom, and the most preferable examples include a substituted or unsubstituted alkyl group, sulfonyl group and halogen atom. Where $R^{11}$ or $R^{12}$ is an aliphatic group, aralkyl group is preferable.

The following shows examples of compounds (M1-1 to M1-17) expressed by the general formula (M1), which are not construed to limit the scope of the invention.

M1-1

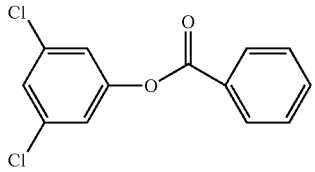

M1-2

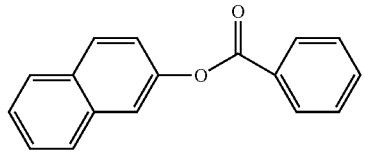

M1-3

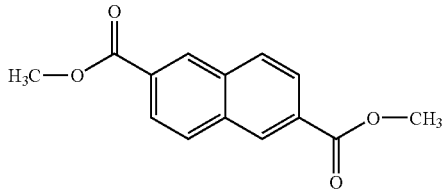

M1-4

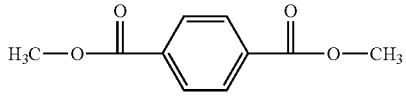

M1-5

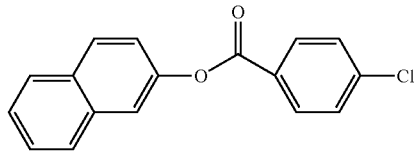

M1-6

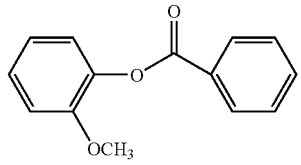

M1-7

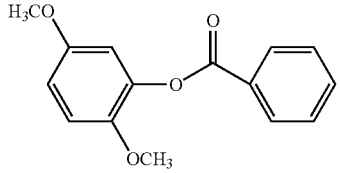

M1-8

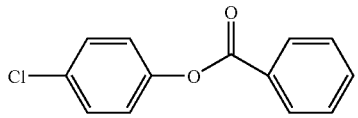

M1-9

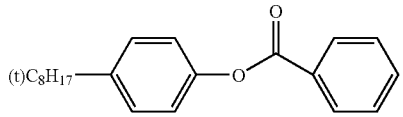

M1-10

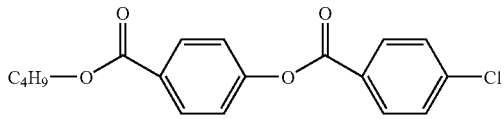

-continued

M1-11

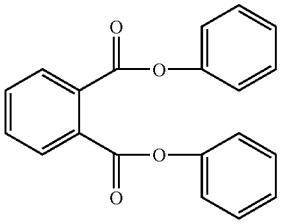

M1-12

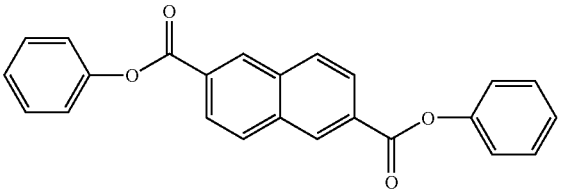

M1-13

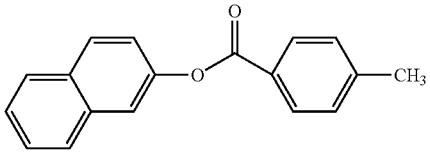

M1-14

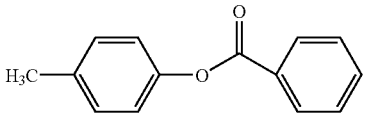

M1-15

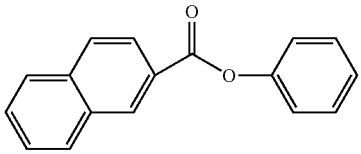

M1-16

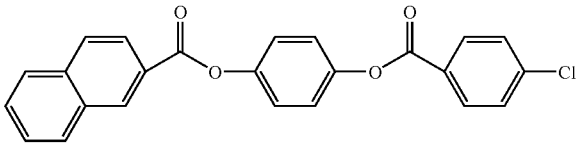

M1-17

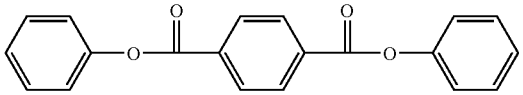

The following is an explanation regarding the compound expressed by general formula (M2) that can be used in the invention as a preferable melting point depressing agent.

General formula (M2)

$$R^{21}—X—R^{22}$$

In the general formula (M2), $R^{21}$ and $R^{22}$ represent independently an aromatic group or a heterocyclic group, and X represents a linking group other than a sulfonyl group and carboxy group.

In the general formula (M2), an aromatic group is the same in meaning as an aromatic group expressed by said general formula (M1). Further, a heterocyclic group is the same in meaning as the heterocyclic group expressed by said general formula (M1).

The substituents that may be contained by said groups are the same in meaning as the substituents that may be contained by the groups expressed by said general formula (M1).

The general formula (M2) does not cover the general formula (M1). A linking group expressed by X is preferably a divalent linking group. In the case of a tri-valent or higher linking group, $R^{21}$ and $R^{22}$ may be independently provided with a substituent selected from a hydrogen atom, aliphatic group, aromatic group or heterocyclic group. Examples of the linking groups include —C(═O)—, —OC(═O)O—, —SO—, substituted or unsubstituted methilene chain with 1 to 3 carbon atoms, —C(═O)—C(═O)—, —C(OH)—C(═O)—, —S—, —O—, and the following.

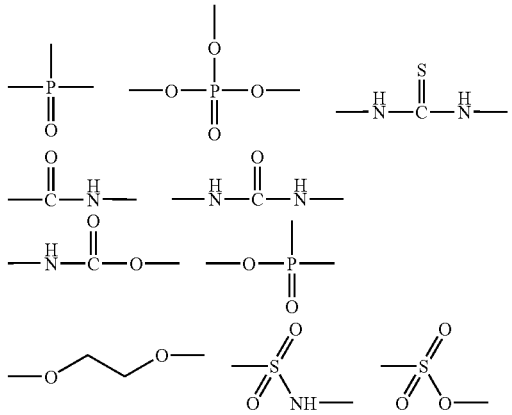

In the general formula (M2), $R^{21}$ is preferably an aromatic group. More preferable examples of a substituents of substituted aryl group include a substituted or unsubstituted alkyl group, substituted or unsubstituted aryl group, substituted or unsubstituted aralkyl group, acyl group, sulfonyl group, alkoxycarbonyl group, alkoxy group, a substituted or unsubstituted carbamoyl group and halogen atom. Still more preferable examples include a substituted or unsubstituted alkyl group, a substituted or unsubstituted aryl group, sulfonyl group, alkoxy group and halogen atom, and the most preferable examples include a substituted or unsubstituted alkyl group, sulfonyl group and halogen atom.

In the general formula (M2), $R^{22}$ is preferably an aromatic group. When $R^{22}$ is an aromatic group, more preferable examples of substituents of a substituted aryl group include a substituted or unsubstituted alkyl group, a substituted or unsubstituted aryl group, a substituted or unsubstituted aralkyl group, acyl group, sulfonyl group, alkoxycarbonyl group, alkoxy group, substituted or unsubstituted carbamoyl group and halogen atom.

Still more preferable examples include a substituted or unsubstituted alkyl group, a substituted or unsubstituted aryl group, a sulfonyl group, an alkoxy group and a halogen atom, and the most preferable examples include a substituted or unsubstitued alkyl group, a sulfonyl group and a halogen atom.

When $R^{21}$ and $R^{22}$ are an aliphatic group, preferable is an aralkyl group. A substituent of $R^{21}$ and $R^{22}$ may bind each other to form a ring together with X.

The following shows examples of compounds (M2-1 to M2-16) expressed by the general formula (M2), which are not construed to limit the scope of the invention.

M2-1
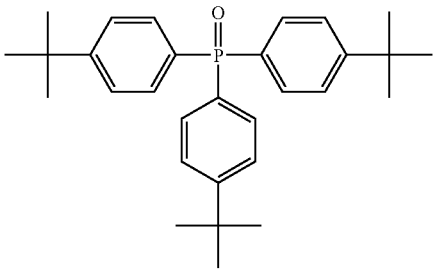
M2-2
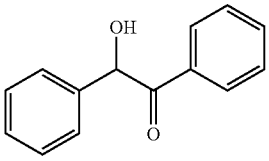
M2-3
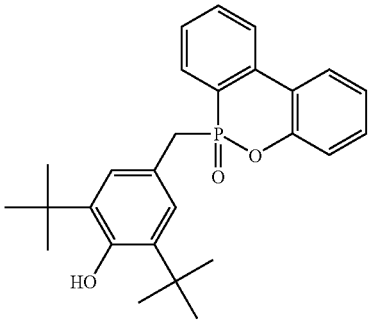
M2-4
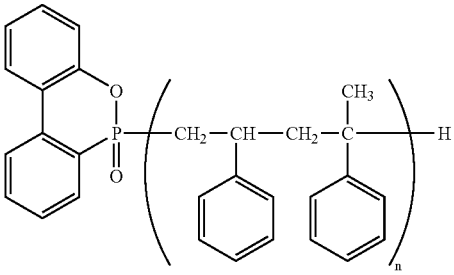
n = 6 or 7
M2-5
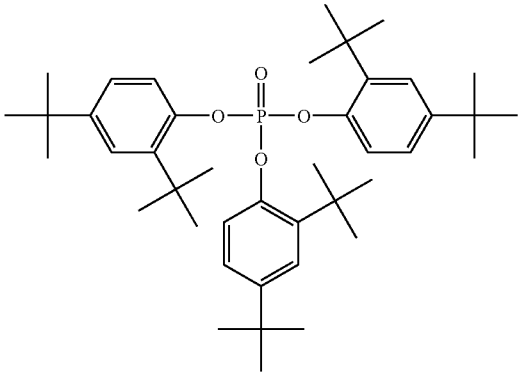
M2-6
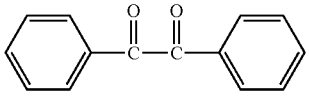
-continued
M2-7
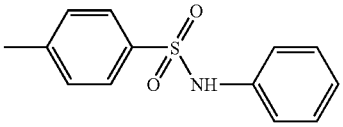
M2-8
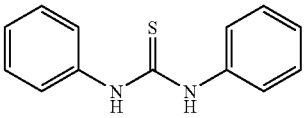
M2-9
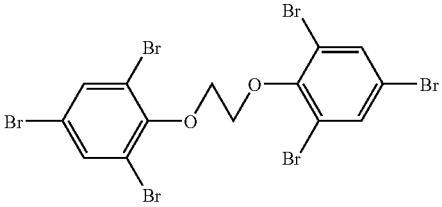
M2-10
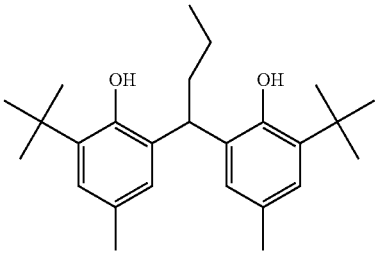
M2-11
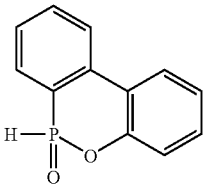
M2-12
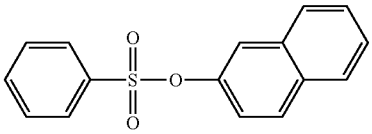
M2-13
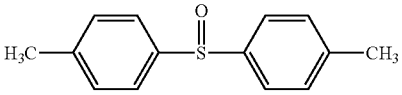
M2-14
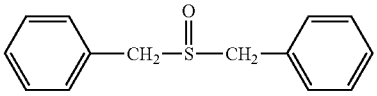
M2-15
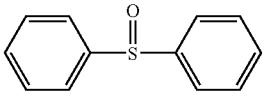
M2-16
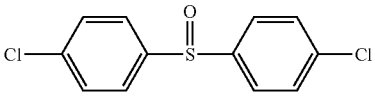
The following is an explanation regarding the compound expressed by general formula (M3) that can be used in the invention as a preferable melting point depressing agent.

General formula (M3)

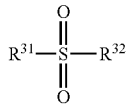

In the general formula (M3), $R^{31}$ and $R^{32}$ independently represent an aromatic group or a heterocyclic group, however, the compounds expressed by the general formula (M3) do not have a carboxyl group or salt of a carboxyl group as a substituent.

In the general formula (M3), an aromatic group is the same in meaning as the aromatic group expressed by said general formula (M1). A heterocyclic group is also the same in meaning as the heterocyclic group expressed by the general formula (M1).

The substituents that may be contained by said groups are the same in meaning as the substituents that may be contained by the groups expressed by said general formula (M1).

In the general formula (M3), $R^{31}$ is preferably an aromatic group. More preferable examples of substituents of a substituted aryl group include a substituted or unsubstituted alkyl group, substituted or unsubstituted aryl group, substituted or unsubstituted aralkyl group, acyl group, sulfonyl group, alkoxycarbonyl group, alkoxy group, substituted or unsubstituted carbamoyl group and halogen atom. Still more preferable examples include a substituted or unsubstituted alkyl group, a substituted or unsubstituted aryl group, sulfonyl group, alkoxy group and halogen atom, and the most preferable examples include a substituted or unsubstitued alkyl group, sulfonyl group and halogen atom.

In the general formula (M3), $R^{32}$ is preferably an aromatic group. When —$R^{32}$ is an aromatic group, more preferable examples of substituents of substituted aryl group include a substituted or unsubstituted alkyl group, substituted or unsubstituted aryl group, substituted or unsubstituted aralkyl group, acyl group, sulfonyl group, alkoxycarbonyl group, alkoxy group, substituted or unsubstituted carbamoyl group and halogen atom. Still more preferable examples include a substituted or unsubstituted alkyl group, substituted or unsubstituted aryl group, sulfonyl group, alkoxy group and halogen atom, and the most preferable examples include a substituted or unsubstitued alkyl group, sulfonyl group and halogen atom.

The following shows examples of the compounds (M3-1 to M3-14) expressed by the general formula (M3), which are not construed to limit the scope of the invention.

M3-1

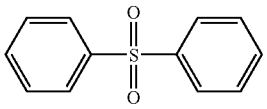

M3-2

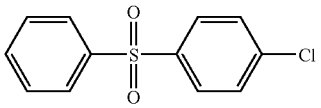

M3-3

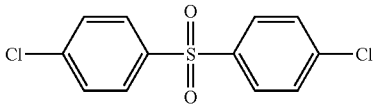

-continued

M3-4

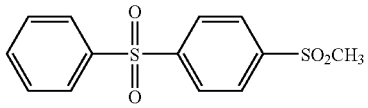

M3-5

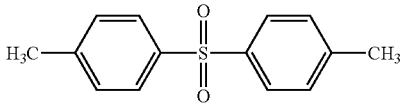

M3-6

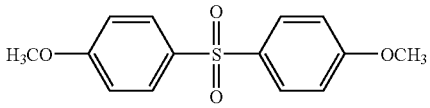

M3-7

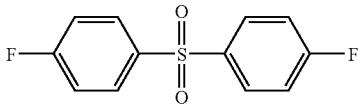

M3-8

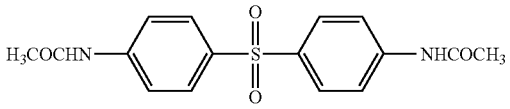

M3-9

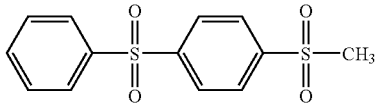

M3-10

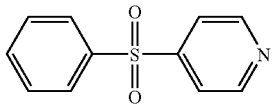

M3-11

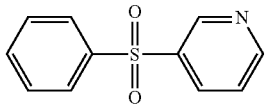

M3-12

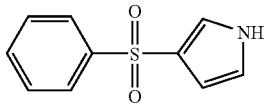

M3-13

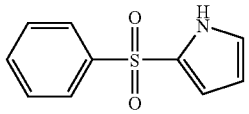

M3-14

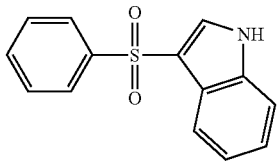

The compounds expressed by the general formula (M1) to (M3) have a melting point preferably equal to or higher than that of the base precursor, more preferably at 70° C. to 400° C. and still more preferably at 100° C. to 300° C.

In the invention, a total addition of the compound expressed by the general formula (M1) to (M3) is preferably 20 to 200 mass part based on 100 mass part of the base precursor.

The compounds expressed by the general formula (M1) to (M3) tend to remain at the background of the image after dye decolorization, and preferably those that do not have an absorption maximum at a wavelength of 400 nm to 700 nm or do not exhibit any practically problematic absorption in a photothermographic material. Also preferable compounds are those that do not exhibit any problematic absorption at a wavelength of 400 nm or less in a photothermographic material.

1-1-8. Surfactant

JP-A No. 11-65021 discloses the surfactants applicable in the invention in paragraph 0132, the solvents in paragraph 0133, the support in paragraph 0134, antistatic agents and conductive layer in paragraph 0135, and methods for obtaining in color image in paragraph 0136. Smoothing agents are described in paragraphs 0061 to 0064 of JP-A No. 11-84573 or in paragraphs 0049 to 0062 of Japanese Patent Application No. 11-106881.

In the invention, surfactants may be provided with any anionic, a nonionic or cationic hydrophilic groups, more preferably with nonionic dydrophilic group and most preferably with an anonic hydrophilic group.

Further, in the invention, it is preferable to use a fluorosurfactant. Examples of the fluorosurfactant are compounds described in JP-A Nos. 10-197985, 2000-19680 and 2000-214554. Highly polymerized fluorosurfactants described in JP-A No. 9-281636 are also preferably used in the invention. The fluorosurfactants preferably usable in the photothermographic material of the invention are described in JP-A No. 2002-82411, Japanese Patent Application Nos. 2001-242357 and 2001-264110. The fluorosurfactants described in Japanese Patent Application Nos. 2001-242357 and 2001-264110 are preferable in the ability to modulate electrostatic charge, stability of coated surface and smoothness particularly when coating is made with an aqueous coating liquid. The fluorosurfactant described in Japanese Patent Application No. 2001-264110 is most preferable in that it is high in the ability to modulate electrostatic charge and used in a smaller quantity for obtaining the same result. The fluorosurfactant may be used solely or used in combination with 2 or more species. The fluorosurfactant may be used together with a non-fluorine surfactant In the invention, the surfactant may be used in an image forming layer, non-photosensitive back side layer, other intermediate layers or surface protective layer. It is particularly preferable that the surfactant may be used in combination with the conductive layer that contains said metal oxides. In this instance, a sufficient effect can be obtained even when the surfactant is used in a small quantity or no surfactant is used in the layer having the conductive layer.

It is preferable that the surfactant is used in an outermost layer of the image forming side or back side. It is also effective to use the surfactant in the prime coat layer for the support.

In the invention, there are no particular restrictions regarding a quantity of surfactant, and the quantity can be determined arbitrarily depending on an area where the surfactant is used or the species or quantity of other materials contained in the composition.

For example, when the surfactant is used in a coating liquid for an outermost layer of the photothermographic material, it is preferably added in a quantity of 0.1 to 100 mg/m$^2$ as a coating quantity of the surfactant in the composition and more preferably in a quantity of 0.5 to 20 mg/m$^2$.

There are no particular restrictions regarding the structure of fluorosurfactants. They are preferably a fluorine compound containing a fluoroalkyl group having 2 or more carbon atoms and 12 or less fluorine atoms, more preferably having 12 or less fluorine atoms, still more preferably having fluorine atoms in a range of 3 to 11, and particularly preferably having fluorine atoms in a range of 5 to 9. In addition, a fluoroalkyl group preferably has 2 or more carbon atoms, more preferably carbon atoms in a range of 4 to 16, and still more preferably in a range of 5 to 12.

There are no particular restrictions regarding a fluoroalkyl group of said fluorine compound. Preferable is the group expressed by the general formula (A) below.

—R c-R f-W General formula (A)

In the general formula (A), Rc represents an alkylene group having 1 to 4 carbon atoms, preferably 1 to 3, and still more preferably 1 to 2.

An akylene group expressed by Rc may be either straight-chain or branched-chain.

Rf represents a perfluoroalkylene group with 2 to 6 carbon atoms and more preferably with 2 to 4 carbon atoms. In this instance, a perfluoroalkylene group is an alkylene group wherein all hydrogen atoms of an alkylene group are substituted with fluorine atom. Said perfluoroalkylene group may be straight-chained or branched. It may also be provided with a cyclic structure.

W represents a hydrogen atom, a fluorine atom or an alkyl group and more preferably a hydrogen atom or a fluorine atom. Particularly preferable is a fluorine atom.

Fluorosurfactants may be provided with any anionic, nonionic or cationic hydrophilic groups, more preferably with an anionic hydrophilic group and most preferably with an nonionic hydrophilic group.

(1) Fluorine Compound Having an Anionic Hydrophilic Group

Anionic hydrophilic group is an acidic group and the alkaline metal salt or ammonium salt whose pKa is 7 or less. The examples include a sulfo group, carboxy group, phosphonate group, carbamoylsulfamoyl group, sulfamoyl sulfamoyl group, acylsulfamoyl group and their salts. Preferable examples include a sulfo group, carboxy group, phosphonate group and its salt, more preferable examples include sulfo group and its salt. Cations that form salts are lithium, natrium, kalium, cesium, ammonium, tetramethyl ammonium, tetrabutyl ammonium and methyl pyridinium, and preferable cations are lithium, natrium, kalium and ammonium.

A more preferable fluorine compound is expressed by the general formula (2) below.

General formula (2)

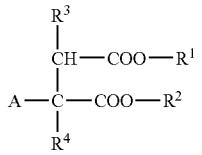

In the formula, $R^1$ and $R^2$ independently represent an alkyl group, and at least either one of them represents a fluoroalkyl group with 2 or more carbon atoms and 12 or less fluorine atoms. When $R^1$ and $R^2$ represent an alkyl group other than fluoroalkyl group, preferable is an alkyl group with 2 to 18 carbon atoms, and more preferably with 4 to 12 carbon atoms. $R^3$ and $R^4$ independently represent a hydrogen atom or a substituted or unsubstituted alkyl group.

Examples of a fluoroalkyl group expressed by $R^1$ and $R^2$ include said groups, and the preferable structure is also the same as that expressed by said general formula (A). The preferable structure is also the same as that of said fluoroalkyl group. Alkyl groups expressed by $R^1$ and $R^2$ are preferably said fluoroalkyl group.

Substituted or unsubstituted alkyl groups expressed by $R^3$ or $R^4$ may be straight-chain or branched-chain. They may also be provided with a circular structure. Any substituents may be employed as said substitutents, and preferable examples include an alkenyl group, aryl group, alkoxy group, halogen atom (preferably Cl), carboxylic acid ester group, carbonamide group, carbamoyl group, oxycarbonyl group and phosphoric ester group.

A represents $—L_b—SO_3M$ and M represents a cation. In this instance, preferable examples of a cation expressed by M include a alkaline metal ions (a lithium ion, sodium ion, potassium ion, etc.), alkalinene earth metal ions (barium ion, calcium ion, etc.), and ammonium ion. Of these examples, more preferable examples include lithium ion, sodium ion, potassium ion or ammonium ion, still more preferable examples include a lithium ion, sodium ion or potassium ion. They can be appropriately selected depending on total carbon atoms in the compound expressed by the general formula (2) and branched extent of the substituent and alkyl group. In a compound wherein the total carbon atoms of $R^1$, $R^2$, $R^3$ and $R^4$ is 16 or greater and M is a lithium ion, improvement is obtained in solubility (especially in water), antistatic ability and uniform coating.

$L_b$ represents a single-bonded, substituted or unsubstituted alkylene group. Preferable substituents are those represented by $R_3$. When $L_b$ is an alkylene group, the preferable number of carbon atoms therein is 2 or less. $L_b$ is preferably single-bonded or a $—CH_2$ group, and most preferably a $—CH_2$ group.

It is preferable that the above general formula (2) is combined with the preferable aspects described above.

Examples of fluorine compounds used in the invention are shown below, which are not construed to limit the scope of the invention.

Regarding the structures of the compounds shown below, an alkyl group and perfluoroalkyl group indicate a straight-chain structure compound, unless otherwise specified.

(F-1)

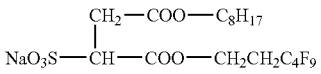

(F-2)

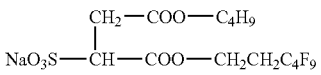

(F-3)

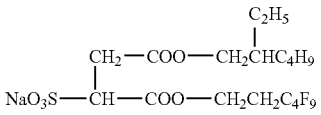

(F-4)

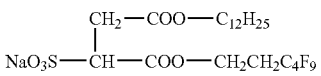

(F-5)

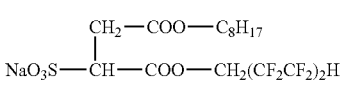

-continued (F-6)

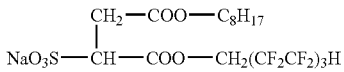

(F-7)

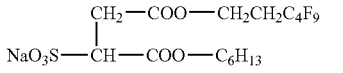

(F-8)

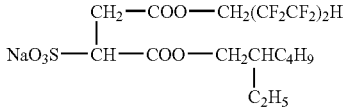

(F-9)

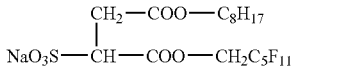

(F-10)

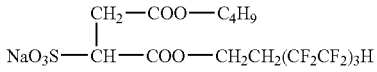

(F-11)

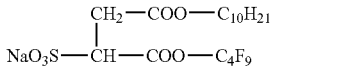

(F-12)

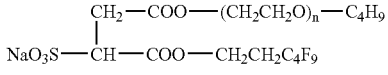

n = 5~15

(F-13)

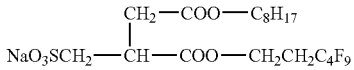

(F-14)

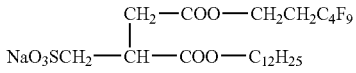

(F-15)

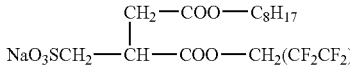

(F-16)

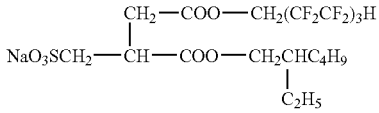

(F-17)

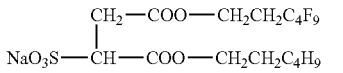

(F-18)

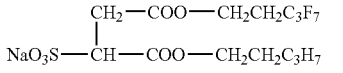

(F-19)

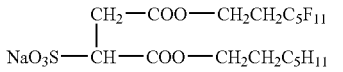

(F-20)

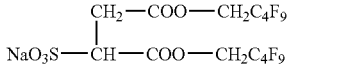

(F-21)

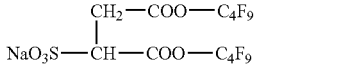

(F-22)

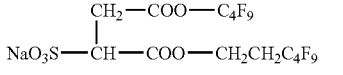

(F-23)

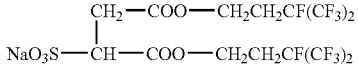

-continued (F-24)

$NaO_3S-CH(CH_2-COO-CH_2CH_2C_2F_5)-COO-CH_2CH_2C_4F_9$ (F-25)

$NaO_3S-CH(CH_2-COO-CH_2(CF_2CF_2)_2H)-COO-CH_2(CF_2CF_2)_2H$ (F-26)

$NaO_3S-CH(CH_2-COO-CH_2(CF_2CF_2)_3H)-COO-CH_2(CF_2CF_2)_3H$ (F-27)

$NaO_3S-CH(CH_2-COO-CH_2CF_2CF_2H)-COO-CH_2(CF_2CF_2)_3H$ (F-28)

$NaO_3S-CH(CH_2-COO-(CH_2CH_2O)nC_4F_9)-COO-(CH_2CH_2O)nC_4F_9$ n = 5~15

(F-29)

$NaO_3SCH_2-CH(CH_2-COO-CH_2CH_2C_4F_9)-COO-CH_2CH_2C_4F_9$ (F-30)

$NaO_3SCH_2-CH(CH_2-COO-CH_2CH_2C_3F_7)-COO-CH_2CH_2C_3F_7$ (F-31)

$NaO_3SCH_2-CH(CH_2-COO-CH_2CH_2C_5F_{11})-COO-CH_2CH_2C_5F_{11}$ (F-32)

$NaO_3SCH_2-CH(CH_2-COO-CH_2CH_2C_6F_{12}H)-COO-CH_2CH_2C_6F_{12}H$ (F-33)

$NaO_3SCH_2-CH(CH_2-COO-CH_2(CF_2CF_2)_2H)-COO-CH_2(CF_2CF_2)_2H$ (F-34)

$NaO_3SCH_2-CH(CH_2-COO-CH_2(CF_2CF_2)_3H)-COO-CH_2(CF_2CF_2)_3H$ (F-35)

$NaO_3SCH_2-CH(CH_2-COO-CH_2CF_2CF_2H)-COO-CH_2(CF_2CF_2)_3H$ (F-36)

$NaO_3SCH_2-CH(CH_2-COO-CH_2CH_2CF_2(CF_3)_2)-COO-CH_2CH_2CF(CF_3)_2$ (F-37)

$NaO_3SCH_2-CH(CH_2-COO-CH_2CH(C_2F_5)_2)-COO-CH_2CH(C_2F_5)_2$ (F-38)

$NaO_3S-CH(CH_2(CH_3)-COO-CH_2CH_2C_4F_9)-COO-CH_2CH_2C_4F_9$ (F-39)

$NaO_3S-CH(CH-COO-CH_2CH_2C_4F_9)-CH-COO-CH_2CH_2C_4F_9)-COO-CH_2CH_2C_4F_9$ (F-40)

$NaO_3S-CH(CH-COO-CH_2(CF_2C_2F)_2H)-CH-COO-CH_2(CF_2CF_2)_2H)-COO-CH_2(CF_2CF_2)_2H$

-continued (F-41)

$NaO_3SCH_2CH_2-CH(CH_2-COO-CH_2CH_2C_4F_9)-COO-CH_2CH_2C_4F_9$ (F-42)

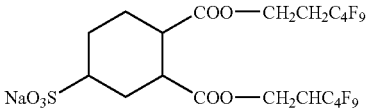

(F-43)

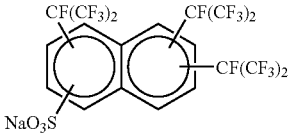

(F-44)

$NaO_3SCH_2-CH(CH_2-COO-C_8H_17)-P(=O)(O-CH_2CH_2C_4F_9)-O-CH_2CH_2C_4F_9$ (F-45)

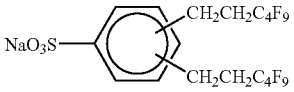

(F-46)

$NaO_3SCH_2-C(CH_2-COO-CH_2(CF_2CF_2)_2H)(CH_2-COO-CH_2(CF_2CF_2)_2H)-COO-CH_2(CF_2CF_2)_2H$ (F-47)

$KO_3S-CH(CH_2-COO-C_8H_17)-COO-CH_2CH_2C_4F_9$ (F-48)

$LiO_3S-CH(CH_2-COO-C_8H_17)-COO-CH_2(CF_2CF_2)_3H$ (F-49)

$LiO_3S-CH(CH_2-COO-C_8H_17)-COO-CH_2CH_2C_4F_9$ (F-50)

$LiO_3S-CH(CH_2-COO-CH_2CH_2C_4F_9)-COO-CH_2CH_2C_4F_9$ (F-51)

$KO_3S-CH(CH_2-COO-CH_2CH_2C_4F_9)-COO-CH_2CH_2C_4F_9$ (F-52)

$LiO_3S-CH(CH_2-COO-CH_2(CF_2CF_2)_3H)-COO-CH_2(CF_2CF_2)_3H$ (F-53)

$LiO_3SCH_2-CH(CH_2-COO-CH_2CH_2C_4F_9)-COO-CH_2CH_2C_4F_9$ (F-54)

$KO_3SCH_2-CH(CH_2-COO-CH_2(CF_2CF_2)_2H)-COO-CH_2(CF_2CF_2)_2H$ (F-55)

$KO_3SCH_2-CH(CH_2-COO-CH_2CH_2C_4F_9)-COO-CH_2CH_2C_4F_9$ (F-56)

$LiO_3SCH_2-CH(CH_2-COO-CH_2(CF_2CF_2)_2H)-COO-CH_2(CF_2CF_2)_2H$ (2) Fluorine Compound Having Nonionic Hydrophilic Group A nonionic hydrophilic group is a group that dissolves in water without dissociation into an ion. It is exemplified as poly (oxyethylene) alkylether and polyvalenet alcohol, but not restricted thereto.

The preferable nonionic fluorine compound of the invention is expressed by the following formula (3).

$$Rf—X—((CH_2)_n—O)_m—R \qquad \text{General formula (3)}$$

In the general formula (3), Rf is said fluoroalkyl group, and examples of Rf include those described before, and the preferable structures are the same as those expressed by the general formula (A). Of these structures, most preferable are those the same as that described in the foregoing Rf.

In the general formula (3), X represents adivalent linking group. There are no particular restrictions, with the examples shown below.

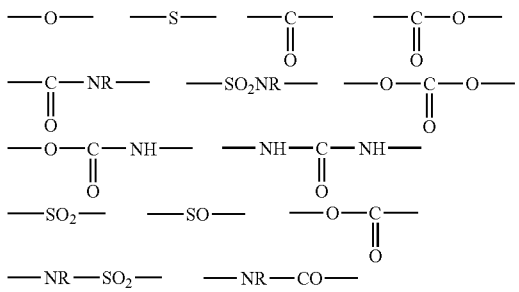

In the general formula (3), n represents an integral number of 2 or 3, m represents an integral number of 1 to 30. R is a group having at least one of a hydrogen atom, alkyl group, aryl group, heterocyclic group, Rf or Rf as a substituent.

Examples of the nonionic fluorine compound of the invention are shown below, which is not construed to limit the scope of the invention.

FN-1

$C_4F_9CH_2CH_2O—(CH_2CH_2O)_n—H$ n = 5 ~ 15

FN-2

$H(CF_2)_6CH_2O—(CH_2CH_2O)_n—H$ n = 5 ~ 15

FN-3

$C_4F_9CH_2COO—(CH_2CH_2O)_n—H$ n = 5 ~ 15

FN-4

$C_4F_9CH_2CONH—(CH_2CH_2O)_n—H$ n = 5 ~ 15

FN-5

$C_4F_9CH_2SO_2NH—(CH_2CH_2O)_n—H$ n = 5 ~ 15

FN-6

$C_4F_9CH_2CH_2NHCOO—(CH_2CH_2O)_n—H$ n = 5 ~ 15

FN-7

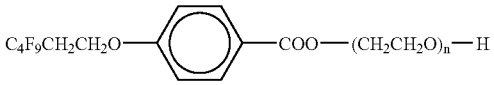

n = 5 ~ 15

-continued

FN-8

$H(CF_2)_4CH_2O—(CH_2CH_2CH_2O)_n—H$ n = 5 ~ 15

FN-9

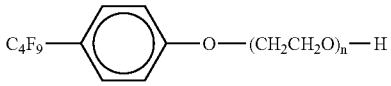

n = 5 ~ 15

FN-10

$C_4F_9CH_2CH_2O—(CH_2CH_2O)_{n1}—(CH_2CH_2CH_2O)_{n2}—(CH_2CH_2O)_{n3}—H$ n1 = 5 ~ 10
n2 = 5 ~ 10
n3 = 5 ~ 10

FN-11

$C_4F_9CH_2CH_2O—(CH_2CH_2O)_n—CH_3$ n = 10 ~ 20

FN-12

$C_4F_9CH_2CH_2O—(CH_2CH_2O)_n—C_4H_9$ n = 10 ~ 20

FN-13

$C_4F_9CH_2CH_2O—(CH_2CH_2O)_n—CH_2CH_2C_4H_9$ n = 10 ~ 20

FN-14

$$\begin{array}{l} CH_2COO—(CH_2CH_2O)_n—CH_2CH_2C_4H_9 \\ | \\ CH_2COO—(CH_2CH_2O)_n—CH_2CH_2C_4H_9 \end{array}$$

n = 5 ~ 10

FN-15

$$\begin{array}{l} CH_2COO—(CH_2CH_2O)_n—CH_2CH_2C_4H_9 \\ | \\ CHCOO—(CH_2CH_2O)_n—CH_2CH_2C_4H_9 \\ | \\ CH_2COO—(CH_2CH_2O)_n—CH_2CH_2C_4H_9 \end{array}$$

n = 5 ~ 10

FN-16

$$\begin{array}{l} CH_2O—(CH_2CH_2O)_n—CH_2CH_2C_4H_9 \\ | \\ CHO—(CH_2CH_2O)_n—CH_2CH_2C_4H_9 \\ | \\ CH_2O—(CH_2CH_2O)_n—CH_2CH_2C_4H_9 \end{array}$$

n = 5 ~ 10

FN-17

$H—C_6F_{12}CH_2O—(CH_2CH_2O)_n—CH_2C_6F_{12}—H$ n = 5 ~ 10
0

FN-18

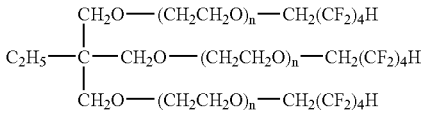

n = 5 ~ 10

1-1-9. Other Compositions (1) Coloring Agent

In the invention, a coloring agent having an absorption maximum at a wavelength of 300 to 450 nm can be add for the purpose of improving the silver tone image and over-time change in the image. Said coloring agent is described in JP-A Nos. 62-210458, 63-104046, 63-103235,63-208846,63-306436, 63-314535, 01-61745 and 2001-100363.

Said coloring agent is ordinarily added in a range of 0.1 $mg/m^2$ to 1 $g/m^2$, and a preferable layer to be added is a back side layer to be provided on the opposite side of the image forming layer.

It is also preferable to use a dye having an absorption peak at a wavelength of 580 to 680 nm for controlling the base color tone. Dyes preferable for this purpose are oil-soluble azomethine dyes with a smaller absorption intensity on the short wavelength side described in JP-A Nos. 4-359967 and 4-359968 and water-soluble phthalocyanine dyes described in Japanese Patent Application No. 2002-96797. Said dyes may be added in either layer, and preferably in a non-photosensitive layer of the emulsion layer side or on the back side.

(2) Matting Agent

In the invention, it is preferable to add a matting agent for improving the conveyance property. Matting agents are described in paragraphs [0126] to [0127] of JP-A No. 11-65021. When the quantity of the matting agent is expressed in the coating quantity per 1 $m^2$ of a photosensitive material, it is preferably in a range of 1 to 400 $mg/m^2$ and more preferably in a range of 5 to 300 $mg/m^2$. In the invention, the matting agent may be used either in delomorphous or amorphous shape but preferably in a delomorphous spherical shape. The mean particle size is preferably 0.5 to 10 μm, more preferably 1.0 to 8.0 μm and still more preferably 2.0 to 6.0 μm. Regarding the particle size distribution, the coefficient of variation is preferably 50% or less, more preferably 40% or less and still more preferably 30% or less. The coefficient of variation hereof is a value expressed by dividing the standard deviation of particle size by the mean value of particle size and making the resultant times 100. It is also preferable that 2 species of matting agents are used together that are small in the coefficient of variation and 3 or greater in the mean particle size ratio.

As long as the stardust damage does not take place, the matting degree on the emulsion surface may be neglected. However, Bekk smoothness is preferably in a range from 30 to 2000 seconds, and particularly preferably in a range from 40 to 1500 seconds. Bekk smoothness can be easily referred to in the Japanese Industrial Standard (JIS) P8119 [Method of Smoothness of Paper and Paper Board by Bekk Tester] and TAPPI standard method (T479).

In the invention, the matting degree of the back side layer is preferably in a range from 10 to 1200 seconds in terms of Bekk smoothness, more preferably in a range from 20 to 800 seconds, and still more preferably in a range from 40 to 500 seconds.

It is preferable that the matting agent of the invention is contained in an outermost layer of the photosensitive material, a layer acting as the outermost layer or a layer close to the outer surface. It is also preferable that the matting agent is contained in a layer acting as a so-called protective layer.

(3) Hardener

A hardener may be used in the layers such as image forming layer, protective layer and back layer. Hardeners are produced in the methods described on page 77 to 87 of "The Theory of the Photography Process, Fourth Edition" authored by T. H. James (published by Macmillian Publsihing Co., Inc., 1997). The preferable examples of the hardeners include multi-valent matalic ions described on page 78 of the above text, polyisocyanates described in U.S. Pat. No. 4,281,060 and JP-A No. 6-208193, epoxy compounds described in U.S. Pat. No. 4,791,042 and vinylsulfone compounds described in JP-A No. 62-89048, in addition to chrome alum, 2.4-dichloro-6-hydroxy-s-triazine sodium, N,N-ethylene bis (vinylsulfone acetoamide), N.N-propylene bis (vinylsulfone acetoamide).

The hardener is added in a form of solution. The solution is added to a coating liquid for the protective layer during a time from 180 minutes before the coating to immediately before the coating and preferably during a time from 60 minutes to 10 seconds before the coating. There are no particular restrictions on the mixing methods and conditions as long as the effect of the invention can be provided sufficiently. Specific mixing methods include a method for mixing in a tank by which a desired mean holding time can be attained by calculating the feed rate of the additive and sending quantity to the coater, or the mixing method using a static mixer described in Chapter 8 of "Technology of Mixing Liquid" authored by N. Harnby, M. F. Edwards and A. W. Nienow and translated by Koji Takahashi (published by Nikkan Gokyo Shinbun Ltd., 1989)

(4) Antistatic Agent

In the invention, it is preferable to have a conductive layer containing metal oxides or conductive polymers. An antistatic layer may be served as an prime coat layer, back layer or surface protective layer, or prepared separately. Metal oxides with increased conductivity by introducing oxygen-defect different metallic atoms into metal oxides are preferably usable as a conductive material for the antistatic layer. Preferable metallic oxides include ZnO, $TiO_2$ and $SnO_2$. It is preferable to add Al or In to ZnO, add Sb, Nb, P or halogen to $SnO_2$ and add Nb or Ta to $TiO_2$. It is particularly preferable to add Sb to $SnO_2$. Addition of different atoms is preferably in a range of 0.01 to 30mol % and more preferably in a range of 0.1 to 10mol %. Any shape of metal oxides may be used, such as spherical, needle or plate shape. Preferable are needle-shaped particles with the ratio of major axis to minor axis of 2.0 or greater and more preferably 3.0 to 50 in view of the effect of imparting the conductivity. Metal oxides are used preferably in a range of 1 $mg/m^2$ to 1000 $mg/m^2$, more preferably in a range of 10 $mg/m^2$ to 500 $mg/m^2$, and still more preferably in a range of 20 $mg/m^2$ to 200 $mg/m^2$. The antistatic layer of the invention may be prepared either on the emulsion side or back side or preferably between the support and the back layer. Examples of the antistatic layer of the invention are described in paragraph 0135 of JP-A No. 11-65021, JP-A Nos. 56-143430, 56-143431, 58-62646, 56-120519, paragraphs 0040 to 0051 of JP-A No. 11-84573, U.S. Pat. No. 5,575,957 and paragraphs 0078 to 0084 of JP-A No. 11-223898.

(5) Other Additives

Anti-oxidants, stabilizing agents, plasticizers, ultraviolet ray-absorbing agents or coating adjuvants may be also added to the photothermographic material. These agents are added to either the image-forming layer or the non-photosensitive layer. The details of said addition can be referred to the descriptions given in WO 98/36322, EP803764A1, JP-A Nos. 10-186567 and 10-18568.

1-1-10. Layer Formation (1) Method

The above back side layer can be formed by the following method: said polymer, matting agent, antistatic agent, etc., are dispersed or dissolved in water or an organic solvent, and Thus obtained coating liquid is directly coated on the support or layers such as a conductive layer, etc., prepared on the support and subjected to heating and drying. Further, a back side protective layer may be provided. The coating can be effected by known methods such as air doctor coater, bread coater, rod coater, knife coater, squeeze coater, reverse coater, bar coater and others.

The support can be produced on these layers by a known method by which individual layers are formed on the support sequentially, or by another method by which all the layers are subjected to die extrusion at the same time to obtain a multilayered coating. In either way, it is necessary to prevent mixing between coating layers for obtaining high-quality photothermographic materials. The photothermographic material of the invention is preferably formed by coating 2 or more layers at the same time according to a multilayered coating and then dried. Multilayered coating may be effected by coating methods, for example, using an extrusion die coater or curtain flow coater. When multilayered coating is effected by an extrusion die coater, two types of coating liquids extruded at the same time are formed in a multilayered manner near the outlet of the extrusion die coater, namely, before traveling to the support, and coated as they are on the support in a multilayered manner.

In producing photothermographic materials, strong aeration is done at the drying process to accelerate the drying for improving the productivity, which may cause irregularity on the dried surface to deteriorate the surface condition.

In the invention, since a coating liquid is not prepared in advance and dried on coating on the image forming layer, it is necessary to strictly control the drying air and drying temperature. The preferable drying method of the invention is described in detail in JP-A Nos. 2001-194749 and 2002-139814.

It is preferable that the photothermographic material of the invention is subjected to thermal treatment immediately after the coating and drying to improve film formability. The thermal treatment is effected preferably at the temperature on the film surface at 60° C. to 100° C. for 1 to 60 seconds, and more preferably at 70 to 90° C. for 2 to 10 seconds. The preferable method for thermal treatment in the invention is described in JP-A Nos. 2002-107872.

(2) Coating Liquid

The coating liquid for forming the non-photosensitive back side layer is an aqueous solution or organic solution, which contains a binder. It further contains a matting agent, surfactant, coloring agent, ultraviolet absorbing agent, crosslinking agent, and antioxidant, etc.

The coating liquid of the invention is preferably a so-called thixotropic fluid. This is also preferable not only in the non-photosensitive back side layer but also in other layers of the image forming side such as an image forming layer or an intermediate layer. Said technology can be referred to a JP-A No. 11-52509. The viscosity of the organic silver salt-containing coating liquid of the invention is preferably 400 mPa·s to 100,000 mPa·s at the shear rate of 0.1 $S^{-1}$ and more preferably 500 mPa·s to 20,000 mPa·s. The viscosity is preferably 1 mPa·s to 200 mPa·s at the shear rate of 1000 $S^{-1}$ and more preferably 5 mPa·s to 80 mPa·s.

When the coating liquid of the invention is prepared by mixing 2 types of liquids, such preparation is preferably manufactured by using a known inline mixer or implant mixer. The preferable inline mixer of the invention is described in JP-A No. 2002-85948, and the preferable implant mixer is described in JP-A No. 2002-90940.

It is preferable to defoam the coating liquid of the invention for keeping the coated surface in a good condition. The preferable defoaming method of the invention is described in JP-A No. 2002-66431.

When the coating liquid of the invention is coated, it is preferable to conduct antistatic treatment for preventing dust, etc., from adhering to the support. The method for antistatic treatment of the invention is described in JP-A No. 2002-143747.

The viscosity of the coating liquid for the non-photosensitive back side layer is preferably 15 cP to 80 cP at coating temperature. The viscosity of the coating liquid for forming the outermost layer in particular is preferably 20 cP to 60 cP at the coating temperature, and more preferably 25 cP to 50 cP. The viscosity of the coating liquid for the layer adjacent to the outermost layer is preferably 20 cP to 60 cP at a coating temperature and more preferably 25 cP to 50 cP.

The surface tension of the coating liquid is an important parameter for improving the surface status. In particular when multilayered coating is conducted, it is necessary to control surface tension for preventing contamination between coating films. Surface tension can be controlled by addition of said surfactants. In the invention, it is preferable that the surface tension of the coating liquid for the outermost layer is at least 2 mN/m less than a surface tension of the coating liquid for a layer adjacent to the outermost layer.

(3) Film Thickness

The film thickness of the back side layer is preferably in a range of 0.1 to 10 μm and particularly preferably in a range of 0.2 to 5 μm.

1-2. Image Forming Side 1-2-1. Layer Composition

An image-forming side ordinarily possesses an image forming layer and a non-photosensitive layer. The non-photosensitive layer is classified into the following layers on the basis of the position: (1) a protective layer that is formed upper than an image forming layer (further side from the support), (2) an intermediate layer formed between plural image forming layers or between an image forming layer and a protective layer, (3) a prime coat or under coat layer formed between an image forming layer and the support.

In most cases, a filter layer is prepared as layers of (1) or (2), and an anti-halation layer prepared on a photosensitive material is provided on the photosensitive material as a layer of (3). For preventing irradiation, an image-forming layer is colored in some cases.

1-2-2. Image Forming Layer

An image-forming layer is prepared on the support in one or more layers. When the image-forming layer is composed of one layer, it contains an organic silver salt, a photosensitive silver halide, a reducing agent and a binder. It may contain a color tone modifier, coating adjuvant and other adjuvant when such additional necessity arises. When composed of 2 or more layers, the first image forming layer (ordinarily a layer adjacent to the support) contains an organic silver salt and a photosensitive silver halide, and the second image forming layer or both of the layers must include some other parts. A multi-color photosensitive thermal developing photography material may be composed of a combination of these 2 layers for each color. Further, as described in U.S. Pat. No. 4,708,928, the material may be composed of one layer that contains all the parts. In the multi-color photosensitive thermal developing photography material, individual emulsion layers are maintained separately from each other by using a functional or non-functional barrier layer in an area between individual image forming layers, as described in U.S. Pat. No. 4,460,681.

The following is an explanation regarding preferable aspects of the image-forming layer of the invention.

1-2-3. Explanation of Organic Silver Salt (1) Composition

An organic silver salt used in the invention is relatively stable against light, but functions as a supplier of a silver ion when heated to 80° C. or higher in the presence of an exposed photosensitive silver halide and reducing agent to form a silver image. The organic silver salt may be any organic substance that can supply silver ions reducible by a reducing agent. Said non-photosensitive organic silver salts are described in paragraphs 0048 to 0049 of JP-A No. 10-62899, line 24 on page 18 to line 37 on page 19 EP-A Nos. 0803764A1 and 0962812A1, JP-A Nos. 11-349591, 2000-7683 and 2000-72711. Preferable is an organic acid silver salt, and more preferable is silver salt of a long-chain aliphatic carboxylic acid (having carbon atoms of 10 to 30 preferably 15 to 28). Preferable examples of aliphatic acid silver salts include lignoceric acid, silver behenate, silver arachidate, silver stearate, silver oleate, silver laurate, silver caproate, silver myristate, silver palmitate, erucic acid and these mixtures. In the invention, of these aliphatic acid silvers, preferable are those having a preferable silver behenate content of 50 mol % or higher and 100 mol % or less, more preferable content of 85 mol % or higher and 100 mol % or less, and still more preferable content of 95 mol % or higher and 100 mol % or less. Also preferable are aliphatic acid silvers having a preferable erucic acid content of 2 mol % or less, more preferable content of 1 mol % or less and still more preferable content of 0.1 mol % or less.

Further, it is also preferable that stearic acid silver content is 1 mol % or less. An organic acid silver salt that is less in Dmin, highly sensitive and excellent in image storability is obtained by keeping said stearic acid content to 1 mol % or less. Stearic acid content is preferably 0.5 mol % or less, and no stearic content is particularly preferable.

When silver arachidate is contained as an organic acid silver salt, the content of silver arachidate is preferably 6 mol % or less and more preferably 3 mol % or less in obtaining less Dmin and an organic acid silver salt of excellent image storability.

(2) Configuration

There are no particular restrictions in the configurations of organic silver salts used in the invention, and any configurations such as needle shape, bar shape, tabular shape or scaly shape may be used.

Scaly organic silver salts are preferable in the invention. Also preferably used are amorphous particles of short needle shape, rectangular shape, cubic shape or potato shape, whose ratio of major axis to minor axis is 5 or less. These organic silver particles are characterized by less fogging upon thermal development as compared with long-needle shaped particles having the major axis to minor axis ratio of 5 or greater. In particular, a particle whose ratio of major axis to minor axis is 3 or less is preferable because it can improve the mechanical stability of coated film. In this invention, the scaly organic silver salt is defined as follows: under electron microscopic observation, the particle of the said salt is closely similar to a rectangular shape and when the sides of the rectangular solid are assumed to be a, b, and c in the ascending order of length (c and b may be of the same length), x is determined as follows by calculation referring to shorter sides of a and b.

$$x=b/a$$

By referring to the above formula, x is determined for approximately 200 particles to obtain the mean value x. When the relation of x (mean value)≧1.5 is obtained, such particles are defined as a scaly particle. The preferable relation is 30≧x (mean value)≧1.5 and the more preferable relation is 15≧x (mean value)≧1.5. For reference, the needle shape is expressed as the relation of 1≦x (mean value)<1.5.

In the scaly particle, a is the thickness of a tabular-shaped particle having a major surface with the sides of b and c.

The mean value of a is preferably in a range from 0.01 μm to 0.3 μm, and more preferably in a range from 0.1 μm to 0.23 μm. The mean value of c/b is preferably 1 or more and 9 or less, more preferably 1 or more and 6 or less, still more preferably 1 or more and 4 or less and most preferably 1 or more and 3 or less.

Less aggregation in the photosensitive material and better image storability can be attained by keeping said sphere equivalent diameter of 0.05 μm or greater and 1 μm or less. The sphere equivalent diameter is preferably 0.1 μm or greater and 1 μm or less. In the invention, the sphere equivalent diameter can be determined by subjecting samples directly to electron-microscopic photography and image processing the negative films.

In the scaly particle, the sphere equivalent diameter of the particle /a is defined as the aspect ratio. The aspect ratio of scaly particle is preferably 1.1 or greater and 30 or less and more preferably 1.1 or greater and 15 or less in view of less aggregation in the photosensitive material and better image storability.

The particle size distribution of organic silver salts is preferably of monodispersion. The monodispersion can be expressed in percentage obtained by dividing the standard deviations of the lengths of the minor axis and the major axis by the minor axis and the major axis respectively. It is preferably 100% or less, more preferably 80% or less, and still more preferably 50% or less. The configuration of organic silver salts can be determined by observing the image of dispersed organic silver salt under a transmission electron microscope. Themonodispersion can be determined by another method, namely, the standard deviation is calculated for the volume weighted mean diameter of organic silver salt, and expressed in percentage (coefficient of variation) obtained by dividing the standard deviation by the volume weighted mean diameter. The Thus obtained monodispersion is preferably 100% or less, more preferably 80% or less and still more preferably 50% or less. There are also other methods, for example, themonodispersion is determined from particle size is being measured (volume weighted mean diameter) which is obtained by an irradiating laser beam to organic silver salt dispersed in a liquid to obtain the auto correlation function in relation to over-time variation in scattered light.

(3) Preparation

Manufacturing and dispersion methods for the organic silver salts used in the invention can be attained by publicly known methods, for example by referring to those described in JP-A No. 10-62899, EP-A Nos. 0803763A1 and 0962812A1, JP-A Nos. 11-349591, 2000-7683, 2000-72711, and 2001-163889, 2001-163890, 2001-163827, 2001-33907, 2001-188313, 2001-83652, 2002-6442, 2002-49117, 2002-31870 and 2002-107868.

When photosensitive silver salt is allowed to coexist at the time of dispersing organic silver salt, fog increases and results in a great decrease in sensitivity. Therefore, it is more preferable that no photosensitive silver salt is practically contained at the time of dispersion. In the invention, the photosensitive silver salt content in the aqueous dispersion to be dispersed is preferably 1 mol % or less and more particularly 0.1 mol % or less based on 1 mol of organic silver acid salt contained in the aqueous dispersion. It is still more preferable that the photosensitive silver salt is not intentionally added.

In this invention, it is possible to mix organic silver salt aqueous dispersion with photosensitive silver salt aqueous dispersion for producing photosensitive materials. The organic silver salt and the photosensitive silver salt can be mixed at any rate, depending on the purposes. The ratio of the photosensitive silver salt to the organic silver salt is preferably in a range of 1 to 30 mol %, more preferably in a range of 2 to 20 mol % and particularly preferably in a range of 3 to 15 mol %. Mixing of 2 or more types of organic silver salt aqueous dispersions with 2 or more types of photosensitive silver salt aqueous dispersions is a preferable method for adjusting photography characteristics.

(4) Added Quantity

The organic silver salt used in the invention can be employed at a desired quantity, namely, in a range of 0.1 to 5.0 $g/m^2$ in terms of silver coating quantity including silver halide, more preferably in a range of 0.3 to 3.0 $g/m^2$, and still more preferably in a range of 0.5 to 2.0 $g/m^2$. For improving the image storability, a total silver coating quantity is preferably 1.8 $g/m^2$ or less and more preferably 1.6 $g/m^2$. It is possible to obtain a sufficient color remaining at such low silver quantity by using the preferable reducing agent of the invention.

1-2-4. Explanation Regarding Reducing Agent

It is preferable that the photothermographic materials used in the invention contain a thermal developer, a reducing agent for reducing organic silver salts. The reducing agent for organic silver salts may be any substance that can reduce silver ion into metallic silver (preferably organic substances). Examples of said reducing agent are described in paragraphs [0043] to [0045] of JP-A No. 11-65021 and in line 34 on page 7 to line 12 on page 18 of EP-A No. 0803764A1.

In the invention, preferable reducing agents are so called hindered phenol reducing agent having a substituent at an ortho position of phenoly hydroxy group or bisphenol reducing agent, and the more preferable agents are those shown in the general formula (R) below.

General formula (R)

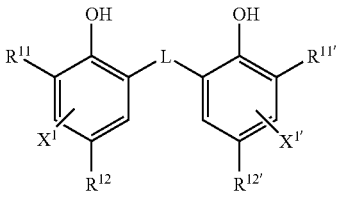

In the general formula (R), $R^{11}$ and $R^{11'}$ represent independently an alkyl group with 1 to 20 carbon atoms. Further, $R^{12}$ and $R^{12'}$ represent independently a hydrogen atom or substituent group that can be substituted with a benzene ring. L represents —S— group or —$CHR^{13}$— group. $R^{13}$ represents a hydrogen atom or alkyl group with 1 to 20 carbon atoms. $X^1$ and $X^{1'}$ represent independently a hydrogen atom or group that can be substituted with a benzene ring.

A detailed explanation is now made regarding the substituent groups in the general formula (R).

(1) $R^{11}$ and $R^{11'}$ $R^{11}$ and $R^{11'}$ represent independently substituted or unsubstituted alkyl groups with 1 to 20 carbon atoms. There are no restrictions on the substituent groups of an alkyl group but preferable substituent groups include an aryl group, hydroxy group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

(2) $R^{12}$ and $R^{12'}$ and $X^1$ and $X^{1'}$ $R^{12}$ and $R^{12'}$ represent independently a hydrogen atom or substituent groups that can be substituted with a benzene ring.

$X^1$ and $X^{1'}$ represent independently a hydrogen atom or substituent groups that can be substituted with benzene ring. Their respective groups that can be substituted with a benzene ring include preferably an alkyl group, aryl group, halogen atom, alkoxy group and acyamino group.

(3) L

L represents an —S— group or —$CHR^{13}$— group. $R^{13}$ represents hydrogen atom or alkyl group with 1 to 20 carbon atoms. The alkyl group may be provided with substituent groups. Examples of $R^{13}$ unsubstituted alkyl groups include a methyl group, ethyl group, propyl group, butyl group, heptyl group, undecyl group, isopropyl group, 1-ethylpentyl group and 2,4,4-trimethylpentyl group. Examples of substituted alkyl groups include the same groups as those given for the above $R^{11}$ such as a halogen atom, alkoxy group, alkylthio group, aryloxy group, arylthio group, acylamino group, sulfone amide group, sulfonyl group, phoshoryl group, oxycarbonyl group, carbamoyl group and sulfamoyl group.

(4) Preferable Substituents

Preferable $R^{11}$ and $R^{11'}$ are secondary and tertiary alkyl groups with 3 to 15 carbon atoms, and examples include isopropyl group, an isobutyl group, t-butyl group, t-amyl group, y-octyl group, cyclohexyl group, cyclopentyl group, 1-methylcyclohexyl group and 1-methylcyclopropyl group. More preferable $R^{11}$ and $R^{11'}$ are tertiary alkyl groups with 4 to 12 carbon atoms, of which a t-butyl group, t-amyl group and 1-methylcyclohexyl group are particularly preferable and a t-butyl group is most preferable.

Preferable $R^{12}$ and $R^{12'}$ are alkyl groups with 1 to 20 carbon atoms, and examples include a methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferable examples include a methyl group, ethyl group, propyl group, isopropyl group and t-butyl group. $X^1$ and $X^{1'}$ are preferably a hydrogen atom, halogen atom or alkyl group, and more preferably a hydrogen atom.

Preferable L is a —$CHR^{13}$ group.

Preferable $R^{13}$ is a hydrogen atom or an alkyl group with 1 to 15 carbon atoms, and a preferable alkyl group includes methyl group, ethyl group, propyl group, isopropyl group or 2,4,4-trimethylpentypl group. Particularly preferable $R^{13}$ are a hydrogen atom, methyl group, ethyl group, propyl group or isopropyl group.

When $R^{13}$ is a hydrogen atom, $R^{12}$ and $R^{12'}$ are preferably alkyl groups with 2 to 5 carbon atoms, preferably an ethyl group or propyl group, and most preferably an ethyl group.

When $R^{13}$ is a primary or secondary alkyl group with 1 to 8 carbon atoms, $R^{12}$ and $R^{12}$ are preferably a methyl group. Primary and secondary alkyl groups of $R^{13}$ with 1 to 8 carbon atoms are more preferably a methyl group, ethyl group, propyl group or isopropyl group, and still more preferably a methyl group, ethyl group or propyl group.

When $R^{11}$, $R^{11'}$, $R^{12}$ and $R^{12'}$ are all methyl groups, it is preferable that $R^{13}$ is a secondary alkyl group. In this instance, the secondary alkyl group of $R^{13}$ is preferably an isopropyl group, isobutyl group or 1-ethylpentyl group, and more preferably an isopropyl group.

The above reducing agents differ in thermal development properties, silver tone upon development and others, depending on a combination of $R^{11}$, $R^{11'}$, $R^{12}$ and $R^{12'}$. Since these properties can be adjusted by combining 2 or more reducing agents, it is desirable to use the reducing agents in 2 or more combinations, depending on the purpose.

Examples of reducing agents in the invention are shown below, together with the compounds expressed by the general formula (R), which are not construed to limit the scope of the invention.

(R-1)
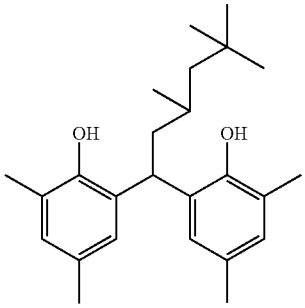
(R-2)
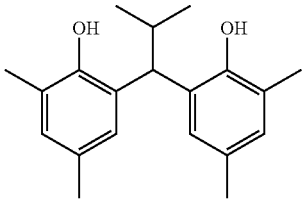
(R-3)
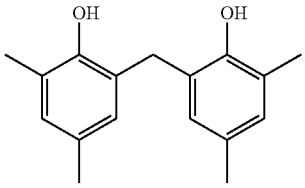
(R-4)
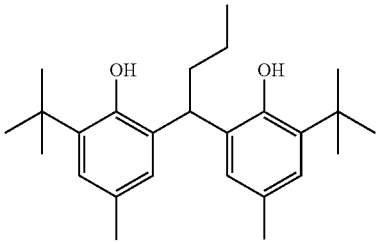
(R-5)
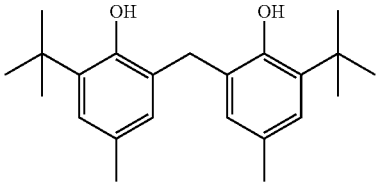
(R-6)
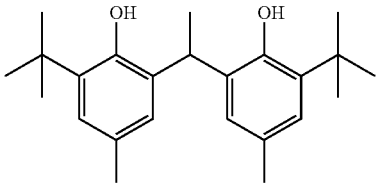
(R-7)
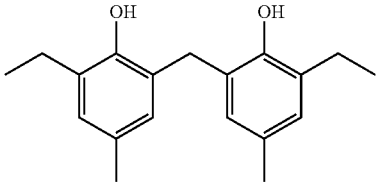
-continued
(R-8)
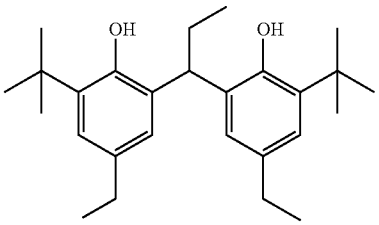
(R-9)
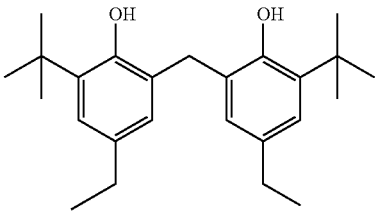
(R-10)
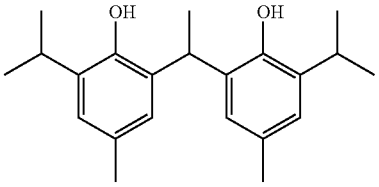
(R-11)
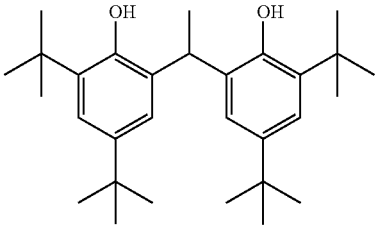
(R-12)
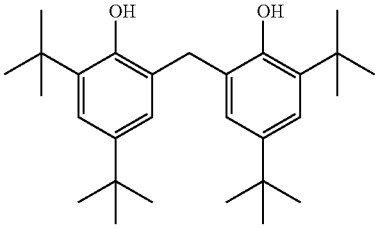
(R-13)
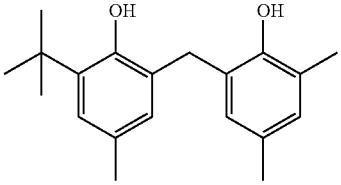
(R-14)
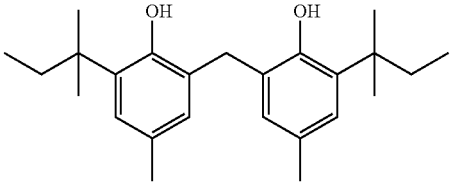

-continued
(R-15)
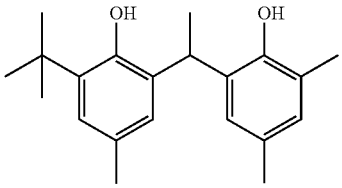
(R-16)
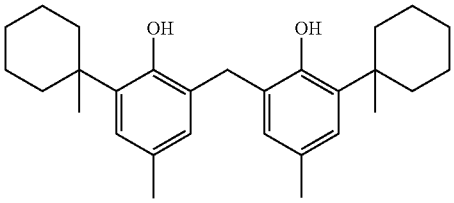
(R-17)
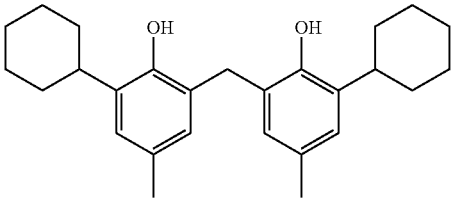
(R-18)
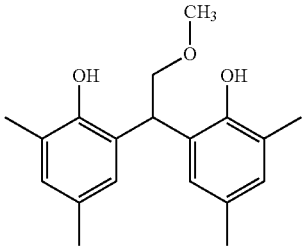
(R-19)
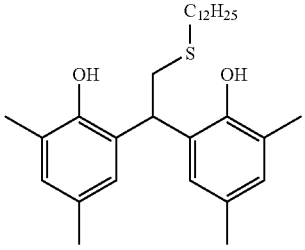
(R-20)
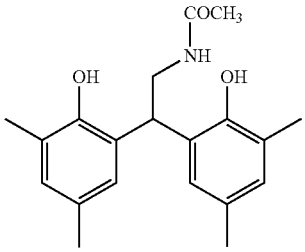
(R-21)
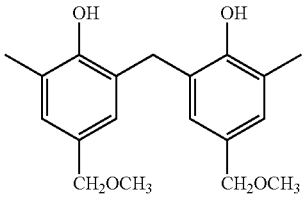
-continued
(R-22)
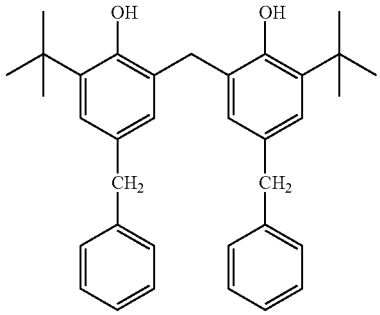
(R-23)
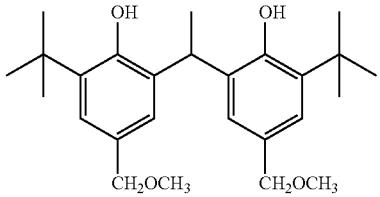
(R-24)
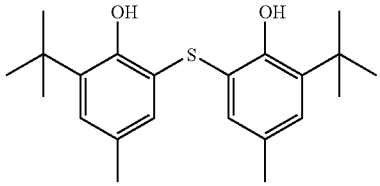
(R-25)
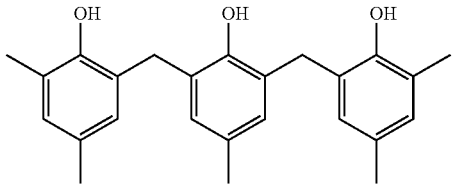
(R-26)
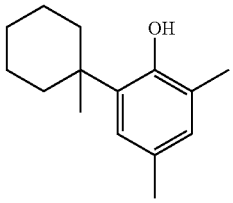
(R-27)
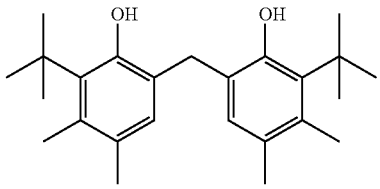
(R-28)
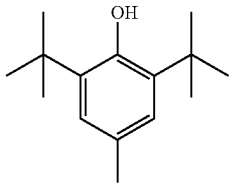

-continued (R-29)

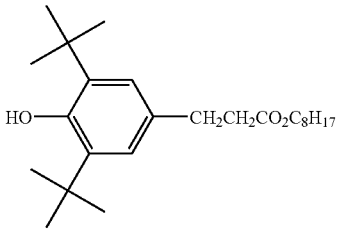

(R-30)

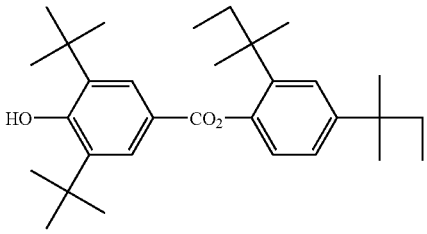

(R-31)

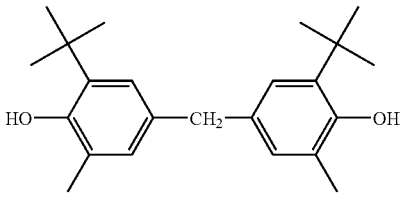

(R-32)

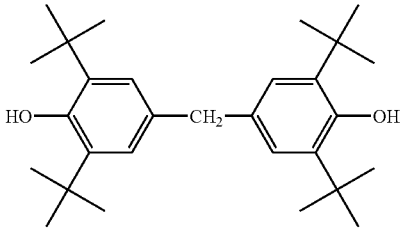

(R-33)

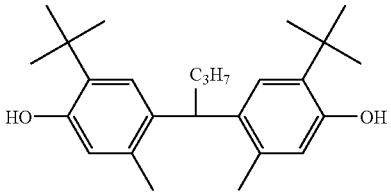

(R-34)

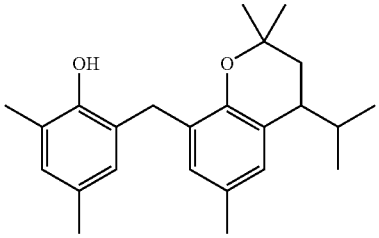

Examples of preferable reducing agents of the invention other than those given above are compounds described in JP-A Nos. 2001-188314, 2001-209145, 2001-350235 and 2002-156727.

In this invention, the reducing agent is to be added preferably in a range of 0.1 to 3.0 g/m$^2$, more preferably in a range of 0.2 to 1.5 g/m$^2$, and still more preferably in a range of 0.3 to 1.0 g/m$^2$. The reducing agent is contained preferably in a range of 5 to 50 mol % based on 1 mol of silver on the image-forming layer, more preferably in a range of 8 to 30 mol % and still more preferably in a range of 10 to 20 mol %. It is preferable that the reducing agent is contained in the image-forming layer.

The reducing agent may be contained in a coating liquid in any form such as an emulsified dispersion or a micro-particle solid-state dispersion so that they can be contained in the photosensitive material. A well-known method for attaining an emulsified dispersion is that oils such as dibutylphthalate, tricresylphosphate, glyceryltriacetate and diethylphthalate, or auxiliary solvents such as ethyl acetate and cyclohexanone are used to dissolve the reducing agent, thus mechanically preparing the emulsified dispersion.

A micro-particle solid dispersion method is that a powdery reducing agent is dispersed in any appropriate solvent such as water by means of ball mill, colloid mill, vibrating ball mill, sand mill, jet mill, roller mill or by supersonic wave to prepare a solid dispersion. In this instance, protective colloids (for example, polyvinyl alcohol), surfactants (for example, anion surfactant such as sodium tri-isopropylnaphthalenesulfonate) (a mixture of substances with different substitution positions of 3 isopropyl groups) may be used. Beads such as zirconia as a dispersion medium are commonly used in the mills mentioned above, and Zr and others eluted from the beads may be found in dispersions. Dispersion is in a range of 1 ppm to 1000 ppm, although dependent upon the conditions. It is practically acceptable as long as Zr is present at 0.5 mg or less per gram of silver in photosensitive materials. It is preferable that an antiseptic agent (for exampleodium benzoisothiazolinon) is contained in an aqueous dispersion.

Particularly preferable is a solid particle dispersion method by which the reducing agent is added as a micro-particle in a mean particle size of 0.01 μm to 10 μm, preferably in 0.05 μm to 5 μm and more preferably in 0.1 μm to 2 μm. Other solid dispersions used in the invention are also preferably dispersed in the above range of the particle size.

1-2-5. Explanation Regarding Development Accelerator

Development accelerators that are preferably used in the photothermographic material of the invention include sulfonamide phenol compounds described in JP-A No. 2000-267222 and expressed by the general formula (A) JP-A No. 2000-330234, hindered phenol compounds expressed by the general formula (II) described in JP-A No. 2001-92075, hydrazine compounds expressed in JP-A No. 10-62895 and expressed by the general formula (I) of JP-A No. 11-15116 and also by the general formula (D) of JP-A No. 2002-156727 and general formula (1) Japanese Patent Application No. 2001-074278, and phenol or naphthol compounds expressed by the general formula (2) in JP-A No. 2001-264929. The development accelerators are preferably used in a range of 0.1 to 20 mol % in relation to the reducing agent, more preferably in a range of 0.5 to 10 mol %, and still more preferably in a range of 1 to 5 mol %. The development accelerator may be added to the photosensitive material in the same manner as for adding the reducing agent to the photosensitive material. It is preferable that the development accelerators are added as a solid dispersion or an emulsified dispersion in particular. When added as an emulsified dispersion, it is added preferably as an emulsified dispersion prepared by using a high-boiling point solvent in a solid form at ordinary temperatures and a low-boiling point adjuvant solvent, or added as so called oil-less emulsified dispersion in which no high-boiling point solvent is used. In the invention, of the above development accelerators, more preferable are hydrazine compounds expressed by the general formula (D) in JP-A No. 2002-156727 and phenol or naphthol compounds expressed by the general formula (2) in JP-A No. 2001-264929.

(A-1)

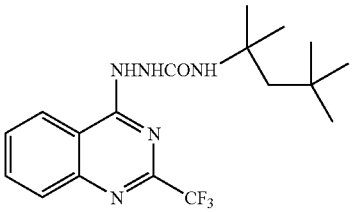

(A-2)

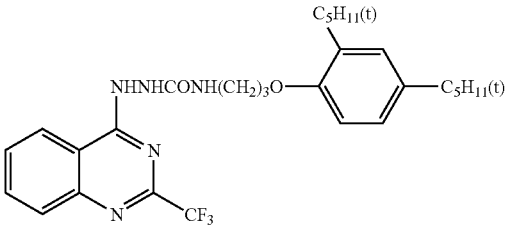

(A-3)

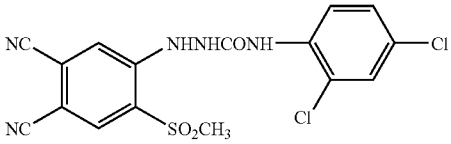

(A-4)

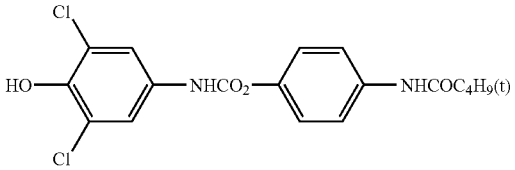

(A-5)

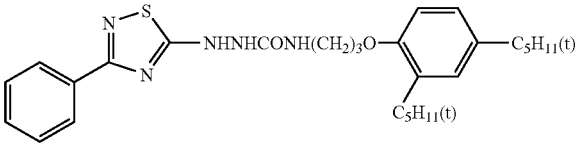

(A-6)

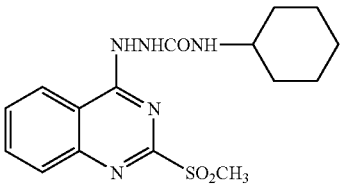

(A-7)

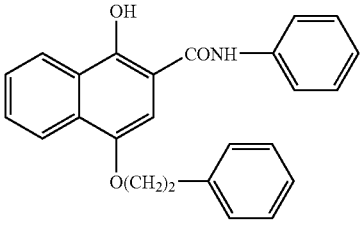

-continued (A-8)

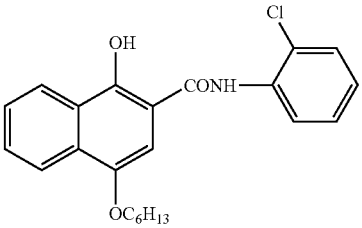

(A-9)

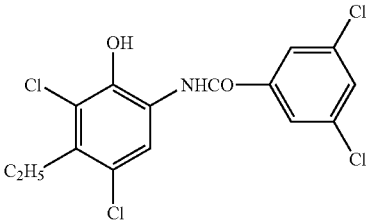

(A-10)

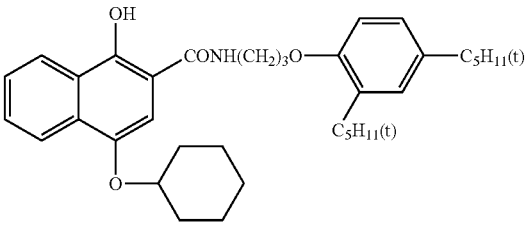

(A-11)

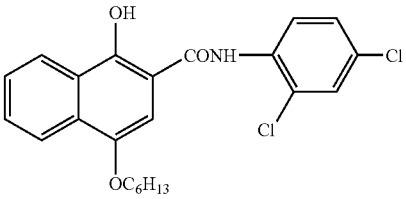

1-2-6. Explanation Regarding Hydrogen Bond Compound

When the reducing agent used in the invention has an aromatic hydroxyl group (—OH), especially in the case of bisphenol as mentioned before, preferable is concomitant use of a non-reducing compound having a group capable of forming a hydrogen bond with bisphenol.

The groups capable of forming a hydrogen bond with hydroxyls or amino groups include a sulforyl group, phosphonyl group, sulfonyl group, carbonyl group, amide group, ester group, urethane group, ureido group, tertiary amino group and a nitrogen-containing aromatic group. Among other things, preferable compounds are those having a phosphonyl group, sulfoxide group, amide group (however, those free from >N—H group and blocked like >N—Ra (Ra) is a substituent other than H), an urethane group (however, those free from >N—H group and blocked like >N—Ra (Ra) is a substituent other than H) and ureido group (however, those free from >N—H group and blocked like >N—Ra (Ra) is a substituent other than H).

Particularly preferable hydrogen bond compounds of the invention are those expressed by the following general formula (D).

General formula (D)

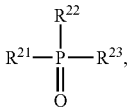

In the general formula (D), $R^{21}$, $R^{22}$ and $R^{23}$ represent independently an alkyl group, an aryl group, an alkoxy group, an aryloxy group, an amino group or a heterocyclic group, and these groups may be provided with unsubstituted or substituted groups. When $R^{21}$, $R^{22}$ or $R^{23}$ is provided with a substituent, such a substituent includes a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group. Preferable substituents are an alkyl group and aryl group, and examples thereof include a methyl group, an ethyl group, an isopropyl group, a t-butyl group, a t-octyl group, a phenyl group, a 4-alkoxyphenyl group and a 4-acyloxyphenyl group.

Examples of an alkyl group expressed by $R^{21}$, $R^{22}$ and $R^{23}$ include a methyl group, an ethyl group, a butyl group, an octyl group, a dodecyl group, an isopropyl group, a t-butyl group, a t-amyl group, a t-octyl group, a cyclohexyl group, an 1-methylcylcohexyl group, a benzyl group, a phenethyl group and a 2-phenoxypropyl group. Examples of an aryl group include a phenyl group, a cresyl group, a kylyl group, a naphthyl group, a 4-t-butylphenyl group, a 4-t-octylphenyl group, a 4-anisyzyl group and a 3,5-dichlorophenyl group. Examples of an alkoxy group include a methoxy group, an ethoxy group, a butoxy group, an octyloxy group, a 2-ethylhexyloxyl group, a 3,5,5-trimethylhexyloxy group, a dodecyloxy group, a cyclohexyloxy group, a 4-methylcyclohexyloxy group and a benzyloxy group. Examples of an aryloxy group include a phenoxy group, cresyloxy group, isopropylphenoxy group, 4-t-butylphenoxy group, naphthoxy group, and biphenyloxy group. Examples of an amino group include a dimethylamino group, diethylamino group, dibutylamino group, dioctylamino group, N-methyl-N-hexylamino group, dicyclohexylamino group, diphenylamino group.

Preferable $R^{21}$, $R^{22}$ and $R^{23}$ include an alkyl group, aryl group, alkoxy group and aryloxy group. In terms of the effect of the invention, it is preferable that at least any one of $R^{21}$, $R^{22}$ and $R^{23}$ are an alkyl group or aryl group, and it is more preferable that at least any 2 of them are an alkyl group or aryl group. It is preferable that $R^{21}$, $R^{22}$ and $R^{23}$ are of the same group in view of economic availability.

Shown below are examples of hydrogen bond compounds including the compounds expressed by the general formula (D) of the invention, which are not construed to limit the scope of the invention.

(D-1)

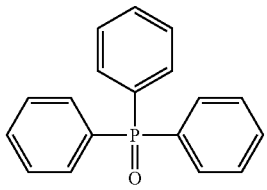

(D-2)

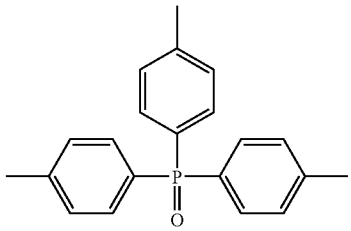

(D-3)

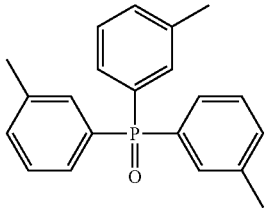

(D-4)

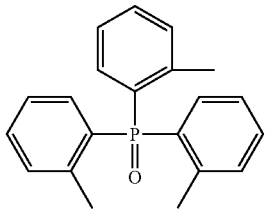

(D-5)

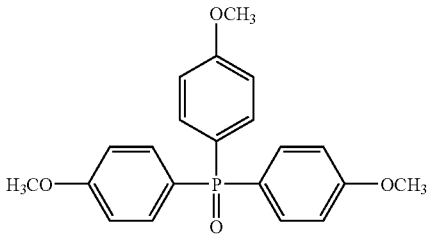

(D-6)

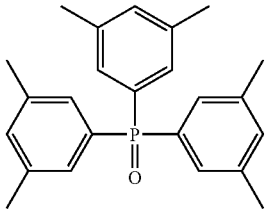

-continued (D-7)

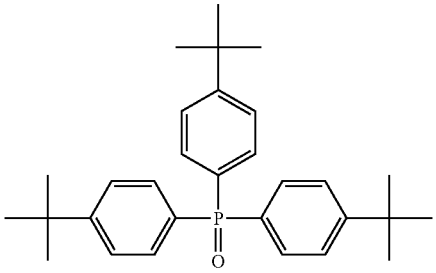

(D-8)

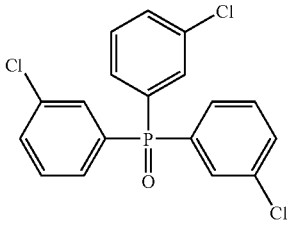

(D-9)

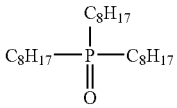

(D-10)

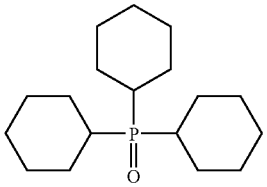

(D-11)

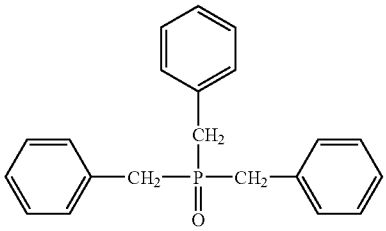

(D-12)

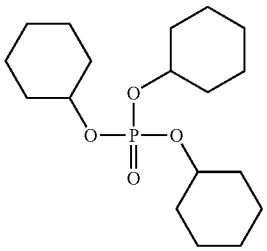

(D-13)

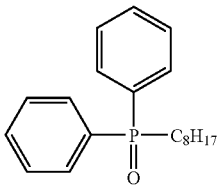

-continued (D-14)

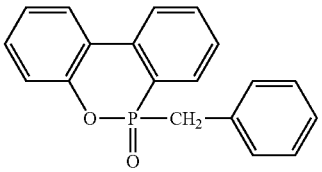

(D-15)

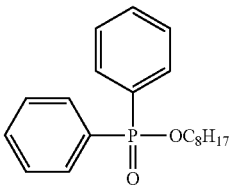

(D-16)

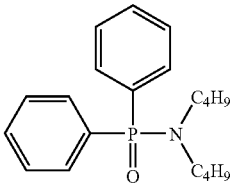

(D-17)

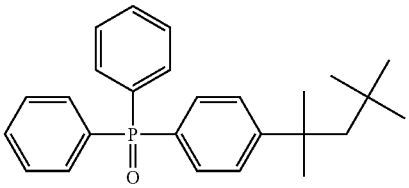

(D-18)

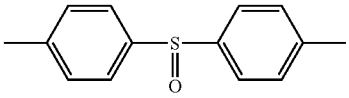

(D-19)

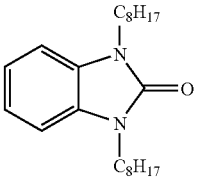

(D-20)

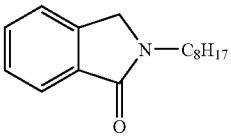

(D-21)

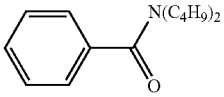

In addition to the above examples of the hydrogen bond compounds, they are also described in the specifications of EP-A No. 1096310, Japanese Patent Application Nos. 2000-270498 and 2001-124796.

As with reducing agents, the hydrogen bond compounds of the invention expressed by the general formula (D) may be contained in a coating liquid in a state of solution, emulsified dispersion or solid micro-particle dispersion so that they can be used in the photosensitive material. A solid dispersion is preferable. The compounds of the invention are provided with hydrogen-binding complexes with compounds having a phenol hydroxyl or amino group in a state of solution, and can be isolated as a crystalline complex through combination of the compounds of the invention expressed by the general formula (D) with reducing agents. It is particularly preferable in attaining stable properties to use the thus .isolated crystalline powders as solid micro-particle dispersion. A method may also be preferably employed in the invention wherein the compounds of the invention expressed by the general formula (D) are mixed in a powdery state with a reducing agent to provide complexes at the time of dispersion by a sand grind mill, etc., together with an appropriate dispersing agent.

The compounds of the invention expressed by the general formula (D) are preferably used in a range of 1 to 200 mol % in relation to a reducing agent, more preferably in a range of 10 to 150 mol %, and still more preferably in a range of 20 to 100 mol %.

1-2-7. Explanation Regarding Silver Halide (1) Halogen Composition

There are no particular restrictions regarding the photosensitive silver halide of the invention in terms of the halogen composition, and the following can be used for this purpose; silver chloride, silver chlorobromide, silver bromide, silver bromide iodide, silver chlorobromide iodide, and silver iodide. Of these compounds, preferable are silver bromide, silver bromide iodide and silver iodide. In the particle, a halogen composition may be dispersed uniformly, or undergo change in a step-wise fashion, or continuous change. A halogen silver particle having a core/shell structure is also preferably used in the invention. Preferable is a particle with a 2- to 5-layered structure and more preferable is that with a 2- to 4-layered structure. Also preferably applicable is a technology by which silver bromide or silver iodide is locally contained in the particles of a silver chloride, silver bromide or chlorobromide.

(2) Particle-Forming Method

Methods for forming photosensitive silver halides are well known in the art. For example, the methods that are described in Research Disclosure, No. 17029 published in June 1978 and the specification of U.S. Pat. No. 3,700,458 may be employed. In a practical method, silver-imparting compounds and halogen-imparting compounds are added to gelatin or other polymer solutions to adjust photosensitive silver halides, and then the photosensitive silver halides are mixed with the organic silver salt. Further, preferable methods are those described in paragraphs 0217 to 0224, JP-A Nos. 11-119374, 11-352627 and 2000-347335.

(3) Particle Size

For the purpose of preventing turbidity after image formation, it is desired to make the particle size of a photosensitive silver halide smaller, preferably 0.20 μm or less, more preferably 0.01 μm or more and 0.15 μm or less, and still more preferably 0.02 μm or more and 0.12 μm or less. In this instance, the particle size means the diameter obtained when conversion is made for the projected area of silver halide particle (project area of a major surface in the case of a tabular particle) and circular image of the said area.

(4) Particle Configuration

Configurations of the silver halide particles include a cube, octahedron, tabular particle, spherical particle, bar-shaped particle and potato-shaped particle. In the invention, cubic particles are particularly preferable. Silver halide particles with round corners can be used preferably. There are no particular restrictions on the side index (Miller index) on the outer surface of the photosensitive silver halide particles. It is, however, preferable to have a higher rate of the side of 100 high in spectral sensitization efficiency when a spectral sensitization dye is adsorbed. The rate is preferably 50% or greater, more preferably 65% or greater and still more preferably 80% or greater. The rate of the Miller index for the side of 100 can be determined by the method described in T. Tami; J. Imaging Sci., 29, 165 (1985) utilizing adsorption dependency on the sides of 111 and 100 in relation to adsorption of the spectral sensitization dye.

(5) Heavy Metals

In the invention, preferable are silver halide particles wherein a hexa-cyano metal complex is allowed to exist on the first surface of the particles. Hexa-cyano metal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, preferable is a hexa-cyano Fe complex.

A hexa-cyano metal complex is present as ion in aqueous solution, and counter cation is not important. It is preferable to use the following that that are easily mixable with water and suitable in causing sedimentation of silver halide emulsions; alkaline metal ions such as sodium ion, potassium ion, rubidium ion, cesium ion and lithium ion, ammonium ion and alkyl ammonium ion (for example, tetra-methyl ammonium ion, tetra-ethyl ammonium ion, tetra-propyl ammonium ion, tetra (n-butyl) ammonium ion).

Hexa-cyano metal complexes can be used after mixing with mixed solvents in which suitable organic solvents are easily mixable with water (for example, alcohols, ethers, glycols, ketones, esters, arnides and others) or with gelatin, in addition to water.

The addition of hexa-cyano metal complexes is preferably $1\times10^{-5}$ mol to $1\times10^{-2}$ mol based on 1 mol of silver, and more preferably $1\times10^{-4}$ mol to 1×10−3 mol based on 1 mol of silver.

Hexa-cyano metal complexes are directly added before completion of the addding process prior to the chemical sensitization process wherein sulfur sensitization, chalcogen sensitization such as selenium sensitization and tellurium sensitization, and noble metal sensitization such as gold sensitization, during the washing process, during the dispersion process or before the chemical sensitization process, following the completed feeding of silver nitrate aqueous solution to be used for forming particles, so that hexa-cyano metal complex is allowed to exist on the first surface of silver halide particles. In order to prevent the growth of silver halide microparticles, it is preferable to add hexa-cyano metal complexes immediately after formation of particles and more preferable to add it before completion of the feeding process.

Addition of hexa-cyano metal complexes may be started after addition of silver nitrate by 96% by mass in a total volume that is added for improving particle formation. It is preferable to start the addition after addition of 98% by mass and it is particularly preferable to start the addition after addition of 99% by mass.

When hexa-cyano metal complexes are added after addition of silver nitrate aqueous solution, state of which is immediately before completion of particle formation, it is possible to provide adsorption on the first surface of silver halide particles, mostly in the form of hardly-soluble salt with silver ion on particle surfaces. Silver salt of hexacyanoferrate (II) is more hardly-soluble than AgI, and able to prevent re-dissolution due to micro particles, thus making it possible to produce silver halide micro-particles with a smaller particle size.

Photosensitive silver halide particles of the invention are able to contain metals or metal complexes of groups 8 to 10 in the Periodic Table (groups 1 to 18). Of the metals or metal complexes of the groups 8 to 10 listed in the Periodic Table, rhodium, ruthenium and iridium are preferable. These metal complexes may be used solely or in combination with two or more types of complexes consisting of the same or different types of metals. The preferable content is in a range of $1\times10^{-9}$ to $1\times10^{-3}$ mol based on 1 mol of silver. These heavy metals, metal complexes and the adding methods are described in JP-A No. 7-225449, paragraphs 0018 to 0024 of JP-A No. 11-65021 and paragraphs 0227 to 0240 of JP-A No. 11-119374.

Metallic atom (for example, $[Fe(CN)_6]^{4-}$) to be contained into silver halide particles used in the invention as well as demineralization and chemical sensitization of silver halide emulsions are described in paragraphs 0046 to 0050 of JP-A No. 11-84574, paragraphs 0025 to 0031 of JP-A No. 11-65021 and paragraphs 0242 to 0250 of JP-A No. 11-119374.

(6) Gelatin

Various gelatins can be used as a gelatin contained in an emulsion to which the photosensitive silver halides are used in the invention. Gelatins with less molecular weight of 10,000 to 1,000,000 are preferable in maintaining better dispersion conditions in organic silver containing-coating liquid of photosensitive silver halide emulsions. It is also preferable that the gelatin substituents are subjected to phthalic acid treatment. These gelatins may be used at the time of particle formation or dispersion after desalting. It is, however, preferable to use the gelatins at the time of particle formation.

(7) Sensitizing Dye

The sensitizing dyes applicable in the invention are those that can give spectral sensitization to silver halide particles at desired wavelength when absorbed onto the silver halide particles, and can be selected from sensitizing dyes having spectral sensitivility suitable for spectral characteristics of a light source. Regarding the sensitizing dyes and the adding method, please refer to the following; described in paragraphs 0103 to 0109 of JP-A No. 11-65021 and the compound expressed by the general formula (II) of JP-A No. 10-186572, dye expressed by the general formula (I) of paragraph 0106 of JP-A No. 11-119374, U.S. Pat. No. 5,510,236, dye described in Example 5 of U.S. Pat. No. 3,871,887, JP-A No. 2-96131 and dyes described in JP-A No. 59-48753, line 38 on page 19 to line 35 on page 20 of EP-A No. 0803764A1, JP-A Nos. 2001-272747, 2001-290238 and 2002-23306. These sensitizing dyes may be added solely or in combination with 2 or more species. In the invention, the sensitizing dye may be added on a silver halide emulsion preferably during the process after desalting at the time of coating, and more preferably during the process after desalting to before completion of chemical aging.

The sensitizing dye of the invention may be added in a desired quantity according to the sensitivity and level of fogging, preferably in a range of $10^{-6}$ to 1 mol based on 1 mol of silver halide of the image forming layer and more preferably in a range of $10^{-4}$ to $10^{-1}$ mol.

For improving the spectral sensitivity efficiency, strong sensitizers can be used in the invention. The strong sensitizers used in the invention include those described in EP-A No. 587,338, U.S. Pat. Nos. 3,877,943 and 4,873,184, JP-A Nos. 5-341432, 11-109547 and 10-111543.

(8) Chemical Sensitization

The photosensitive silver halide particles of the invention are preferably subjected to chemical sensitization by sulfur sensitization method, selenium sensitization method or tellurium sensitization method. Known compounds, for example, those described in JP-A No. 7-128768 may be used as compounds preferably used in the sulfur sensitization method, the selenium sensitization method and the tellurium sensitization method. The tellurium sensitization is particularly preferable in the invention. More preferable are the compounds described in paragraph 0030 of JP-A No. 11-65021, and those expressed by the general formulae of (II), (III) and (IV) of JP-A No. 5-313284.

In the invention, it is preferable that the photosensitive silver halide particle is chemically sensitized solely by gold sensitization or in combination with the above chalcogen sensitization. Gold sensitizers are preferably those with gold valency of +1 or +3, and ordinary gold compounds are preferable gold sensitizers in the invention. Preferable examples include gold chloride, gold bromide, potassium chloroaurate, potassium broroaurate, auricrichloride, potassium auricthiocyanate, potassium iodine aurate, tetracyanoauric acid, ammonium aurothiocyanate, and pyridyltrichloro gold. Also preferable are gold sensitizers described in U.S. Pat. No. 5,858,637 and Japanese Patent Application No. 2001-79450.

In the invention, chemical sensitization may be performed at any time as long as it is performed after particle formation but before coating, for example, after desalting, (1) before spectral sensitization, (2) at the same time with spectral sensitization, (3) after spectral sensitization, and (4) immediately before coating.

Added quantities of sulfur, selenium and tellurium sensitizers used in the invention vary depending on silver halide particles to be used, chemical aging conditions, etc., and in a range of $10^{-8}$ to $10^{-2}$ mol based on 1 mol of silver halide and preferably in a range of $10^{-7}$ to $10^{-3}$ mol. Added quantities of the gold sensitizer vary depending on various factors, fundamentally in a range of $10^{-7}$ mol to $10^{-3}$ mol for 1 mol of silver halide and preferably in a range of $10^{-6}$ to $10^{-4}$ mol. There are no particular restrictions in performing the chemical sensitization in the invention, with pH of 5 to 8, pAg of 6 to 11 and temperatures of 40 to 95° C.

To the silver halide emulsion used in the invention thiosulfonic acid compound may be added by the method described in EP-A No. 293,917.

In the invention, it is preferable to add a reducing agent to photosensitive silver halide particles. Preferable compounds to be used in a reducing sensitization are, for example, ascorbic acid and thionitrate dioxide, and other preferable examples include stannous chloride, aminoiminomethane sulfinic acid, hydrazine derivative, borane compound, silane compound and polyamine compound. The reducing sensitizer may be added at any time during the sensitive emulsion production process from crystal growth to preparation process immediately before coating. It is also preferable to conduct aging at pH of the emulsion maintained at 7 or higher and pAg maintained at 8.3 or less, thus performing the reducing sensitization. It is also preferable that a single addition part of silver ion is introduced during particle formation to effect the reducing sensitization.

It is preferable that the photosensitive silver halide emulsion of the invention contains a FED sensitizer (frangmentable electron donating sensitizer) as a compound generating 2 electrons from 1 photon. Preferable compounds as the FED sensitizer are those described in U.S. Pat. Nos. 5,747,235, 5,747,236, 6,054,260 and 5,994,051 and Japanese Patent Application No. 2001-86161. The FED sensitizer may be preferably added at any time during the photosensitive emulsion producing process from crystal growth to preparation immediately before coating. The added quantity may vary depending on various conditions, fundamentally in a range of $10^{-7}$ to $10^{-1}$ mol based on 1 mol of silver halide and preferably in a range of $10^{-6}$ mol to $5\times10^{-2}$ mol.

(9) Combination of Plural Silver Halides

In this invention, the photosensitive silver halide emulsion to be contained in the photosensitive material may be used solely or in combination with 2 or more types of emulsions (for example, those with different mean particle size, those with different halogen compositions, those with different crystal habits, those with different conditions of chemical sensitization). Use of 2 or more types of sensitizing silver halides with different sensitivity makes it possible to modulate the gradation. Technologies concerning the above are those described in JP-A Nos. 57-119341, 53-106125, 47-3929, 48-55730, 46-5187, 50-73627 and 57-150841. It is desirable to provide a sensitization difference of 0.2 log E or greater for each emulsion.

(10) Coating Quantity

The photosensitive silver halide is added preferably in a quantity of 0.03 to 0.6 g/m$^2$, more preferably in a quantity of 0.05 to 0.4 g/m$^2$ and most preferably in a quantity of 0.07 to 0.3 g/m$^2$ on the basis of coated silver quantity for 1 m$^2$ of photosensitive material, while it is added preferably at 0.01 to 0.5 mol, more preferably at 0.02 to 0.3 mol and still more preferably at 0.03 to 0.2 mol based on 1 mol of organic silver salt.

(11) Mixing of Photosensitive Silver Halide and Organic Silver Salt

Regarding the mixing methods and conditions, for a method of separately-prepared photosensitive silver halides and organic silver salts mixing silver halide particles with organic silver salt, both of which are completed for preparation using a high speed mixer, ball mill, sand mill, colloid mill, vibrating mill, homogenizer, etc., a method for mixing in any process of preparing the organic silver salt the photosensitive silver halide that is completed for preparation to prepare the organic silver salt, etc., may be employed. There are no particular restrictions regarding the mixing methods and conditions as long as the effect of the invention is sufficiently provided. Mixing of 2 or more types of organic silver salt water dispersions with 2 or more types of photosensitive silver salt water dispersions is a preferable method for adjusting photography characteristics.

(12) Mixing of Silver Halide with Coating Liquid

The silver halide of the invention is added to a coating liquid for image forming layer preferably from 180 minutes before coating to immediately before coating and more preferably from 60 minutes before coating to 10 seconds before coating. There are no particular restrictions in the mixing methods and conditions, as long as the effect of the invention can be attained sufficiently. Specific mixing methods include a method for mixing in a tank in such a way that a desired mean staying time can be obtained that is calculated from adding a feed rate and charge rate to coaters or mixing by using a static mixer described in the 8$^{th}$ chapter of "Liquid Mixing Technology" authored by N. Harnby, M. F. Edwards and A. W. Nienow and translated by Koji Takahashi (published by the Nikkan Kogyo Shimbun, 1989)

1-2-8. Explanation Regarding Binder

It is preferable that the photothermographic material of the invention contains in the image forming layer as a binder the following polymers.

Any polymer can be used as a binder of the image forming layer of the invention. Preferable binders are transparent or semi-transparent and generally colorless, and such polymers include vehicles which form natural resins, polymers and copolymers, synthesized resins, polymers and copolymers, and other films. The vehicles include gelatins, rubbers, poly (vinyl alcohols), hydroxyethyl celluloses, cellulose acetates, cellulose acetate butylates, poly (vinyl pyrrolidones), caseins, starches, poly (acrylic acids), poly (methyl methacrylic acids), poly (vinyl chlorides), poly (methacrylic acids), styrene-anhydrous maleic acid copolymers, styrene-acrylonitrile copolymers, styrene-butadiene copolymers, poly (vinyl acetals) (for example, poly (vinyl formals) and poly (vinyl butyrals)), poly (esters), poly (urethanes), phenoxy resins, poly (vinylidene chlorides), poly (epoxides), poly (carbonates), poly (vinyl acetates), poly (olefins), cellulose esters and poly (amides). The binders may be formed by coating with water, organic solvents or emulsions.

In this invention, binders usable in organic silver salt-containing layer are transited to glass preferably at temperatures exceeding 10° C. and not more than 80° C. (hereinafter, from time to time, called high Tg binder), more preferably at temperatures exceeding 15° C. and not more than 70° C. and still more preferably at temperatures exceeding 25° C. and not more than 65° C.

In this instance, Tg was calculated according to a method similar to that used for a polymer (glass transition temperature −10 to 120° C.) to be added on the back side layer.

The binder may be used in combination with 2 or more species when such necessity arises. The binder may also be used in combination of those having the glass transition temperature exceeding 20° C. with those having the temperature less than 20° C. When 2 or more polymers having different Tg are used in combination, the weight average Tg preferably falls under the above temperature range.

In the invention, it is preferable that coating and drying a coating liquid containing organic silver salt layer is formed of 30% by mass of water.

In this invention, an improved performance can be attained when organic silver salt-containing layer is formed by coating and drying a coating liquid containing 30% by mass, when a binder of the organic silver salt-containing layer can be dissolved or dispersed in an aqueous solvent (water solvent) and particularly when the binder consists of latex polymers whose equilibrium moisture content is 2% by mass or less particularly at 25° C. and 60% RH. Most preferable is a case that ion conductivity is adjusted so as to become 2.5 mS/cm or less. Such adjustment can be carried out by a method wherein polymer is synthesized and then purified by a separation membrane.

The aqueous solvent capable of dissolving or dispersing the above-mentioned polymers is water or a mixture of water with water-soluble organic solvent whose content 70% by mass or less.

Water-soluble organic solvents include alcohols such as methyl alcohol, ethyl alcohol and propyl alcohol, cellosolves such as methyl cellosolves, ethyl cellosolves and butyl cellosolves, ethyl acetate and dimethylformamide.

In the invention, the equilibrium moisture content of the binder polymers at 25° C. and 60% RH is preferably in a range not more than 2% by mass, more preferably in a range of 0.01% by mass or more and not more than 1.5% by mass, and still more preferably in a range of 0.02% by mass or more and not more than 1% by mass.

In this invention, particularly preferable are polymers dispersible in aqueous solvents. Polymers in a dispersion state may include latexes wherein water-insoluble hydrophobic polymer particles are dispersed or those wherein polymer molecules are dispersed in a molecular state or micelle state. More preferable polymers are those with particles dispersed in a latex state. The mean size of dispersed particles is in a range of 1 to 50000 nm, preferably in a range of 5 to 1000 nm, more preferably in a range of 10 to 500 nm and still more preferably in a range of 50 to 200 nm. There are no particular restrictions on the particle size distribution of dispersed particles. More particularly, particle size distribution of said polymers may be used that is wider or of monodispersion. Mixing of 2 or more polymers with particle size distribution that is of monodispersion is also a preferable in controlling physical properties of a coating liquid.

The aspect of preferable polymers soluble in aqueous solvents and examples of preferable polymer latexes are similar to those given in the polymer to be added on said non-photosensitive back side layer.

To the image forming layer used in photosensitive materials of the invention, hydrophilic polymers such as gelatin, polyvinyl alcohol, methyl cellulose, hydroxypropyl cellulose and carboxymethyl cellulose may be added, whenever necessary. These hydrophilic polymers are added preferably in 30% by mass or less based on a total quantity of binder of the image forming layer, and more preferably in 20% by mass or less.

In the invention, polymer latexes are used preferably to form the image forming layer. Regarding a quantity of binder of the image forming layer, the weight ratio of total binder to organic silver salt is preferably in a range of 1/10 to 10/1, more preferably in a range of 1/3 to 5/1 and still more preferably in a range of 1/1 to 3/1.

The image-forming layer is usually a photosensitive layer (emulsion layer) that contains photosensitive silver halide which is(photosensitive silver salt as well. In this instance, the weight ratio of total quantity of binder to silver halide is preferably in a range of 400 to 5 and more preferably in a range of 200 to 10.

A total quantity of the binder of the image forming layer of the invention is preferably in a range of 0.2 to 30 g/m$^2$, more preferably in a range of 1 to 15 g/m$^2$ and still more preferably in a range of 2 to 10 g/m$^2$. Crosslinking agents for crosslinking and surfactants for improving coating improvement may be added to the image-forming layer of the invention.

1-2-9. Preferable Solvents for Coating Liquids

In the invention, aqueous solvents that contain water in 30% by mass greater are preferable solvents of coating liquids for the image-forming layer of photosensitive material (for simplification, solvents and dispersing medium are jointly called solvents). Any water-soluble organic solvents such as methyl alcohol, ethyl alcohol, isopropyl alcohol, methylcellosolve, ethylcellosolve, dimethylformamide and ethyl acetate may be used, other than water. The solvents for coating liquids preferably contain water exceeding 50% by mass and more preferably water content of 70% by mass or more. Preferable solvent compositions, other than water, include water/methyl alcohol=90/10, water/methyl alcohol=70/30, water/methyl alcohol/dimethylformamide=80/15/5, water/methyl alcohol/ethylcellosolve=85/10/5 and water/methyl alcohol/isopropyl alcohol=80/10/5 (the values indicate percentage by mass).

1-2-10. Explanation Regarding Fog-Preventive Agent (1) Anti-Fog Agent

The anti-fog agents, stabilizer and precursors of a stabilizer that can be used in the invention include compounds described in paragraph 0070 of JP-A No. 10-62899, in line 57 on page 20 to line 7 on page 21 of EP-A0803764A1, JP-A No. 9-281637, compounds described in JP-A No. 9-329864, U.S. Pat. Nos. 6,083,681, 6,083,681 and compounds described in EP-A No. 1048975. In the invention, preferable anti-fog agents are organic halides. More particularly, they include those disclosed in paragraphs 0111 to 0112 of JP-A No. 11-65021. Particularly preferable compounds are organic halide expressed by the formula (P) of JP-A No. 2000-284399, organic polyhalide expressed by the formula (II) of JP-A No. 10339934, and organic polyhalides described in JP-A Nos. 2001-31644 and 2001-33911.

(2) Explanation Regarding Polyhalide

The following is a specific explanation regarding polyhalide preferably used in the invention. Preferable polyhalide in the invention are those expressed by the general formula (H) below:

$$Q\text{-}(Y)n\text{-}C(Z_1)(Z_2)X \qquad \text{General formula(H)}$$

In the general formula (H), Q represents an alkyl group, an aryl group or a heterocyclic group, Y represents a divalent communication group, n represents 0 or 1, $Z_1$ and $Z_2$ represent a halogen atom, and X represents a hydrogen atom or an electron-attracting group.

In the general formula (H), Q is preferably an aryl group or a heterocyclic group. In the general formula (H) when Q is a heterocyclic group, preferable is a nitrogen-containing hetero cycle ring that contains 1 or 2 nitrogen atoms, and more preferable are 2-pyridyl group or 2-quinolyl group.

In the general formula (H), when Q is an aryl group, Q preferably represents a phenyl group substituted with an electron-attracting group that gives positive values of the Hammett substituent constant σp. As to the Hammett substituent constant, Journal of Medicinal Chemistry, 1973, Vol. 16, No. 11, 1207-1216, etc., can be refered to. Examples of these electron-attracting groups include halogen atom (fluorine atom (σp value: 0.06), chlorine atom (σp value: 0.23), bromine atom (σp value: 0.23), iodine atom (σp value: 0.18), trihalomethyl group (tribromomethyl (σp value: 0.29), trichloromethyl (σp value: 0.33), trifluoromethyl (σp value: 0.54)), cyano group (σp value: 0.66), nitro group (σp value: 0.78), aliphatic-aryl or heterocyliC sulfonyl group (for example, methane sulfonyl (σp value: 0.72), aliphatic-aryl or heterocyliC acyl group (for example, acetyl(σp value: 0.50)), benzoyl (σp value: 0.43)), alkyl group (for example, C═CH (σp value: 0.23), aliphatic aryl or heterocycle oxlycarbonyl group (for example, methoxycarbonyl group (σp value: 0.45), phenoxycarbamoyl (σp value: 0.44), carbamoyl group (σp value: 0.36), sulfamoyl group (σp value: 0.57), sulfoxide group, heterocyclic group and phosphoryl group. σp values are preferably in a range of 0.2 to 2.0 and more preferably in a range of 0.4 to 1.0. Electron-attracting groups include particularly preferably carbamoyl group, alkoxycarbamoyl group, alkylsulfonyl group and alkylphosphoryl group, and most preferably carbamoyl group.

X is preferably an electron-attracting group, more preferably, halogen atom, aliphatic aryl or heteroycle sulphonyl group, aliphatic acyl group or heterocycle acyl group, aliphatic aryl or heterocycle oxycarbonyl group, carbamoyl group or sulfamoyl group, and particularly preferably, halogen atom. Of halogen atoms, preferable are chlorine atom, bromine atom and iodine atom, more preferable are chlorine atom and bromine atom, and particularly preferable is bromine atom.

Y preferably represents —C(═O)—, —SO— or —$SO_2$—, more preferably —C(═O)— or —$SO_2$—, and particularly preferably —$SO_2$—. n represents zero or 1, and preferably 1.

Examples of the compounds expressed by the general formula (H) are shown below.
(H-1)
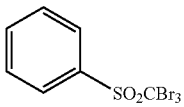
(H-2)
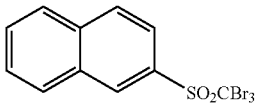
(H-3)
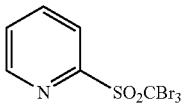
(H-4)
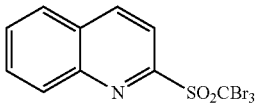
(H-5)
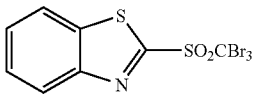
(H-6)
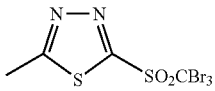
(H-7)
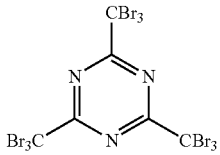
(H-8)
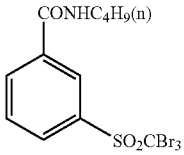
(H-9)
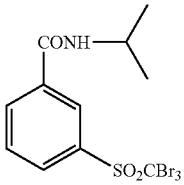
-continued
(H-10)
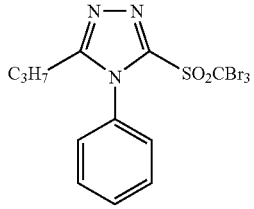
(H-11)
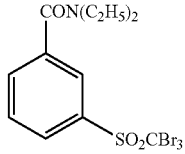
(H-12)
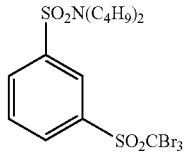
(H-13)
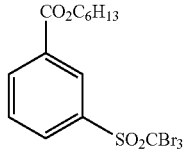
(H-14)
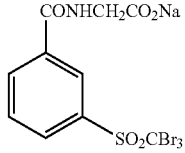
(H-15)
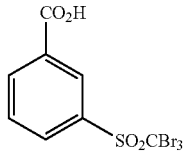
(H-16)
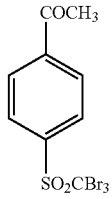
(H-17)
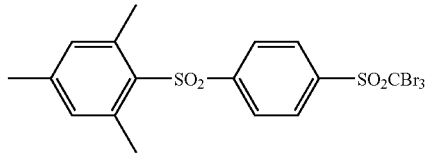
(H-18)
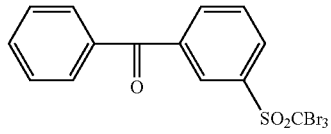

-continued (H-19)

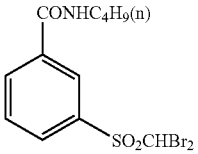

(H-20)

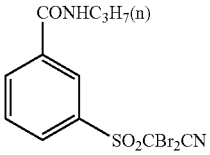

(H-21)

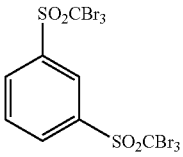

(H-22)

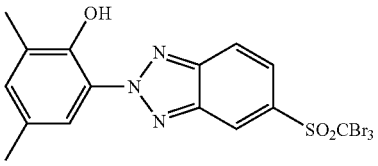

(H-23)

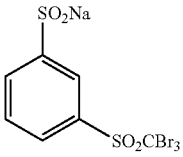

(H-24)

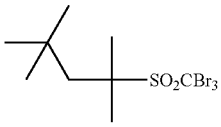

In the invention, the compound expressed by the general formula (H) is preferably used in a range of $1\times10^{-4}$ to 1 mol based on 1 mol of a non-photosensitive silver salt of the image forming layer, more preferably in a range of $1\times10^{-3}$ to 0.5 mol, and still more preferably in a range of $1\times10^{-2}$ to 0.2 mol.

In the invention, a method for including the anti-fog agent into the photosensitive material is the same as that previously described for the reducing agent. It is also preferable that organic polyhalides are added as a solid micro-particle dispersion.

(3) Other Anti-Fog Agents

Other anti-fog agents include silver (II) salt and benzoic acids respectively described in paragraphs [0113] and [0114] of JP-A No. 11-65021, salicylic acid derivatives of JP-A No. 2000-206642, formalin scavenger compounds expressed by the formula (S) of JP-A No. 2000-221634, triazine compounds described in claim 9 of JP-A No. 11-352624 and 4-hydroxy-6-methyl-1,3,3a, 7-tetrazainden expressed by the general formula (III) of JP-A No. 6-11791.

The photothermographic material of the invention may contain an azolium salt for preventing fogging. Azolium salts include the compound expressed by the general formula (XI) of JP-A No. 59-193447, the compound described in JP-B No. 55-12581 and the compound described in JP-A No. 60-153039. Azolium salt may be added to any site of the photosensitive material. However, it is preferably added to a layer having the image forming layer and more preferably added to an organic silver salt-containing layer. Azolium salt may be added anytime while in a process of preparing a coating liquid. When added to the organic silver salt-containing layer, it may be added at any time while in a process for preparing an organic silver salt or for preparing the coating liquid, preferably during the period from the time of completing preparation of the organic silver salt to the time immediately before coating. Azolium salt may be added in any form such as powder, solution or micro-particle dispersion. It may also be added as a mixed solution with other additives such as a sensitizing dye, reducing agent and coloring agent. In the invention, azolium salt may be added at any quantity. It is, however, added preferably in a range from $1\times10^{-6}$ mol to 2 mol based on 1 mol of silver, and more preferably in a range from $1\times10^{-3}$ mol to 0.5 mol.

1-2-11. Other Additives (1) Mercapto, Disulfide and Thiones

In the invention, mercapto compounds, disulfide compounds or thione compounds may be contained for the purpose of suppressing or accelerating so as to control the development processing, improving spectral sensitization rate or improving stability before and after the development processing. These compounds are described in paragraphs 0067 to 0069 of JP-A No. 10-62899 or expressed by the formula of (I) of JP-A No. 10-186572. They are also exemplified in paragraphs 0033 to 0052 of the preceding JP-A No. 10-186572 and in line 36 to 56 on page 20 of EP-A No. 0803764A1. Particularly preferable compounds are mercapto-substituted heterocycle aromatic compounds described in JP-A No. 9-297367, JP-A Nos. 9-304875 and 2001-100358 and in Japanese Patent Application Nos. 2001-104213 and 2001-104214.

(2) Color Tone Modifier

Addition of color tone modifier is preferred in the photothermographic material of the invention. Color tone modifiers are described in paragraphs [0054] to [0055] of JP-A No. 10-62899, in line 23 to 48 on page 21 of EP-A No. 0803764A1 and JP-A Nos. 2000-356317 and 2000-187298. Particularly preferable color tone modifiers include phthalazinones (phthalazinone, phthalazinone derivative or metallic salt; for example, 4-(1-naphthyl)-phthalazinone, 6-chlorophthalazinone, 5,7-dimethoxyphthalazinone and 2,3-dihydro-1,4-phthalazine dione); a combination of phthalazinones and phthalic acids (for example, phthalic acid, 4-methylphthalic acid, 4-nitrophthalic acid, diammonium phthalate, sodium phthalate, potassium phthalate and tetrachlorophthalic anhydrate); phthalazines (phthalazine, phthalazine derivative or metal salt; for example, 4-(1-naphthyl)-phthalazine, 6-isopropylphthalazine, 6-t-butylphthalizine, 6-chlorophthalazine, 5,7-dimethoxyphthalazine, and 2,3-dihydrophthalazine), and combination of phthalazines with phthalic acid. Particularly preferable is a combination of 6-isopropylphthalazine with phthalic acid or 4-methyl phthaic acid.

(3) Plasticizers and Lubricants

Plasticizers and lubricants usable in the image-forming layer of the invention are described in paragraph 0117 of JP-A No. 11-65021. Super high-contrast agents for forming the super high-contrast image as well as the method for addition and added quantity are described in paragraph 0118 of the preceding JP-A No. 11-65021, paragraph 0136 to 0193 of JP-A No. 11-223898, the compounds are those expressed by the formulae (H), (1) to (3), (A) and (B) of JP-A No. 2000-

284399 and by general formula (III) to (V) (specific compounds: Kagaku 21 to Kagaku 24) of Japanese Patent Application No. 11-91652, and the super high-contrast agents are those described in paragraph 0102 of JP-A No. 11-65021 and in paragraph 0194 to 0195 of JP-A No. 11-223898

(4) Dyes and Pigments

A variety of dyes and pigments (for example, C.I. Pigment Blue 60, C.I. Pigment Blue 64, C.I. Pigment Blue 15:6) can be used in view of improving color tone, preventing interference fringe on laser light exposure or preventing irradiation. These dyes and pigments are described in detail in WO98/36322, JP-A Nos. 10-268465 and 11-398098.

(5) Super High-Contrast Agents

It is preferable to add super high-contrast agents to the image-forming layer for producing a super high-contrast image suitable for print plate-making. Methods for adding super-high contrast agents to the image forming layer and the additive quantities are described in paragraph No. 0118, paragraphs 0136 to 0193 of JP-A No. 11-223898, compounds expressed by the formulae (H), (1) to (3), formulae (A) and (B) of JP-A No. 11-87297 and compounds expressed by the formulae (III) to (V) of the Japanese Patent Application No. 11-91652 (specific compounds; Kagaku 21 to Kagaku 24). High contrast accelerators are described in paragraph 0102 of JP-A No. 11-65021 and paragraphs 0194 to 0195 of JP-A No. 11-223898.

When formic acid or formate is used as a strong hazing substance, it is preferable that said substance is contained on the side having the image forming layer that contains a photosensitive silver halide in a quantity of 5 milli mol or less based on 1 mol of silver and more preferably in a quantity of 1 milli mol or less.

When a super high-contrast agent is used in the photothermographic material of the invention, it is preferable to use the agent together with an acid or its salt produced by hydration of diphosphorous pentaoxide. The acid or salt produced by hydration of diphosphorous pentaoxide include metaphosphoric acid (metaphosphate), pyrophosphoric acid (pyrophosphate), orthophosphoric acid (orthophosphate), triphosphoric acid (triphosphate), tetraphosphoric acid (tetraphosphate), hexametaphosphoric acid (hexametaphosphate). Particularly preferable acids or salts produced by hydration of diphosphorous pentaoxide include orthophosphoric acid (orthophosphate) and hexametaphosphoric acid (hexametaphosphate). Exemplary examples are sodium orthophosphate, sodium dihydrogen orthophosphate, sodium hexametaphosphate and ammonium hexametaphosphate.

The acid or salt produced by hydration of diphosphorous pentaoxide may be used in any desired quantity (coating quantity for 1 $m^2$ of the photosensitive material), depending on factors such as the sensitivity or fogging level, preferably in 0.1 to 500 $mg/m^2$ and more preferably in 0.5 to 100 $mg/m^2$.

The reducing agents, hydrogen bond compounds, development accelerators and polyhalide of the invention are added preferably in a state of solid dispersion, and preferable methods for producing these solid dispersions are described in JP-A No. 2002-55405.

1-3. The Surface-Protective Layer

The phototherrnographic layer of the invention may be provided with a surface-protective layer for the purpose of preventing adhesion of the image-forming layer. The surface-protective layer may be produced in a single layer or plural layers. The surface-protective layer is described in paragraphs [0119] to [0120] of JP-A No. 11-65021, and JP-A No. 2000-171936.

Gelatin is a preferable binder for the surface-protective layer of the invention. It is also preferable to use polyvinyl alcohol (PVA), etc., in combination with gelatin. Gelatins used in the invention include an inert gelatin (for example, Nitta Gelatin 750) and a phthalated gelatin (for example, Nitta Gelatin 801). Preferable PVAs are described in paragraphs [0009] to [0020] of JP-A No.2000-171936, and other preferable PVAs include a completely saponificated polyvinyl alcohol, PVA-105, a partially saponificated polyvinyl alcohol, PVA-205 or PVA-335 and a modified polyvinyl alcohol, MP-203 (all are brand names of Kuraray Co., Ltd.). A polyvinyl alcohol is coated preferably in a quantity of 0.3 to 4.0 $g/m^2$ in relation to the surface-protective layer (per layer) (for each 1 $m^2$ of the support) and more preferably in a quantity of 0.3 to 2.0 $g/m^2$.

The coating quantity (per $m^2$ of the support) of all binders (including aqueous polymers and latex polymers) for the surface protective layer (per layer) is preferably 0.3 to 5.0 $g/m^2$ and more preferably 0.3 to 2.0 $g/m^2$.

1-4. Other Materials 1-4-1. Support

Preferably used transparent supports include polyesters especially polyethylene terephtalate that are treated at temperatures of 130 to 185° C. for alleviating an internal strain remaining in the film on a two-axis drawing and removing shrinkage due to heat generated during thermal development.

When used in the photothermographic material for medical use, the transparent support may be colored with a blue dye (for example, the dye-1 described in the example of JP-A No. 8-240877) or may not be colored. The support is prepared preferably in accordance with the prime coating technology for water-soluble polyester described in JP-A No. 11-84574, for styrene butadienecopolymer described in JP-A No. 10-186565, or for vinylidene chloride copolymer described in JP-A No. 2000-39684 and paragraphs 0063 to 0080 of the Japanese Patent Application No. 11-106881.

1-4-2. Packaging Material

In order to prevent variation in picture performance during raw stock as well as improve curl and winding property, it is desired to wrap the photosensitive material of the invention with a packaging material having a low oxygen permeability and/or moisture permeability. The oxygen permeability is preferably 50 $ml/atm \cdot m^2 \cdot day$ or less at 25° C. and more preferably 10 $ml/atm \cdot m^2 \cdot day$ or less and still more preferably 1.0 m $1/atm \cdot m^2 \cdot day$ or less. The moisture permeability is preferably 10 $g/atm \cdot m^2 \cdot day$ or less, more preferably 5 $g/atm \cdot m^2 \cdot day$ or less and still more preferably 1 $g/atm \cdot m^2 \cdot day$ or less.

The example of said packaging material with less oxygen permeability and/or moisture permeability are those described in JP-A No. 8-254793 and JP-A No. 2000-206653.

1-5. Other Applicable Technology

The technology applicable to the photothermographic material of the invention are described in EP803764A1, EP883022A1, WO98/36322, JP-A No. 56-62648 and 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A No. 2000-187298, 2000-10229, 2000-47345, 2000-206642, 2000-98530, 2000-98531, 2000-112059, 2000-112060, 2000-112104, 2000-112064, and 2000-171936.

In the multi-color photothermographic material, individual emulsion layers are maintained separately from each other by using a functional or non-functional barrier layer in an area between individual image forming layers, as described in U.S. Pat. No. 4,460,681.

A multi-color photothermographic material may be composed of a combination of these 2 layers for each color. Further, as described in U.S. Pat. No. 4,708,928, the material may be composed of one layer that contains all the parts.

1-6. Image Forming Method (1) Exposure

Exposure is carried out by using red to infrared light-emitting He—Ne laser, red semi-conductor laser, or blue to green light-emitting Ar+, He—Ne, He—Cd laser or blue semi-conductor laser. The red to infrared light-emitting semi-conductor laser is preferable, and the peak wavelength of the laser beam is 600 mn to 900 nm and preferably 620 nm to 850 nm. In recent years, a module integrating SHG (Second Harmonic Generator) element and semi-conductor laser and blue semi-conductor laser have been developed, grabbing attention as a laser output device in a short wavelength range. The blue semi-conductor laser is expected to be much demanded due to the ability to record the high-quality image, increased record density and longer-operating life and stable output. The peak wavelength of the blue semi-conductor laser beam is preferably 300 nm to 500 nm and particularly preferably 400 nm to 500 nm.

Preferable laser beam is of a vertical multi-mode oscillation by high frequency superimposition.

(2) Thermal Development

The photothermographic material of the invention may be developed by any method, and usually developed by increasing the temperature of the material, on exposure to light in an image-oriented fashion. Developing temperatures are preferably 80 to 250° C., more preferably 100 to 140° C., and still more preferably 110 to 130° C. Developing time is preferably 1 to 60 seconds, more preferably 3 to 30 seconds, still more preferably 5 to 25 seconds and particularly preferably 7 to 15 seconds.

Thermal development can be effected by using either a drum heater or a plate-type heater, and more preferable is a plate-type heater. Thermal development by using a plate-type heater is described in JP-A No. 11-133572. The equipment is a thermal development device capable of providing visible image by allowing the latent image-producing photothermographic material to contact at the thermal development site by heating means, comprising a plate-type heater and plural pressure rollers oppositely set along one side of said plate-type heater, so that thermal development can be effected by allowing said photothermographic material to pass between said pressure rollers and said plate-type heater. It is preferable that the plate-type heater is divided into 2 to 6 stages, with temperatures maintained less by 1 to 10° C. at the ends. For example, 4 sets of plate-type heaters are used that can be controlled for temperatures independently, each of which is controlled at 112° C., 119° C., 121° C. and 120° C. Said method is described in JP-A No. 54-30032, and able to remove moisture and organic solvents contained in the photothermographic material from the system and heat the photothermographic material rapidly, thus making it possible to prevent change in configuration of the support for the photothermographic material.

(3) System

A laser imager for medical use having the exposed area and thermal development area includes Fuji Medical Dry Laser Imager-FM-DPL. Said system is described on pages 39 to 55 In Fuji Medical Review No. 8 and can be used as a laser imager for which the photothermographic material of the invention is used. The photothermographic material of the invention can be also used as a photothermographic material for a laser imager in the AD network proposed by Fuji Film Medical System as a network system adapted to DICOM Standards.

1-7. Applications of the Invention

The photothermographic material of the invention will produce a black and white image based on silver color, and preferably finding applications as photothermographic materials for medical diagnosis use, industrial photography, printing use and COM use.

The photothermographic material as described in the second aspect of the invention is preferably a so-called single-sided photosensitive material having an image forming layer that contains on one side of the support at least one layer of silver halide emulsion and the back layer on the other side of the support. In the invention, one side of the support having the image-forming layer is designated as an image-forming side, and the side having the back layer is designated as a "non-photosensitive back side layer."

An image-forming side ordinarily contains an image forming layer and a non-photosensitive layer. The non-photosensitive layer is classified into as follows on the basis of the placement: (1) protective layer that is prepared on an upper layer than the image forming layer (distal side from the support), (2) intermediate layer prepared between plural image forming layers or between an image forming layer and protective layer, and (3) prime coat or under coat layer prepared between an image forming layer and the support.

In most cases, a filter layer is prepared as a layer of (1) or (2), and an anti-halation layer prepared on a photosensitive material is provided on the photosensitive material as a layer of (3). For preventing irradiation, an image-forming layer is colored in some cases.

The non-photosensitive back side is provided with a back protective layer, whenever necessary, in addition to a back layer. In some cases, the back layer or the back protective layer serves as an anti-halation layer.

The following is a detailed explanation of the second aspect of the invention.

2-1. Non-Photosensitive Back Layer 2-1-1. Binder (1) Polymer Latex (i) Species

The photothermographic material of the invention, in which the back layer contains at least one species of polymer latexes having a glass transition temperature (hereinafter abbreviated as Tg from time to time) of −10° C. to 120° C.

Said polymer latex may be any polymer as long as the glass transition temperature is −10° C. or higher and 120° C. or less, which is transparent or semi-transparent, and preferably colorless.

The mean size of dispersed particles is 1 to 50000 nm, preferably 5 to 1000 nm, more preferably 10 to 500 nm and still more preferably 50 to 200 nm. There are no particular restrictions on the particle size distribution of dispersed particles. More particularly, particle size distribution of said polymers may be used that is wider or of monodispersion.

Mixing of 2 or more species with particle size distribution of monodispersion is also a preferable in controlling physical properties of a coating liquid.

In the invention, preferable examples of aqueous solvent-dispersible polymers include hydrophobic polymers such as acrylic polymer, poly (esters), rubbers (for example, SBR resin), poly (urethanes), poly (vinyl chlorides), poly (vinyl acetates), poly (vinylidene chlorides) and poly (olefins). Further, the following polymers can be used in the invention; straight chain polymers, branched chain polymers, or cross-linked polymers, so-called homopolymers made through polymerization of monomers and copolymers made through polymerization of 2 or more types of monomers. In the case of copolymers, either random copolymer or block copolymer may be employed. These polymers are preferably 5,000 to 1,000,000 in the number average molecular weight and more preferably 10,000 to 200,000. Particularly suitable polymers are cross-linked polymer latexes.

(ii) Example of Preferable Polymer Latexes

Examples of preferable polymer latexes are the same as examples of preferable polymer latexes given in the above 1-1-4.2) (iii).

(iii) Content

The polymer whose glass transition temperature is −10° C. or higher and 120° C. or less that is contained on the back side of the invention is preferably in a range from 10% by mass to 50% by mass based on gelatin on the non-photosensitive back side and more preferably in a range from 20% by mass to 40% by mass.

In this instance, when the non-photosensitive back side possesses 2 or more layers, the polymer content is calculated by referring to a total weight of said polymer contained in all the layers of said polymer and a total weight of gelatin contained in all the layers.

When the non-photosensitive back side possesses two layers, it is preferable that a content ratio of the polymer to gelatin is greater in a back layer closer to the support than in a back layer further from the support.

(iv) Coating Quantity

In the invention, it is preferable that said polymer latex on the non-photosensitive back side is preferably 0.1 to 1.5 g/m$^2$ based on the total coating quantity and more preferably 0.2 to 1.2 g/m$^2$.

(v) Glass Transition Temperature

The glass transition temperature of the polymer latex is the same as that described in the above 1-1-4.(2) (vi).

(vi) Moisture Content

The moisture content is the same as the moisture content of the polymer contained in the back side described in the above 1-1-4.(2) (vii).

(vii) Addition

The polymer latexes whose glass transition temperature is −10° C. or higher and 120° C. or less may be added to the layer compositions of the image forming side described above in Item: 1-2-1, namely, (1) protective layer, (2) intermediate layer and (3) prime coat or undercoat layer, in addition to the back layer.

(2) Gelatin (i) Species

Species of preferable gelatins of the invention are the same as those described in the above 1-1-4.(1)(i).

(ii) Preferable Species

Species of preferable gelatins of the invention are the same as those described in the above 1-1-4.(1)(ii).

(iii) Coating Quantity

The photothermographic material of the invention is characterized in that a total gelatin coating weight of the non-photosensitive back side is 0.5 times to 1.5 times a total gelatin coating quantity of the image forming layer. Further, the value is preferably 0.7 time to 1.3 times.

When the non-photosensitive back side possesses 2 or more layers, the volume for a unit area of total gelatin contained in all the layers is defined as "total gelatin coating quantity of non-photosensitive back side". Similarly, when the image-forming layer is composed of 2 or more layers, the volume for a unit area of total gelatin contained in all the layers is defined as "total gelatin coating quantity of image forming side".

A total gelatin coating quantity on the non-photosensitive back side is preferably 1.0 g/m$^2$ or higher and 4.0 g/m$^2$ or less, and more preferably 1.5 g/m$^2$ or higher and 3.0 g/m$^2$ or less.

Further, a total gelatin coating quantity of the non-photosensitive back layer is preferably 0.3 g/m$^2$ or higher and 0.8 g/m$^2$ or less, and more preferably 0.4 g/m$^2$ or higher and 0.6 g/m$^2$ or less.

2-1-2. Dye Discolorable by Thermal Development Processing

The following is an explanation regarding the dye that is discolorable by thermal development processing (hereinafter referred to as thermally discolorable dye from time to time).

The thermally discolorable dye of the invention is designated as a dye for attaining optical functions such as filtration, irradiation prevention or halation prevention, preferably available as a solid micro-particle dye. Further, the thermally discolorable dye of the invention may be used in combination with a dye not discolorable by thermal development processing.

(1) Configuration

Configuration of the dye discolorable by thermal development processing is the same as that described in the above 1-1-5 (1).

(2) Added Quantity

Added quantity of the dye discolorable by thermal development processing is the same as that described in the above 1-1-5 (2).

(3) Preferable Thermally Discolorable dye

A detailed explanation regarding the preferable thermally discolorable dye is the same as that given in the above 1-1-5 (3).

In the invention, it is preferable that a thermally discolorable dye is added to a non-photosensitive back side. It may be added to the prime coat or undercoat layer provided between the image forming layer and the support.

Said thermally discolorable dye may be added solely or in combination with 2 or more species. When 2 or more layers that contain the thermally discolorable dye are formed, a different species of the thermally discolorable dye may be used individually in these layers, or the thermally discolorable dyes with different species may be added.

The thermally discolorable dye is coated preferably in a range of 0.001 to 1.0 g/m$^2$ and more preferably in a range of 0.005 to 0.1 g/m$^2$.

2-1-3. Base Precursor

It is preferable that the non-photosensitive back side of the invention contains a base precursor.

The base precursors used in the invention are the same as those described in the above 1-1-6.

2-1-4. Melting Point Depressing Agent

The melting point depressing agents used in the invention are the same as those described in the above 1-1-7.

2-1-5. Other Compositions (1) Coloring Agent

In the invention, a coloring agent having the absorption maximum at the wavelength of 300 to 450 nm can be added for the purpose of improving the silver tone and over-time change in the image. Said coloring agent is described in JP-A Nos. 62-210458, 63-104046, 63-103235, 63-208846, 63-306436, 63-314535, 01-61745 and 2001-100363.

Said coloring agents are ordinarily added in a range of 0.1 $mg/m^2$ to 1 $g/m^2$, and a preferable layer to be added is a back layer to be prepared on the opposite side of the image forming layer.

It is also preferable to use a dye having the absorption peak at the wavelength of 580 to 680 nm for controlling the base color tone. Dyes preferable for this purpose are oil-soluble azomethine dyes with a smaller absorption intensity on the short wavelength side described in JP-A Nos. 4-359967 and 4-359968 and water-soluble phthalocyanine dyes described in Japanese Patent Application No. 2002-96797. Said dyes may be added to either layer, and preferably to non-photosensitive layer of the emulsion side or on the back side.

(2) Matting Agent

The matting agents are the same as those described in the above 1-1-9 (2).

In the invention, the matting degree of the back layer is preferably in a range from 10 to 1200 seconds in terms of Bekk smoothness, more preferably in a range from 20 to 800 seconds, and still more preferably in a range from 40 to 500 seconds.

(3) Hardeners

The hardeners are the same as those described in the above 1-1-9. (3).

(4) Surfactant

The surfactants applicable in the invention are described in paragraph 0132, the solvents are described in paragraph 0133, the support is described in paragraph 0134, antistatic agents and conductive layer are described in paragraph 0135, methods for obtaining color image are described in paragraph 0136 of JP-A No. 11-65021. Smoothing agents are described in paragraphs 0061 to 0064 of JP-A No. 11-84573 or in paragraphs 0049 to 0062 of Japanese Patent Application No. 11-106881.

In this invention, use of fluorosurfactants is preferable. The examples of fluorosurfactants include the compounds described in JP-A Nos. 10-197985, 2000-19680, and 2000-214554. Also preferably used are high-polymer fluorosurfactants described in JP-A No. 9-281636. Use of fluorosurfactants described in JP-A No. 2002-82411, Japanese Patent Application Nos. 2001-242357 and 2001-264110 are preferable in the photothermographic material of the invention. Fluorosurfactants described in Japanese Patent Application Nos. 2001-242357 and 2001-264110 are particularly preferable in terms of ability to modulate electrostatic charge, stability of coated surface state and smoothness when an aqueous system coating liquid is used. Fluorosurfactants described in Japanese Patent Application No. 2001-264110 are most preferably used because they are high in ability to modulate electrostatic charge and can attain the effect in a smaller quantity.

In the invention, a fluorosurfactant may be used in an emulsion side or back side, and preferably used in both of them. It is particularly preferable that the fluorosurfactant is used in combination with the conductive layer that contains said metal oxides. In this instance, a sufficient performance can be obtained even when the fluorosurfactant is used in a small quantity or no fluorosurfactant is used in the layer having the conductive layer.

The fluorosurfactant is used in the emulsion side and back side preferably in a range of 0.1 $mg/m^2$ to 100 $mg/m^2$ and more preferably in a range of 0.3 $mg/m^2$ to 30 $mg/m^2$, and still more preferably in a range of 1 $mg/m^2$ to 10 $mg/m^2$. The fluorosurfactant described in Japanese Patent Application No. 2001-264110 is particularly effective, whose quantity is preferably in a range of 0.01 to 10 $mg/m^2$ and more preferably in a range of 0.1 to 5 $mg/m^2$.

(5) Antistatic Agent

The antistatic agents applicable in the invention are the same as those described in the above 1-1-9.(4).

(6) Other Additives

Anti-oxidants, stabilizing agents, plasticizers, ultraviolet ray-absorbing agents or coating adjuvants may be also added to the photothermographic material. These agents are added to either the image-forming layer or to the non-photosensitive layer. The details of said addition can be referred in the descriptions given in WO 98/36322, EP803764A1, JP-A Nos. 10-186567 and 10-186568.

2-2. Image Forming Layer

The image forming layer is the same as that described in the above 1-2-2.

The following is an aspect of the preferable image-forming layer of the invention.

2-2-1. Explanation Regarding Organic Silver Salt

The explanation regarding organic silver salt is the same as that described in the above 1-2-3.(1) to (4).

2-2-2. Explanation Regarding Reducing Agents

The explanation regarding the reducing agents are the same as that described in the above 1-2-4.(1) to (4).

2-2-3. Explanation Regarding Development Accelerator

Development accelerators that are preferably used in the photothermographic material of the invention include sulfonamide phenol compounds described in JP-A No. 2000-267222 and expressed by the general formula (A) of JP-A No. 2000-330234, hindered phenol compounds expressed by the general formula (II) of JP-A No. 2001-92075, hydrazine compounds expressed in JP-A No. 10-62895 and by the general formula (I) of JP-A No. 11-15116 and general formula (1) of Japanese Patent Application No. 2001-074278, and phenol and naphthol compounds expressed by the general formula (2) in Japanese Patent Application No. 2000-76240. These development accelerators are preferably used in a range of 0.1 to 20 mol % in relation to the reducing agent, more preferably in a range of 0.5 to 10 mol %, and still more preferably in a range of 1 to 5 mol %. The development accelerators can be added to the photosensitive material in a way the same as that for adding the reducing agent to the photosensitive material. It is preferable that the development accelerators are added as a solid dispersion or an emulsified dispersion in particular. When added as an emulsified dispersion, they are added preferably as an emulsified dispersion prepared by using a high-boiling point solvent in a solid form at ordinary temperatures and a low-boiling point adjuvant solvent, or added as so called oil-less emulsified dispersion in which no high-boiling point solvent is used.

In the invention, of the above development accelerators, more preferable are hydrazine compounds expressed by the general formula (I) in Japanese Patent Application No. 2001-074278 and phenol and naphthol compounds expressed by the general formula (2) in Japanese Patent Application No. 2000-76240.

Examples of preferable development accelerators of the invention include (A-1) to (A-11) described in the above 1-2-5. Explanation regarding development accelerator, which are not construed to limit the scope of the invention.

2-2-4. Explanation Regarding Hydrogen Bond Compounds

Explanation regarding hydrogen bond compounds is the same as that described in the above 1-2-6.

2-2-5. Explanation Regarding Silver Halide

Explanation regarding silver halide is the same as that described in the above 1-2-7.(1) to (12).

2-2-6. Explanation Regarding Binders

The explanation regarding binders is the same as that made regarding the above 1-2-8.

2-2-7. Preferable Solvents for Coating Liquids

Preferable solvents for coating liquids are the same as those described in the above 1-2-9.

2-2-8. Explanation Regarding Fog-Preventive Agent

The fog preventive agents are the same as those described in the above 1-2-10.(1) to (3).

2-2-9. Other Additives

Other additives are the same as those described in the above 1-2-11.(1) to (5).

2-3. Non-Photosensitive Layer

The photothermographic layer of the invention may be provided with a surface-protective layer or an intermediate layer for the purpose of preventing adhesion of the image-forming layer. The surface-protective layer and the intermediate layer may be produced in a single layer or plural layers. The surface-protective layer is described in paragraphs [0119] to [0120] of JP-A No. 11-65021, and JP-A No. 2000-171936.

Gelatin is used as a binder for the surface-protective layer of the invention. It is also preferable to use polyvinyl alcohol (PVA), etc., in combination with gelatin. Gelatins used in the invention include an inert gelatin (for example, Nitta Gelatin 750) and a phthalated gelatin (for example, Nitta Gelatin 801). Preferable PVAs are described in paragraphs 0009 to 0020 of JP-A No. 2000-171936, and other preferable PVAs include a completely saponificated polyvinyl alcohol, PVA-105, a partially saponificated polyvinyl alcohol, PVA-205 or PVA-335 and a modified polyvinyl alcohol, MP-203 (all are brand names of Kuraray Co., Ltd.). Gelatin is coated preferably in a quantity of 1.0 to 4.0 g/m$^2$ in relation to the surface-protective layer or intermediate layer (per layer) (for each 1 m$^2$ of the support) and more preferably in a quantity of 1.5 to 3.5 g/m$^2$.

In the invention, it is important that a total gelatin coating quantity of all layers of non-photosensitive back side (back layer, back side protective layers, etc.,) is 0.5 times to 1.5 times a total gelatin coating quantity of all the layers of the image forming layer (intermediate layer, protective layer, etc.)

A total binder coating quantity (per m$^2$ of support) of the surface protective layer or intermediate layer (for one layer) is preferably in a range of 1.5 to 6.0 g/m$^2$ and more preferably in a range of 2.0 to 4.5 g/m$^2$.

2-4. Coating 2-4-1. Coating Method

The photothermographic material of the invention may be coated by any method. Specifically, it is coated by various methods including extrusion coating, slide coating, curtain coating, dip coating, knife coating, flow coating and the extrusion coating by using the species of the hopper described in the U.S. Pat. No. 2,681,294. Preferable are extrusion coating and slide coating, and particularly preferable is slide coating described on pages 399 to 536 in "Liquid Film Coating" authored by Stephen F. Kistler, Petert M. Schweizer (published by Chapman & Hall, 1997). The shape of the slide coater used in the slide coating is described in FIG. 11 b. 1 on page 427 in the above text. If desired, 2 or more layers can be coated at the same time by the methods described on pages 399 to 536 in the above text or by the methods described in U.S. Pat. No. 2,761,791 and UKP No. 837,095. Particularly preferable coating methods of the invention are those described in JP-A No. 2001-194748, 2002-153808 and 2002-153803.

The coating liquid of the invention is a preferably so-called thixotropic fluid. Said technology can be referred to in JP-A No. 11-52509. The viscosity of the organic silver salt-containing coating liquid of the invention is preferably 400 mPa·s to 100,000 mPa·s and more preferably 500 mPa·s to 20,000 mPa·s at a shear rate of 0.1 $S^{-1}$. The viscosity is preferably 1 mPa·s to 200 mPa·s and more preferably 5 mPa·s to 80 mPa·s at a shear rate of 1000 $S^{-1}$.

When the coating liquid of the invention is prepared by mixing 2 types of liquids, such preparation is preferably manufactured by using a known inline mixer or implant mixer. The preferable inline mixer of the invention is described in JP-A No. 2002-85948, and the preferable implant mixer is described in JP-A No. 2002-90940.

It is preferable to defoam the coating liquid of the invention for keeping the coated surface in a good condition. The preferable defoaming of the invention is the method described in JP-A No. 2002-66431.

When the coating liquid of the invention is coated, it is preferable to conduct antistatic treatment for preventing dust from adhering to the support. The method for antistatic treatment of the invention is described in JP-A No. 2002-143747.

In the invention, since a coating liquid is not prepared in advance and dried upon coating on the image forming layer, it is necessary to control strictly air and drying temperature. The preferable drying method of the invention is described in detail in JP-E No. 2001-194749 and 2002-139814.

It is preferable that the photothermographic material of the invention is heat-treated immediately after the coating and drying to improve the film formability. The heat-treatment is effected preferably at a temperature on the film surface at 60° C. to 100° C. for 1 to 60 seconds, and more preferably at 70 to 90° C. and for 2 to 10 seconds. The preferable method for heat-treatment in the invention is described in JP-A No. 2002-107872.

Further, the method described in JP-A No. 2002-156728 is preferably used in attaining a stable and continuous production of the photothermographic material of the invention.

The photothermographic material of the invention is preferably a mono sheet (image can be formed on a single sheet of photothermographic material without using another sheet like an image-receiving material).

2-4-2. pH on the Surface Layer

The photothermographic material of the invention has preferably pH of 7.0 or less on the surface layer prior to thermal development processing, and more preferably pH of 6.6 or less. There are no particular restrictions on the lower limit of pH but around a pH of 3. The most preferable pH range is 4 to 6.2. It is preferable in view of reduction of pH on the surface layer to use unvolatile acids including organic acid such as phthalic acid derivative and sulfuric acid or volatitle bases such as ammonia to adjut pH on the surface layer. In particular, ammonia will easily become volatile and can be removed during a coating process or before thermal development, thus making it a preferable substance in attaining a less pH level on the surface layer.

It is also preferable to use unvolatile bases such as sodium hydroxide, photassium hydroxide and lithium hydroxide in combination with ammonia. The method for determining pH on the surface layer is described in paragraph [0123] of JP-A No. 2000-284399.

2-5. Other Materials 2-5-1. Support

The support is the same as that described in the above 1-4-1.

2-5-2. Packaging Material

The packaging material is the same as that described in the above 1-4-2.

2-6. Other Applicable Technology

The other applicable technology is the same as that described in the above 1-5.

2-7. Image Forming Method

The image forming method is the same as that described in the above 1-6.(1) to (3).

2-8. Use of the Invention

The use of the invention is the same as that described in the above 1-7.

A photothermographic material ordinarily contains photosensitive layer and a non-photosensitive layer. The non-photosensitive layer is classified as follows on the basis of the placement: (1) protective layer that is prepared on an upper layer rather than the image forming layer (distal side from the support), (2) intermediate layer prepared between plural photosensitive layers or between a photosensitive layer and protective layer, (3) prime coat or under coat layer prepared between a photosensitive layer and the support and (4) back layer (or including a back protective layer prepared when necessary) prepared on the opposite side of the photosensitive layer.

In most cases, a filter layer is prepared as a layer of (1) or (2), and an anti-halation layer prepared on a photosensitive material is provided on the photosensitive material as a layer of (3) or (4). For preventing irradiation, a photosensitive layer is colored in some cases.

The photothermographic material of the invention is provided with an optically functional layer. In the invention, the optically functional layer is a general term for layers such as a non-photosensitive layer and a photosensitive layer having a dye that can be thermally discolored for controlling filtration and preventing halation or irradiation, and specifically a filter layer for the above (1) or (2), a non-photosensitive layer for the above (3) or (4) as an anti-halation layer and a colored photosensitive layer for irradiation prevention.

The photothermographic material of the invention is particularly preferable when it has a layer of above (3) or (4) as an anti-halation layer with an optical function, among other things, and most preferable when it has a back layer (4) (including a back protective layer prepared when necessary).

The following is a detailed explanation regarding the third aspect of the invention.

The third aspect of the photothermographic material of the invention contains at least one species of polymers whose glass transition temperature is −10° C. or higher and 120° C. or less in an optically functional layer and/or a layer adjacent thereto.

Any polymer other than gelatin can be used as long as the glass transition temperature is −10° C. or higher and 120° C. or less. Preferable polymers are transparent or semi-transparent, and preferably colorless in general. Preferable polymer whose glass transition temperature is −10° C. or higher and 120° C. or less include natural resins, polymers or copolymers; synthesized resins, polymers or copolymers; and other film-forming media, for example, rubbers, poly (vinyl alcohols), hydroxyethyl celluloses, cellulose acetates, cellulose acetate butylates, poly (vinyl pyrrolidones), caseins, starches, poly (acrylic acids), poly (methyl methacrylic acids), poly (vinyl chlorides), poly (methacrylic acids), styrene-anhydrous maleic acid copolymers, styrene-acrylonitrile copolymers, styrene-butadiene copolymers, poly (vinyl acetals) (for example, poly (vinyl formals) and poly (vinyl butyrals), poly (esters), poly (urethanes), phenoxy resins, poly (vinylidene chlorides), poly (epoxides), poly (carbonates), poly (vinyl acetates), poly (olefins), cellulose esters and poly (amides).

A quantity of the polymer whose glass transition temperature is −10° C. or higher and 120° C. or less that is contained in the optically functional layer and/or a layer adjacent thereto is preferably 1 to 70% by weight based on a quantity of all the binders contained in the optically functional layer and/or a layer adjacent thereto, more preferably 1 to 50% by weight and particularly preferably 2 to 40% by weight.

In the invention, the glass transition temperature is −10° C. or higher and 120° C. or less, preferably 10° C. or higher and 100° C. and most preferably 10° C. or higher and 85° C. or less.

In this instance, Tg was calculated in the same manner as in the above 1-1-4.

Two or more polymers may be used in a state of copolymerization when necessary. When 2 or more species of polymers with different Tg are blended, it is preferable that the weight average Tg falls under the above range.

In the invention, the polymer contained in the optically functional layer is preferably 2% by mass or less (equilibrium moisture content) at 25° C. and 60% RH, because of a better color remaining of the thermally discolorable dye. More preferable is 0.01% by mass or higher and 1.5% by mass or less, and still more preferable is 0.02% by mass or higher and 1% by mass or less.

The equilibrium moisture content at 25° C. and 60% RH can be expressed as follows by referring to W, weight of polymer whose moisture is maintained in equilibrium at 25° C. and 60% RH, and to WO, weight of polymer maintained absolutely dry at 25° C.

$$\text{Equilibrium moisture content at 25° C. and 60\% RH} = [(W1-WO)/WO]\times 100(\%\text{ by mass})$$

The definition and method for determining the moisture content can be, for example, referred to in Molecular Material Test, High Molecular Engineering Courses 14 (compiled by the Society of Polymer Science, Japan, Chijinshokan).

In the invention, the preferable polymer to be contained in the optically functional layer and/or a layer adjacent thereto is a polymer latex in view of better color remaining of a thermally discolorable dye.

Particularly, regarding example in a state of dispersion, latexes in which water-insoluble hydrophobic polymer is dispersed in a state of a micro-particle or those in which polymer molecules are dispersed in a state of molecule or micelle may be usable and preferably in a state of latex-dispersion particle. The mean size of dispersed particles is 1 to 50,000 nm, preferably 5 to 1000 nm, more preferably 10 to 500 mn and still more preferably 50 to 200 nm. There are no particular restrictions on the particle size distribution of dispersed particles. More particularly, the particle size distribution of said polymers may be used that is wider or of monodispersion. Mixing of 2 or more species with particle size distribution that is of monodispersion is also preferable in controlling physical properties of a coating liquid.

In the invention, preferable examples of aqueous solvent-dispersible polymers include hydrophobic polymers such as acrylic polymer, poly (esters), rubbers (for example, SBR resin), poly (urethanes), poly (vinyl chlorides), poly (vinyl acetates), poly (vinylidene chlorides) and poly (olefins). The following polymers can be used in the invention; straight chain polymers, branched chain polymers, or cross-linked polymers homopolymers made through polymerization of monomers and copolymers made through polymerization of 2 or more types of monomers. In the case of copolymers, either random copolymer or block copolymer may be employed. These polymers are preferably 5,000 to 1,000,000 in the number average molecular weight and more preferably 10,000 to 200,000. Those with an excessively low molecular weight are insufficient in the dynamics strength of the emulsion layer and those with an excessively large molecular weight are poor in film formability. Particularly suitable polymers are cross-linked polymer latexes.

(Example of Polymer Latexes)

Examples of preferable polymer latexes are the same as those described in the above 1-1-4 (2) (iii).

(Preferable Polymer Latexes)

The polymer latexes usable for the optically functional layer of the invention include those described as polymer latexes for the back side layer in the above 1-1-4 (2) (iii).

(Dye Discolorable by Thermal Development Processing)

The following is an explanation regarding the dye that is discolorable by thermal development processing (hereinafter referred to as thermally discolorable dye from time to time).

The thermally discolorable dye of the invention is designated as a dye for attaining optical functions such as filtration, irradiation prevention or halation prevention, preferably available as a solid micro-particle dye. Further, the thermally discolorable dye of the invention may be used in combination with a dye not discolorable by thermal development processing.

The dyes that are discolorable by thermal development processing may include those discolorable by thermal development as described in the above 1-1-5.(1) to (3).

(Base Precursor)

The optically functional layer of the invention preferably contains a base precursor.

The base precursors used in the invention are those described in the above 1-1-6.

(Melting Point Depressing Agent)

The melting point depressing agents are those described in the above 1-1-7.

(Gelatin with Isoelectric Point of 5.0 to 9.5)

The photothermographic material of the invention preferably contains in the optically functional layer of the invention a gelatin whose isoelectric point is 5.0 to 9.5 (hereinafter referred to as "specific gelatin" from time to time).

The following is an explanation regarding the specific gelatin of the invention.

In the specific gelatin of the invention, a desirable range of isoelectric point is fundamentally determined by the performance required for photothermographic materials. An excessively high isoelectric point may restrict a pH range of coating liquid, depending on the type of additive agent on the coating liquid, because of necessity for avoiding aggregation of the coating liquid. In the specific gelatin of the invention, the isoelectric point is 5.0 to 9.5, preferably 5.5 to 8.5 and still more preferably 5.5 to 8.0, with the fact taken into account.

Gelatins are the same as those described as desirable species in the above 1-1-4 (1) (ii).

The photothermographic material of the invention is preferably a so-called dry silver type photothermographic material that contains a non-photosensitive silver source, a photosensitive silver halide and a reducing agent in one surface of the support.

The following is an explanation regarding the preferable aspect of the photothermographic material of the invention.

It is preferable to use the following organic silver salts as the non-photosensitive silver source of the invention.

(Explanation Regarding Organic Silver Salts)

Organic silver salts used in the invention are relatively stable against light, but function as a supplier of silver ions when heated to 80° C. or higher in the presence of an exposed photosensitive silver halide and a reducing agent to form a silver image. The organic silver salt may be any organic substance that can supply silver ions reducible by a reducing agent. Said non-photosensitive organic silver salts are described in paragraphs 0048 to 0049 of JP-A No. 10-62899, line 24 on page 18 to line 37 on page 19 EP-A No. 0803764A1, EP-A No. 0962812A1, JP-A No. 11-349591, JP-A Nos. 2000-7683 and 2000-72711. Preferable is an organic acid silver salt, and more preferable is a silver salt of a long-chain aliphatic carboxylic acid (having 10 to 30 carbon atoms preferably 15 to 28 carbon atoms). Preferable examples of aliphatic acid silver salts include silver lignocerate, silver behenate, silver arachidate, silver stearate, silver oleate, silver laurate, silver caproate, silver myristate, silver palmitate, erucic acid and these mixtures. In the invention, of these aliphatic acid silvers, preferable are those having a silver behenate content of 50 mol % or higher, more preferable are those having a silver behenate content of 85 mol % or higher, and still more preferable are those having an aliphatic acid silver content of 95 mol % or higher.

There are no particular restrictions in the configurations of organic silver salts used in the invention, and any configurations such as needle shape, bar shape, tabular shape or scaly shape may be employed.

Scaly organic silver salts are preferable in the invention. Also preferably used are amorphous particles of short needle shape, rectangular shape, cubic shape or potato shape, whose ratio of major axis to minor axis is 5 or less. These organic silver particles are characterized by less fogging upon thermal development as compared with long-needle shaped particles having the major axis to minor axis ratio of 5 or greater. In particular, a particle whose ratio of major axis to minor axis is 3 or less is preferable because it can improve the mechanical stability of coated film. In this invention, the scaly organic silver salt is defined as follows: under electron microscopic observation of the organic acid silver salt, the shape of the said organic silver particle salt is made nearly similar to a rectangular shape and when the sides of the rectangle are assumed to be a, b, and c in the ascending order of length (c and b may be of the same length), x is determined as follows by a calculation referring to the shorter sides of a and b.

$$x=b/a$$

By referring to the above formula, x is determined for approximately 200 particles to obtain the mean value x. When the relation of x (mean value)≧1.5 is obtained, such particles are defined as a scaly particle. The preferable relation is 30≧x (mean value)≧1.5 and the more preferable relation is 20≧x (mean value)≧2.0. For reference, the needle shape is expressed as the relation of 1≦x (mean value)<1.5

In the scaly particle, a is the thickness of a tabular-shaped particle having a major surface with the sides of b and c. The mean value of a is preferably in a range from 0.01 μm to 0.23 μm, and more preferably in a range from 1 μm to 0.20 μm. The mean value of c/b is preferably in a range from 1 to 6, more preferably in a range from 1.05 to 4, still more preferably in a range from 1.1 to 3 and particularly preferably in a range of from 1.1 to 2.

The particle size distribution of organic silver salts is preferably of monodispersion. The monodispersion can be expressed in a percentage obtained by dividing the standard deviations of the lengths of the minor axis and the major axis by the minor axis and the major axis respectively. It is preferably 100% or less, more preferably 80% or less, and still more preferably 50% or less. The configuration of organic silver salts can be determined by observing the image of dispersed organic silver salt under a transmission type electron microscope. The monodispersion can be determined by another method, namely, the standard deviation is calculated for the volume weighted mean diameter of organic silver salt, and expressed in a percentage (coefficient of variation) obtained by dividing the standard deviation by the volume weighted mean diameter. The Thus obtained monodispersion is preferably 100% or less, more preferably 80% or less and still more preferably 50% or less. There is also another method, for example, themonodispersion is determined from particle size being measured (volume weighted mean diameter) which is obtained by irradiating a laser beam to organic silver salt dispersed in a liquid to obtain the auto correlation function in relation to over-time variation in scattered light.

The preparation of organic acid silver and the added quantity are the same as those described in the above 1-2-3 (3) and (4).

(Explanation Regarding Reducing Agents)

The explanation regarding reducing agents is the same as that described in the above 1-2-4 (1) to (4).

In the invention, the reducing agent is preferably in a solid dispersion.

(Development Accelerators)

The explanation regarding development accelerators is the same as that described in the above 2-2-3.

(Explanation Regarding Hydrogen Bond Compound)

The explanation regarding a hydrogen bond compound is the same as that described in the above 1-2-6.

(Explanation Regarding Silver Halide)

The explanation regarding silver halide is the same as that described in the above 1-2-7. (1) to (12).

(Explanation Regarding Binder)

It is preferable that the following polymers to be explained in detail are contained as a binder in an organic silver salt-containing layer of the photothermographic material of the invention.

The binder of the organic silver salt-containing layer is the same as that described in the above 1-1-4 (species).

In the third aspect, the glass transition temperature of the binder usable jointly in a layer that contains an organic silver is 10° C. or higher and 80° C. or less (hereinafter referred to as high Tg binder from time to time), more preferably 15° C. to 70° C. and still more preferably 20° C. or higher and 65° C. or less.

In the invention, it is preferable that coating, drying and subsequent film formation are carried out by using a coating liquid in which the organic silver salt-containing layer has a solvent 30% by mass of which is water.

In this invention, an improved performance can be attained when coating, drying and subsequent film formation are carried out by using a coating liquid in which the organic silver salt-containing layer has a solvent 30% by mass of which is water, where a binder of the organic silver salt-containing layer can be dissolved or dispersed in an aqueous solvent (water solvent) and particularly where the binder consists of latex polymers whose equilibrium moisture content is 2% by mass or less particularly at 25° C. and 60% RH. Most preferable is a case that a coating liquid is prepared so that its ion conductivity is 2.5 mS/cm or less. Such a preparation method can be carried out by using a polymerized isolative function membrane.

The aqueous solvent capable of dissolving or dispersing the above-mentioned polymers is water or a mixture of water with a water-soluble organic solvent whose content is 70% by mass or less. Water-mixable organic solvents include alcohols such as methyl alcohol, ethyl alcohol and propyl alcohol, cellosolves such as methyl cellosolves, ethyl cellosolves and butyl cellosolves, ethyl acetate and dimethylformamide.

A solvent wherein polymers are not dissolved thermodynamically and present in a state of so-called dispersion is also termed as an aqueous solvent.

The moisture content of a binder polymer in the third aspect is the same as a moisture content described in the above 1-1-4 (2) (vii).

In this invention, particularly polymers dispersible in an aqueous soluble solvent are preferable. Binders in a dispersion state may include latexes wherein water-insoluble hydrophobic polymer particles are dispersed or those wherein polymer molecules are dispersed in a molecular state or a state where micelle is formed. More preferable binders are those with particles dispersed in a latex state. The mean size of dispersed particles is 1 to 50000 nm, preferably 5 to 1000 nm, more preferably 10 to 500 nm and still more preferably in a range of 50 to 200 nm. There are no particular restrictions on the particle size distribution of dispersed particles. More particularly, particle size distribution of said polymers may be used that is wider or of monodispersion. Mixing of 2 or more polymers having particle size distribution that is of monodispersion is also preferable in controlling physical properties of a coating liquid.

In the invention, preferable examples of aqueous solvent-dispersible polymers include hydrophobic polymers such as acrylic polymer, poly (esters), rubbers (for example, SBR resin), poly (urethanes), poly (vinyl chlorides), poly (vinyl acetates), poly (vinylidene chlorides) and poly (olefins). Further, the following polymers can be used in the invention; straight chain polymers, branched chain polymers, or cross-linked polymers, homopolymers made through polymerization of monomers and copolymers made through polymerization of 2 or more species of monomers. In the case of copolymers, either a random copolymer or block copolymer may be employed. In these polymers, the number molecular weight is preferably 5000 to 1000000 and more preferably, 10000 to 200000. The polymers with excessively small molecular weight are insufficient in the dynamics strength of emulsion layer and those with excessively large molecular weight are poor in film formability and not suitable. Cross-linked polymer latexes are particularly preferable.

(Example of Latex)

Preferable polymer latexes include the following. Shown below are examples of starting material monomers, the number given in parentheses means percentage by mass, and the molecular weight is the number average molecular weight. When multifunctional monomers are used, the term, crosslinking, is described and the molecular weight is omitted, because a concept of molecular weight for building crosslinking is not applicable. Tg indicates glass transition temperature.

P-1; -MMA(70)EA(27)MAA(3)-latex (Molecular weight 37000, Tg61)

P-2; -MMA(70)2EHA(20)St(5)AA(5)-latex (Molecular weight 40000, Tg59)

P-3; -St(50)Bu(47)MAA(3)-latex (crosslinking, Tg-17)

P-4; -St(68)Bu(29)AA(3)-latex (crosslinking, Tg17)

P-5; -St(71)Bu(26)-AA(3)-latex (crosslinking, Tg24)

P-6; -St(70)Bu(27)IA(3)-latex (crosslinking)

P-7; -St(75)Bu(24)AA(1)-latex (crosslinking, Tg 29)

P-8; -St(60)-Bu(35)DVB(3)-MAA(2)-latex (crosslinking)

P-9; -St(70)Bu(25)-DVB(2)AA(3)-latex (crosslinking)

P-10; -VC(50)MMA(20)EA(20)-AN(5)AA(5)-latex (Molecular weight 80000)

P-11; -VDC(85)-MMA(5)EA(5)-MAA(5)-latex (Molecular weight 67000)

P-12; -Et(90)MAA(10)-latex (Molecular weight 12000)

P-13; -St(70)-2EHA(27)-AA(3)-latex (Molecular weight 130000, Tg43)

P-14; -MMA(63)-EA(35)-AA(2)-latex (Molecular weight 33000, Tg47)

P-15; -St(70.5)Bu(26.5)-AA(3)-latex (crosslinking, Tg23)

P-16; -St(69.5)-Bu(27.5)-AA(3)-latex (crosslinking, Tg20.5)

The abbreviations in the above structures correspond to monomers as follows:

MAA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The above-described polymer latexes are commercially available, with the following brand names. Examples of acrylic polymers include Cevian A-4635, 4718 and 4601 (all produced by Daicel Chemical Industries Ltd.) and Nipol Lx811, 814, 821, 820 and 857 (all produced by Zeon Corporation) Examples of poly (esters) include FINETEX ES650, 611, 675 and 850 (all produced by Dai Nippon Ink & Chemicals, Inc.) and WD-size WMS (all produced by Eastman Chemical Corporation) Examples of poly (urethanes) include HYDRAN AP10, 20 and 40 (all produced by Dai Nippon Ink & Chemicals, Inc.). Examples of rubbers include LACSTAR7310K, 3307B, 4700H, 7132C (all produced by Dai Nippon Ink & Chemicals, Inc.) and Nipol Lx416, 410, 438C, 2507 (all produced by Zeon Corporation.). Example of poly (vinyl chlorides) include G351 and G576 (all produced by Zeon Corporation) Example of poly (vinylidene chlorides) include L502 and L513 (all produced by Asahi Kasei Corporation). Example of poly (olefins) include CHEMIPEARL S120 and SA100 (all produced by Mitsui Chemicals, Inc.).

These polymer latexes may be used solely or blended in combination with 2 or more species of the polymers when necessary.

(Preferable Latex)

Styrene-butadienecopolymer latex is particularly preferable as polymer latex to be used in the invention. The weight ratio of styrene monomer unit to butadiene monomer unit in styrene-butadienecopolymer is preferably in a range of 40:60 to 95:5. The proportion of combined monomer units of styrene and of butadiene to copolymer is preferably in a range of 60 to 99% by mass. Polymer latexes of the invention preferably contain acrylic acid or methacrylic acid in a range of 1 to 6% by mass based on a sum of styrene and butadiene and more preferably in a range of 2 to 5% by mass. It is preferable that the polymer latexes of the invention contain acrylic acid.

Preferable styrene-butadienecopolymer latexes include previously described P-3 to P-8 and P-15 as well as commercial products such as LACSTAR-3307B, 7132C and Nipol Lx416 described on page 3 through 8 and 15.

To an organic silver salt-containing layer used in photosensitive materials of the invention, hydrophilic polymers such as gelatin, polyvinyl alcohol, methyl cellulose, hydroxypropyl cellulose and carboxymethyl cellulose may be added, whenever necessary. These hydrophilic polymers are added preferably in 30% by mass or less based on a total quantity of binders to be added to the organic silver salt-containing layer, and more preferably in 20% by mass or less.

In the invention, polymer latexes are used preferably to form the organic silver salt-containing layer (namely, image forming layer). Regarding a quantity of binders to be added to the organic sliver salt-containing layer, the weight ratio of total binders to organic silver salt is preferably in a range of 1/10 to 10/1, more preferably in a range of 1/3 to 5/1 and still more preferably in a range of 1/1 to 3/1.

The organic silver salt-containing layer is usually a photosensitive layer (emulsion layer) that contains photosensitive silver halide (a photosensitive silver salt) as well. In this instance, the weight ratio of total binders to silver halide is preferably in a range of 400 to 5 and more preferably in a range of 200 to 10.

A total quantity of the binders added to the image forming layer in the invention is preferably in a range of 0.2 to 30 g/m$^2$, more preferably in a range of 1 to 15 g/m$^2$ and still more preferably in a range of 2 to 10 g/m$^2$. Crosslinking agents for crosslinking and surfactants for improving applicability may be added to the image-forming layer of the invention.

(Preferable Coating Liquid Solvents)

Preferable coating liquid solvents are the same as those described in the above 1-2-9.

(Description of Anti-Fog Agent)

Description of anti-fog agents is the same as the description of anti-fog agents given in the above 1-2-10.(1) to (3).

The examples of the compounds expressed by the general formula (H) in the above 1-2-10.(2) are described below.

(H-1)

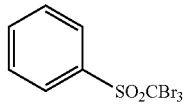

-continued
(H-2)
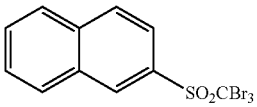
(H-3)
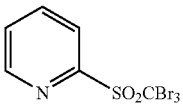
(H-4)
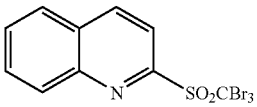
(H-5)
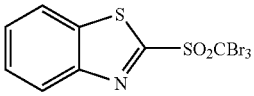
(H-6)
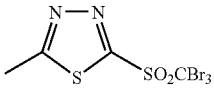
(H-7)
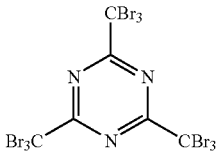
(H-8)
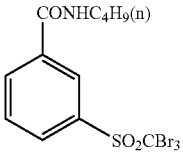
(H-9)
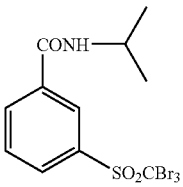
(H-10)
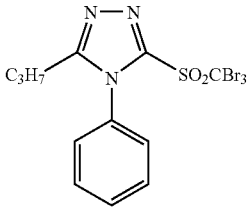
-continued
(H-11)
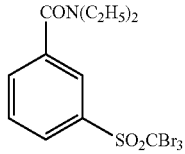
(H-12)
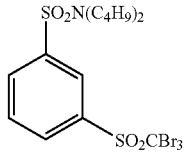
(H-13)
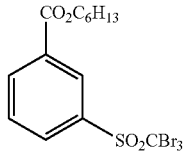
(H-14)
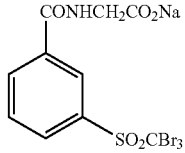
(H-15)
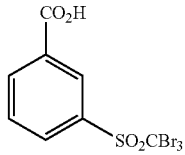
(H-16)
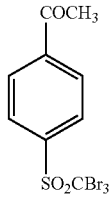
(H-17)
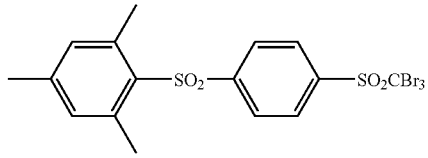
(H-18)
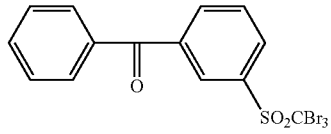
(H-19)
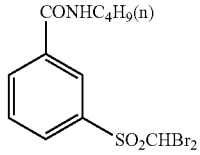

-continued (H-20)

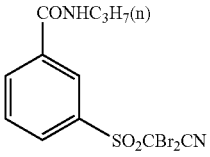

(H-21)

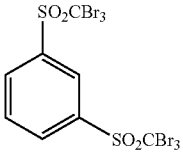

(H-22)

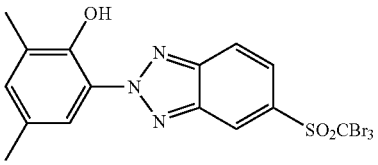

(H-23)

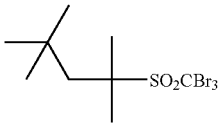

(H-24)

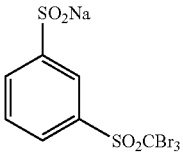

(H-25)

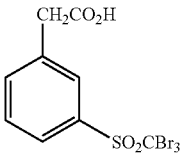

Other additives are the same as those described in the above 1-2-11.(1) to (3).

When formic acid or formate is used as a strong hazing substance, it is preferable that said substance is contained on the side having the image forming layer that contains a photosensitive silver halide in a quantity of 5 milli mols or less based on 1 mol of silver and more preferably in a quantity of 1 milli mol or less.

When a super high-contrast agent is used in the photothermographic material of the invention, it is preferable to use the agent together with an acid or its salt produced by hydration of diphosphorous pentaoxide. Acid or its salts produced by hydration of diphosphorous pentaoxide include metaphosphoric acid (metaphosphate), pyrophosphoric acid (pyrophosphate), orthophosphoric acid (orthophosphate), triphosphoric acid (triphosphate), tetraphosphoric acid (tetraphosphate) and hexametaphosphoric acid (hexametaphosphate). Particularly preferable acids or its salts produced by hydration of diphosphorous pentaoxide include orthophosphoric acid (orthophosphate) and hexametaphosphoric acid (hexametaphosphate). Exemplary examples are sodium orthophosphate, sodium dihydrogen orthophosphate, sodium hexametaphosphate and ammonium hexametaphosphate.

Acid or its salts produced by hydration of diphosphorous pentaoxide may be used in any desired quantity (quantity applicable to 1 $m^2$ of the photosensitive material), depending on performance such as sensitivity or fogging level, preferably in 0.1 to 500 $mg/m^2$ and more preferably in 0.5 to 100 $mg/m^2$.

The photothermographic material of the invention is preferably a so-called single-sided photosensitive material having a photosensitive layer that contains at least one layer of silver halide emulsion in one side of the support and having the back layer on the other side of the support.

(Explanation Regarding Matting Agent)

In the invention, it is preferable to add a matting agent for improving the conveyance property. The explanation regarding the matting agent is the same as that described in the above 2-1-5.(2).

The back layer applicable to the invention is described in paragraph 0128 to 0130 of JP-A No. 11-65021.

In the invention, it is preferable to provide a metal-oxide-containing conductive layer. Metal oxides with increased conductivity by introducing oxygen-defect different metal atoms into metal oxides are preferably used as a conductive material for the conductive layer. Preferable metallic oxides include ZnO, $TiO_2$ and $SnO_2$. It is preferable to add Al or In to $Zn^2O$, add Sb, Nb, P or a halogen element to $SnO_2$ and add Nb or Ta to $TiO_2$. Particularly, $SnO_2$ to which Sb is added is preferable. Added quantity of different atoms is preferably in a range of 0.01 to 30 mol % and more preferably in a range of 0.1 to 10 mol %. Any shape of metal oxides may be used, such as spherical, needle or tabular shape. Preferable are needle-shaped particles with the ratio of major axis to minor axis of 2.0 or greater and more preferably 3.0 to 50 in view of the effect of imparting conductivity. Metal oxides are used preferably in a range of 1 $mg/m^2$ to 1000 $mg/m^2$, more preferably in a range of 10 $mg/m^2$ to 500 $mg/m^2$, and still more preferably in a range of 20 $mg/m^2$ to 200 $mg/m^2$. The condutive layer of the invention may be prepared either on the emulsion side or back side, preferably between the support and the back layer. Examples of the conductive layer of the invention are described in JP-A No. 7-295146 and JP-A No. 11-223901.

A fluorosurfactant is preferably used in the invention.

The surfactant is the same as that described in the above 2-1-5.(4).

The support is the same as that described in the above 1-4-1.

Further, the anti-static layer or prime coat layer are prepared by the technology disclosed in JP-A Nos. 56-143430, 56-143431, 58-62646, 56-120519, paragraphs 0040 to 0051 of JP-A No. 11-84573, U.S. Pat. No. 5,575,957 and paragraphs 0078 to 0084 of JP-A No. 11-223898.

The photothermographic material of the invention is preferably a mono sheet (image can be formed on photothermographic material without using another sheet like an image-receiving material).

Anti-oxidants, stabilizing agents, plasticizers, ultraviolet ray-absorbing agents or coating adjuvants may be also added to either the photothermographic material. These additives are added either to the phoptosensitive layer or to the non-photosensitive layer. The details of said addition can be referred to in the descriptions given in WO 98/36322, EP803764A1, JP-A Nos. 10-186567 and 10-18568.

The photothermographic material of the invention may be coated by any method. Specifically, it is coated by various methods including extrusion coating, slide coating, curtain coating, dip coating, knife coating, flow coating and extrusion coating by using the hopper disclosed in the U.S. Pat. No. 2,681,294. Preferable are extrusion coating and slide coating, and particularly preferable is slide coating described on pages 399 to 536 in "Liquid Film Coating" authored by Stephen F. Kistler, Petert M. Schweizer (published by Chapman & Hall, 1997).

The shape of the slide coater used in the slide coating is described in FIG. 11 b. 1 on page 427 in the above text. If desired, 2 or more layers can be coated at the same time by the methods disclosed on pages 399 to 536 in the above text or by methods disclosed in U.S. Pat. No. 2,761,791 and UKP No. 837,095.

The coating liquid of the invention is preferably a so-called thixotropic fluid. The technology on thixotropic fluid can be referred to in JP-A No. 11-52509. The viscosity of the organic silver salt-containing coating liquid of the invention is preferably 400 m Pa·s to 100,000 mPa·s and more preferably 500 mPa·s to 20,000 mPa·s at a shear rate of 0.1 $S^{-1}$. The viscosity is preferably 1 mPa·s to 200 mPa·s and more preferably 5 mPa·s to 80 mPa·s at a shear rate of 1000 $S^{-1}$.

The technology usable in preparing the photothermographic material of the invention is the same as that described in the above 1-5.

(Explanation Regarding Packaging Material)

The packaging material is the same as that described in the above 1-4-2.

(Explanation Regarding Thermal Development)

The explanation regarding thermal development is the same as that described in the above 1-6.(2).

The photosensitive material of the invention may be exposed to light in any way and preferably to a laser beam. The laser beam preferably used in the invention includes gas laser (Ar+, He—Ne), YAG laser, dye laser and semi-conductor laser. It is also preferable to use a semi-conductor laser together with the $2^{nd}$ harmonic wave generating device. Preferable is red to infrared light-emitting gas or a semi-conductor laser.

The system is the same as that described in the above 1-6.(3).

The photothermographic material of the invention is to provide a black-and-white image based on silver image, preferably applied medical diagnosis, industrial photography, printing and COM uses.

The following are aspects of the invention.

In view of the 1st aspect, the invention is a photothermographic material comprising, on one side of a support, an image forming layer containing at least a photosensitive silver halide, a non-photosensitive organic silver salt, a reducing agent and a binder and, on the other side of the support, a non-photosensitive back side layer, wherein a total quantity of one or more alkaline earth metals contained in the non-photosensitive back side layer is in a range from $1\times10^{-5}$ mol/$m^2$ to $1\times10^{-3}$ mol/$m^2$.

In view of the 2nd aspect, the invention is the photothermographic material described in the 1st aspect wherein a coating quantity of gelatin contained in the non-photosensitive back side layer is in a range from 1.0 g/$m^2$ to 3.0 g/$m^2$.

In view of the 3rd aspect, the invention is the photothermographic material described in the 1st or 2nd aspect wherein the binder contains gelatin in an amount of 50% by mass to 100% by mass.

In view of the 4th aspect, the invention is the photothermographic material described in any of the 1st to 3rd aspects wherein the non-photosensitive back side layer is formed by coating two or more layers at the same time and subsequently drying the layers.

In view of the 5th aspect, the invention is the photothermographic material described in any of the 1st to 4th aspects wherein a coating liquid for forming the outermost layer, which is the most distant layer from the support, among the non-photosensitive back side layers, contains gelatin in an amount of 3.0% by mass to 10.0% by mass.

In view of the 6th aspect, the invention is the photothermographic material described in the 5th aspect wherein the surface tension of the coating liquid for forming the outermost layer is at least 2 mN/m less than a surface tension of the coating liquid for forming a layer adjacent to the outermost layer.

In view of the 7th aspect, the invention is the photothermographic material described in the 5th or 6th aspect wherein the viscosity of a coating liquid for forming the outermost layer is 20 cP or higher and 60 cP or less at the coating temperature.

In view of the 8th aspect, the invention is the photothermographic material described in any of the 5th to 7th aspects wherein the coating liquid for forming the outermost layer and/or the layer adjacent to the outermost layer contains a fluorine compound that has a fluoroalkyl group having 2 or more carbon atoms and 12 or less fluorine atoms.

In view of the 9th aspect, the invention is the photothermographic material described in the 8th aspect wherein the fluoroalkyl group is expressed by the following general formula (A).

-Rc-Re—W General formula (A)

(Wherein Rc represents an alkylene group with 1 to 4 carbon atoms, Re represents a perfluoroalkylene group with 2 to 6 carbon atoms, and W represents a hydrogen atom, a fluorine atom or an alkyl group.)

In view of the 10th aspect, the invention is the photothermographic material described in the 8th or 9th aspect wherein the fluorine compound has an anionic hydrophilic group.

In view of the 11th aspect, the invention is the photothermographic material described in the 10th aspect wherein the fluorine compound is expressed by the following general formula (2).

General formula (2)

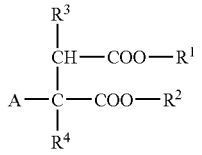

(In the formula, $R^1$ and $R^2$ independently represent a substituted or unsubstituted alkyl group, and at least one of which represents a fluoroalkyl group having 2 or more carbon atoms and 12 or less fluorine atoms or a fluoroalkyl group expressed by the above formula (A). $R^3$ and $R^4$ each independently represent a hydrogen atom or an alkyl group. A represents $-L_b-SO_3M$, and M represents a hydrogen atom or a cation. $L_b$ represents a mono-bond or substituted or unsubstituted alkylene group.)

In view of the 12th aspect, the invention is the photothermographic material described in the 8th or 9th aspect wherein the fluorine compound has a nonionic hydrophilic group.

In view of the 13th aspect, the invention is the photothermographic material described in the 12th aspect wherein the fluorine compound is expressed by the following general formula (3).

General formula (3)

$$Rf-X-(CH_2)_n-O)_m-R$$

(In the formula, Rf represents a fluoroalkyl group having 2 or more carbon atoms and 12 or less fluorine atoms or a fluoroalkyl group expressed by the above general formula (A). n represents an integral number of 2 or 3 and m represents an integral number of 1 to 30. X represents adivalent linking group, R represents a hydrogen atom, aryl group, heterocycle, Rf, or a group having at least one Rf as a substituent.)

In view of the 14th aspect, the invention is the photothermographic material described in any of the 6th aspect to 13th aspects wherein the viscosity of the coating liquid for forming the layer adjacent to the outermost layer is 20 cP to 60 cP at a coating temperature.

In view of the 15th aspect, the invention is the photosensitive material described in any of the 3rd to 14th aspects wherein the isoelectric point of the gelatin is 5.0 to 9.5.

In view of the 16th aspect, the invention is the photothermographic material described in the 15th aspect, wherein the gelatin is an acid-treated gelatin.

In view of the 17th aspect, the invention is the photothermographic material, comprising, on one side of the support, an image forming layer containing at least a photosensitive silver halide, a non-photosensitive organic silver salt, a reducing agent and a binder, and, on the other side of the support, the non-photosensitive back side layer, wherein a total coating quantity of gelatin on the non-photosensitive back side is 0.5 times to 1.5 times a total gelatin coating quantity of the side having an image forming layer, and the non-photosensitive back side contains at least one species of polymer latexes having a glass transition temperature in a range from −10° C. to 120° C.

In view of the 18th aspect, the invention is the photothermographic material described in the 17th aspect wherein the coating quantity of the polymer latex is in a range from 10% by mass to 50% by mass based on the total gelatin coating quantity in the non-photosensitive back side.

In view of the 19th aspect, the invention is the photothermographic material described in the 17th or 18th aspect wherein the non-photosensitive back side possesses two layers and, of these two layers, a content ratio of polymer latex to gelatin is greater in a back layer closer to the support than in a back layer further from the support.

In view of the 20th aspect, the invention is the photothermographic material described in any of the 17th aspect to 19th aspects wherein the non-photosensitive back side contains at least one species of a dye that can be discolored by thermal development processing.

In view of the 21st aspect, the invention is the photothermographic material described in the 20th aspect wherein the dye is discolorable by a base.

In view of the 22nd aspect, the invention is the photothermographic material described in the 17th to 21st aspects wherein a coating quantity of gelatin in the non-photosensitive back layer is in a range from 0.3 g/m$^2$ to 0.8 g/m$^2$.

In view of the 23rd aspect, the invention is the photothermographic material described in the 17th to 22nd aspects wherein the latex is a latex of styrene butadienecopolymer.

In view of the 24th aspect, the invention is the photothermographic material described in any of the 17th to 23rd aspects wherein a base precursor is contained.

In view of the 25th aspect, the invention is the photothermographic material described in any of the 17th to 24th aspects wherein the isoelectric point of the gelatin is in a range of 5.0 to 9.5.

In view of the 26th aspect, the invention is the photothermographic material described in the 25th aspect, wherein the gelatin is an acid-treated gelatin.

In view of the 27th aspect, the invention is a photothermographic material comprising, on at least one side of the support, at least on an optically functional layer containing at least one dye that can be discolored by thermal development processing, wherein at least one of the optically functional layer and a layer adjacent thereto contains at least one polymer having a glass transition temperature in a range from −10° C. to 120° C.

In view of the 28th aspect, the invention is the photothermographic material described in the 27th aspect, further comprising a non-photosensitive silver source, a photosensitive silver halide and a reducing agent on the support.

In view of the 29th aspect, the invention is the photothermographic material described in either the 27th or 28th aspect, wherein the optically functional layer contains at least one polymer having a glass transition temperature in a range from −10° C. to 120° C.

In view of the 30th aspect, the invention is the photothermographic material described in any of the 27th to 29th aspects wherein the at least one polymer having a glass transition temperature in a range from −10° C. to 120° C. is a polymer latex.

In view of the 31st aspect, the invention is the photothermographic material described in the 30th aspect wherein the at least one polymer having a glass transition temperature in a range from −10° C. to 120° C. is a latex of styrene butadienecopolymer.

In view of the 32nd aspect, the invention is the photothermographic material described in any of the 27th to 31st aspects, wherein the optically functional layer contains a base precursor.

In view of the 33rd aspect, the invention is the photothermographic material described in the 27th to 32nd aspects, wherein at least one of the optically functional layer and a layer adjacent thereto contains gelatin.

In view of the 34th aspect, the invention is the photothermographic material described in the 33rd aspect, wherein the isoelectric point of the gelatin is in a range of 5.0 to 9.5.

In view of the 35th aspect, the invention is the photothermographic material described in the 34th aspect, wherein the gelatin is an acid-treated gelatin.

EXAMPLES

The following is a specific explanation regarding the invention by referring to examples, which are not construed to limit the scope of the invention.

Example 1

(Fabrication of PET Support)

Terephthalic acid and ethylene glycol were used to obtain PET with IV(intrinsic viscosity) of 0.66 (determined at 25° C. in phenol/tetrachlorethane=6/4 (weight ratio) by a conventional method. After the PET was processed into pellets, they were dried at 130° C. for 4 hours and dissolved at 300° C. Then, the resultant was subjected to extrusion molding by using a T die and cooled rapidly to prepare an undrawn film so that the film thickness is 175 μm after thermal fixation.

The film was drawn 3.3 times longitudinally by using rollers with a different peripheral velocity and then 4.5 times horizontally by using a tenter. The temperatures were respectively 110° C. and 130° C. Thereafter, the film was thermally fixed at 240° C. for 20 seconds and then relaxed by 4% horizontally at the same temperature. The area of the film caught with the clamp of the tenter was cut off and both ends of the film were subjected to a knurled roller and reeled off at 4 kg/cm$^2$ to obtain 175 μm-thick film.

Corona Treatment of the Surface

A solid-state Corona treatment system (brand name: 6KVA model, manufactured by Pillar Inc. was used to treat both surfaces of the support at the rate of 20 m/minute at room temperature. The electric current and voltage read at the time of said treatment revealed that the support was treated at 0.375 kV·A·minute/m$^2$. The frequency at the time of said treatment was 9.6 kHz, and the clearance gap between the electrode and the dielectric roller was 1.6 mm.

(Preparation of Coating Liquid for Prime Coat of Photosensitive Layer Side)

The coating liquid for a prime coat of photosensitive layer side was prepared under the following compositions.

| | |
|---|---|
| PES resin A-520 (30% by mass solution) manufactured by Takamatsu Oil and Fat Co., Ltd. | 59 g |
| Polyethylene glycol mono-nonylphenyl ether (mean ethylene oxide number = 8.5) 10% by mass solution | 5.4 g |
| MP-1000, manufactured by Soken Chemical and Engineering Co., Ltd. (polymer micro-particle, mean particle size 0.4 μm) | 0.91 g |
| Distilled water | 935 ml |

(Preparation of Coating Liquid for Back Side)

Gelatin Gl purified through ion exchange resin was used. An alkaline earth metal contained in the gelatin is only calcium, with the content of 30 ppm.

<<Preparation of Solid Micro-Particle Dispersion of Base Precursor (a)>>

2.5 kg of base precursor compound 1 was mixed with 300 g of a surfactant (brand name: Demol N, manufactured by Kao Corporation), 781 g of diphenylsulfone (exemplified compound as (3M-1)) and distilled water to give a mixture (a total weight of 6.5 k g). Thus prepared mixture was subjected to bead dispersion using a horizontal-type sand mill (UVM-2: manufactured by Imex). To be more specific, the mixture was fed with a diaphragm pump to the UVM 2 in which zirconia beads (0.5 mm in mean diameter) were filled up with, and dispersion was effected with an internal pressure maintained at 50 hPa, until a desired mean particle size was obtained.

The dispersion was effected to an extent that the ratio of absorbance spectrophotometrically determined at 450 nm to that at 650 nm (D450/D650)) was 2.9 or greater. 1.0 g of sodium of benzoisothiazolinone was added to thus obtained dispersion and diluted with distilled water to give a total weight of 10 kg (25% by mass in base precursor concentration). The resultant was filtered through 3.0 μm-mean pore size polypropylene filter to remove foreign matters such as residues for actual use.

<<Preparation of Dye Solid Micro-Particle Dispersion>>

6.0 kg of cyanine dye compound-1, 3.0 kg of p-dodecylbenzene sodium sulfonate, 0.6 kg of Demol SNB, a surfactant manufactured by Kao Corporation and 0.15 kg of a defoaming agent (brand name of Surfynol 104E, manufactured by Nisshin Chemical Industry Co., Ltd.) were mixed with distilled water to give a total quantity of 60 kg. The mixture was dispersed by using a horizontal type sand mill (UVM-2: Imex) in which 0.5 mm zirconia beads were packed.

The dispersion was effected to an extent that the ratio of absorbance spectrophotometrically determined at 650 nm to that at 750 nm (D650/D750)) was 5.0 or greater. Thus obtained dispersion was diluted with distilled water so as to give 6% by mass in the concentration of cyanine dye. The resultant was filtered through 1.0 μm-mean pore size polypropylene filter to remove foreign matters such as residues for actual use.

<<Preparation of Back Layer Coating Liquid-A1>>

Gelatin Gl (Table 1) 36 g; 1 mol/liter caustic soda, 2.2 g; monodispersion polymethylmethacrylate micro-particle (mean particle size of 8 μm, standard deviation of particle size of 0.4) 2.4 g; benzoisothiazolinone 0.08 g; the above dye solid micro-particle dispersion 35.9 g; the above solid micro-particle dispersion of base precursor (a) 74.2 g; polyethylene sodium sulfonate 0.65 g; styrene/butadiene/acrylic acidcopolymer latex(copolymerization 68/29/3), 16.4 g ; N, N-ethylene bis (vinylsulfone acetoamide) 2.9 g were mixed with water to give a total quantity of 855 ml, which was designated as back layer coating liquid-A1.

<<Preparation of Coating Liquid for Back Side Protective Layer-A1>>

A vessel was maintained at 40° C., gelatin Gl (Table 1) 40 g; liquid paraffin emulsion as liquid paraffin 1.5 g; benzoisothiazolinone 35 mg; 5% solution of disodium sulfosuccinate (ethylhexyl) 10 ml; polystyrene sodium sulfonate 0.60 g; styrene/methymethacrylate/butylacrylate/hydroxyethylmethacrylate/acrylic acidcopolymer latex (copolymerization ratio 57/9/28/4/2), 6.0 g: N, N-ethylene bis (vinylsuilfone acetoamide), 1.0 g: were mixed, to which 1 mol/liter caustic soda was added to adjust pH to 6.9 and water was added to give a total quantity of 977 ml solution. Thus prepared solution was used as a coating liquid for back side protective layer-A1.

<<Preparation of Coating Liquids for Back Side Protective Layer-A2 to A10>>

Regarding the samples of 1-3 and 1-5 to 1-8, the coating liquid for the back side protective layer was prepared in a way identical to that used for preparing the coating liquid for the back side protective layer-A1, except that calcium nitrate solution and magnesium nitrate solution were added to the back side protective layer so that the coating quantities shown in Table 2 were attained.

Regarding the samples 1-2 and 1-4, the coating liquid for the back side protective layer was prepared in a way identical to that used in preparing the coating liquid-A1 for the back side protective layer except that the gelatin coating quantity of the back side protective layer was only changed in the sample 1-2 and the gelatin coating quantity of the back side protective layer was only changed in the sample 1-4 and calcium nitrate solution was added to the back side protective layer so as to attain the coating quantitieshown in Table 2 and gelatin was added so as to attain the total gelatin coating quantity as shown in Table 2.

Regarding the samples of 1-9 and 1-10, the coating liquid for the back side protective layer was prepared in a way identical to that used in preparing the coating liquid-A1 for the back side protective layer except that the gelatin species of the back side protective layer was only changed.

(Preparation of Silver Halide Emulsion)

<<Preparation of Silver Halide Emulsion1>>

3.1 ml of 1% by mass potassium bromide was added to 1421 ml distilled water, and 3.5 ml sulfuric acid with 0.5 mol/liter concentration and 31.7 g of phthalic gelatin were added thereto. Thus prepared mixture was stirred in a stainless-steel made reaction vessel and maintained at 30° C. and 22.22 g of silver nitrate was diluted to 95.4 ml solution by adding distilled water, which was designated as Solution A, and 15.3 g of potassium bromide and 0.8 g of potassium iodine were diluted with distilled water to 97.4 ml solution, which was designated as Solution B. These Solutions A and B were added in a whole quantity to the mixture for 45 seconds. Thereafter, 10 ml of 3.5% by mass hydrogen peroxide solution was added and further 10.8 ml of 10% by mass benzoimidazole was added. Then, 51.86 g of silver nitrate was diluted to 317.5 ml by adding distilled water, which was designated as Solution C, and 44.2 g of potassium bromide and 2.2 g of potassium iodide was diluted to 400 ml by adding distilled water, which was designated as Solution D. A whole quantity of Solution C was added at a constant flow rate for 20 minutes and Solution D was maintained at pAg 8.1 and added by control double jet method. Ten minutes after addition of Solutions C and D was started, potassium iridium (III) hexachloride was added in a whole quantity so as to give $1\times10^{-4}$ mol based on 1 mol of silver. Five seconds after completed addition of Solution C, aqueous solution of potassium iron (II) hexa-cyanide was added in a whole quantitieso as to give $3\times10^{-4}$ mol based on 1 mol of silver.

Sulfuric acid with 0.5-mol/L concentration was added to adjust pH to 3.8. Stirring was ceased to carry out the processes of sedimentation, demineralization and water washing. Sodium hydroxide with 1 mol/L concentration was used to adjust pH to 5.9, and silver halide dispersion with pAg 8.0 was prepared.

The above silver halide dispersion was maintained at 38° C., with stirring, and 5 ml of methanol solution of 1,2-benzoisothiazoline-3-on (0.34% by mass) was added, 40 minutes thereafter methanol solution with the mol ratio of 1:1 (spectral sensitization dye A to sensitization dye B) was added in $1.2\times10^{-3}$ mol as a sum of the sensitization dyes A and B based on 1 mol of silver and 1 minute thereafter the temperature was elevated to 47° C. Twenty minutes after the temperature elevation, benzene thiosufonic sodium was added in a form of methanol solution at $7.6\times10^{-5}$ mol based on 1 mol of silver, and 5 minutes thereafter, tellurium sensitizer C was added in a form of methanol solution at $2.9\times10^{-4}$ mol based on 1 mol of silver and the resultant was aged for 91 minutes. 1.3 ml of methanol solution (0.8% by mass) of N,N'-dihydroxy-N'-diethylmalmine was further added, and 4 minutes thereafter, 5-methyl-2-mercaptobenzoimidazole was added in a form of methanol solution at $4.8\times10^{-3}$ mol based on 1 mol of silver, and 1-phenyl-2-heptyl-5-mercapto-1,3,4-triazole was added in a form of methanol solution at $5.4\times10^{-3}$ mol based on 1 mol of silver to prepare silver halide emulsion 1.

A particle of Thus prepared silver halide emulsion was iodine silver bromide particle containing uniformly 3.5 mol % iodine with the mean sphere equivalent diameter of 0.042 μm and coefficient variation of the sphere equivalent diameter of 20%. The particle size, etc., were determined from the mean value of 1000 particles under electron microscopic observation. The [100] area ratio of the particle was determined by Kubelka-Munk method to be 80%.

<<Preparation of Silver Halide Emulsion 2>>

Silver halide emulsion 2 was prepared in the same manner as in preparing the silver halide emulsion 1 except that solution temperature of 30° C. on particle formation was changed to 47° C., Solution B to which 15.9 g of potassium bromide added was diluted with distilled water to 97.4 ml, Solution D to which 45.8 g of potassium bromide was diluted with distilled water to 400 ml, Solution C was add for 30 minutes, and potassium iron (II) hexa-cyanide was removed. As with the silver halide emulsion 1, sedimentation/desalting/water washing/dispersion were conducted. Further, the spectral sensitization, chemical sensitization and addition of 5-methyl-2-mercaptobenzoimidazole and 1-phenyl-2-heptyl-5-mercapto-1,3,4-triazole were carried out to obtain the silver halide emulsion 2 in the same manner as in preparing the emulsion 1, except that methanol solution with the mol ratio of 1:1 (spectral sensitization dye A to sensitization dye B) was added in $7.5\times10^{-4}$ mol as a sum of the sensitization dyes A and B based on 1 mol of silver, tellurium sensitizer C was added at $1.1\times10^{-4}$ mol based on 1 mol of silver and 1-phenyl-2-heptyl-5-mercapto-1,3,4-triazole was added at $3.3\times10^{-3}$ mol based on 1 mol of silver. An emulsion particle of the silver halide emulsion 2 was a pure silver bromide cubic particle with the mean sphere equivalent diameter of 0.080 μm and coefficient variation of the sphere equivalent diameter of 20%.

<<Preparation of Silver Halide Emulsion 3>>

The silver halide emulsion 3 was prepared in the same manner as in preparing the silver halide emulsion 1 except that the solution temperature of 30° C. on particle formation was changed to 27° C. As with the silver halide emulsion 1, sedimentation/desalting/water washing/dispersion were conducted. Further, the silver halide emulsion 3 was prepared in the same manner as in preparing the emulsion 1, except that solid dispersion (gelatin solution) with the mol ratio of 1:1 (spectral sensitization dye A to sensitization dye B) was added in $6\times10^{-3}$ mol as a sum of the sensitization dyes A and B based on 1 mol of silver, tellurium sensitizer C was added at $5.2\times10^{-4}$ mol based on 1 mol of silver and 3 minutes after addition of tellurium sensitizer C, gold bromine aurate was added at $5\times10^{-4}$ mol based on 1 mol of silver and potassium thiocyanate was added at $2\times10^{-3}$ mol based on 1 mol of silver. An emulsion particle of the silver halide emulsion 3 was iodine silver bromide particle containing uniformly 3.5 mol % iodine with the mean sphere equivalent diameter of 0.034 μm and coefficient variation of the sphere equivalent diameter of 20%.

<<Preparation of Mixed Emulsion A for Coating Liquid>>

Silver halide emulsion 1 was dissolved in 70% by mass, silver halide emulsion 2 dissolved in 15% by mass and silver halide emulsion 3 dissolved in 15% by mass, to which 1% by mass solution of benzothiazolium iodide was added at $7\times10^{-3}$ mol based on 1 mol of silver. Further, water was added so that silver halide was contained in a quantity of 38.2 g as silver per kg of the mixed emulsion for the coating liquid.

<<Preparation of Aliphatic Acid Silver Dispersion A>>

87.6 kg of behenic acid (brand name: Edenor C22-85R, manufactured by Henkel), 423L of distilled water, 49.2 L of NaOH solution (5 mol/L concentration) and 120 L of t-butyl alcohol were mixed and allowed to react at 75° C. for 1 hour by stirring to obtain sodium behenic acid solution. Separately, 40.4 kg of silver nitrate was dissolved in water to prepare 206.2 L of silver nitrate solution (pH 4.0), which was maintained at 10° C. A reaction vessel containing 635 L of distilled water and 30 L of t-butyl alcohol was maintained at 30° C., to which the sodium behenic acid solution A and silver nitrate aqueous solution were added in a whole quantity at a constant flow rate for 93 minutes and 15 seconds and 90 minutes respectively, with sufficient stirring. In this instance, care was taken so that only silver nitrate solution was added for 11 minutes after start of such addition, and only sodium behenic acid solution A was added for 14 minutes and 15 seconds after completed addition of silver nitrate solution. Ambient temperatures were controlled so that the liquid was maintained constantly at 30° C. inside the reaction vessel. Sodium behenic acid solution A was added through a double-layered pipe, through the outer layer of which warm water was circulated to keep warm, so that the solution temperature at the outlet was maintained at 75° C. at the tip of the nozzle for adding the solution. Silver nitrate solution was added through a double-layered pipe, through the outer layer of which cold water was circulated to keep the temperature constant. The positions at which sodium behenic acid solution A and silver nitrate solution were added in a symmetrical position in relation to the center of the axis of the stirrer. The height was also adjusted so as not to contact with the reaction solution.

After addition of sodium behenic acid solution A, the resultant was allowed to stand for 20 minutes, with the temperature maintained as it was. Then, the temperature was elevated to 35° C. for 30 minutes and the resultant was aged for 210 minutes. Immediately after the completed aging, the resultant was subjected to centrifugal filtration the solid, which was washed with water until the conductivity of filtrate reached 30 μS/cm. Aliphatic acid silver salt was obtained through these processes. The separated solid was not subjected to drying but maintained as wet cake.

Electron-microscopic photography was carried out to evaluate the configuration of thus obtained silver behenate particle, observing that it was scaly crystal having a=0.14 μm, b=0.4 μm and c=0.6 μm on average, mean aspect ratio of 5.2, mean sphere equivalent diameter of 0.52 μm and coefficient variation of the sphere equivalent diameter of 15%. (a, b and c were defined in the text).

19.3 kg of polyvinyl alcohol (brand name: PVA-217 and water were added to the wet cake (equivalent to 260 kg of dry solid) to give a total quantity of 1000 kg. The resultant was converted into slurry by using a dissolver blade and preliminarily dispersed by using a pipeline mixer (brand name: PM-10 model, manufactured by Mizuho Industrial Co., Ltd.)

Then, thus preliminarily dispersed bulk solution was treated 3 times by using a disperser (brand name: Microfluidizer-M-610, manufactured by Microfluidex International Corporation, use of Z model interaction chamber), with the pressure of the disperser adjusted to 1260 kg/cm$^2$, to obtain silver behenate dispersion. In the cooling operation, coiled heat exchangers were fixed to the front and rear of the interaction chamber respectively to adjust the temperature of coolant so that the dispersion temperature was at 18° C.

<<Preparation of Reducing Agent Complex-1 Dispersion>>

10 kg of reducing agent complex -1

(6,6'-di-t-butyl-4,4'-dimethyl-2-2'-butylidenediphenol) and tri-phenylphosphineonxide complex of 1:1), 0.12 kg of triphenylphosphineoxide and 16 kg of aqueous solution (10% by mass) of modified polyvinyl alcohol (Poval MP203 manufactured by Kuraray Co., Ltd.) were added to 10 kg of water and mixed well to prepare a slurry. The slurry was fed with a diaphragm pump and subjected to 4-hour and 30-minute dispersion by using a horizontal sand mill (UVM-2: manufactured by Imex) in which zirconia beads (0.5 mm in mean diameter) were packed, and then 0.2 g of benzoisothiazolinone sodium and water were added to adjust the concentration of the reducing agent complex to 22% by mass, thus obtaining the reducing agent complex-1 dispersion. A reducing agent complex particle contained in the thus obtained reducing agent complex dispersion was 0.45 μm in the median diameter and 1.4 μm or less in the maximum particle size. The reducing agent complex dispersion was filtered through 3.0 μm-pore size polypropylene filter to remove foreign matters such as residues for retention.

<<Preparation of Development Accelerator-1 Dispersion>>

10 kg of the development accelerator-1 and 20 kg of aqueous solution (10% by mass) of modified polyvinyl alcohol (Poval MP203, manufactured by Kuraray Co., Ltd.) were added to 10 kg of water and mixed well to prepare a slurry. The slurry was fed with a diaphragm pump and subjected to 3-hour and 30-minute dispersion by using a horizontal-type sand mill (UVM-2: manufactured by Imex) in which zirconia beads (0.5 mm in mean diameter) were packed, and then 0.2 g of benzothiazolinone sodium and water were added to adjust the concentration of the development accelerator to 20% by mass, thus obtaining the development accelerator-1 dispersion. A development accelerator particle contained in the thus obtained development accelerator dispersion was 0.48 μm in the median diameter and 1.4 μm or less in the maximum particle size. The development accelerator dispersion was filtered through 3.0 μm-pore size polypropylene filter to remove foreign matters such as residues for retention.

(Preparation of Polyhalide)

<<Preparation of Organic Polyhalide-1 Dispersion>>

10 kg of the organic polyhalide-1 (tribromomethane sulfonylbenzene), 10 kg of aqueous solution (20% by mass) of modified polyvinyl alcohol (Poval MP203, manufactured by Kuraray Co., Ltd.) and 0.4 kg of aqueous solution of sodium trisiopropylnaphthalensulfonate (20% by mass) were added to 14 kg of water and mixed well to prepare a slurry. The slurry was fed with a diaphragm pump and subjected to 5-hour dispersion by using a horizontal-type sand mill (UVM-2: manufactured by Imex) in which zirconia beads (0.5 mm in mean diameter) were packed, and then 0.2 g of benzothiazolinone sodium and water were added to adjust the concentration of the organic polyhalide to 26% by mass, thus obtaining the organic polyhalide-1 dispersion. An organic polyhalide particle contained in the thus obtained polyhalide dispersion was 0.41 μm in the median diameter and 2.0 μm or less in the maximum particle size. The obtained organic polyhalide dispersion was filtered through 10.0 μm-pore size polypropylene filter to remove foreign matters such as residues for retention.

<<Preparation of Organic Polyhalide Dispersion-2>>

10 kg of the organic polyhalide -2 (N-butyl-3-tribromomethane sulfonylbenzoamide) was added to 20 kg of modified polyvinyl alcohol (Poval MP203, manufactured by Kuraray Co., Ltd.) solution (10% by mass) and 0.4 kg of sodium trisiopropylnaphthalensulfonate (20% by mass) solution and mixed well to prepare a slurry. The slurry was fed with a diaphragm pump and subjected to 5-hour dispersion by using a horizontal-type sand mill (UVM-2: manufactured by Imex) in which zirconia beads (0.5 mm in mean diameter) were packed, and then 0.2 g of benzoicothiazolinone sodium and water were added to adjust the concentration of the organic polyhalide to 30% by mass. The dispersion was heated at 40° C. for 5 hours to obtain the organic polyhalide-2 dispersion. An organic polyhalide particle contained in the thus obtained polyhalide dispersion was 0.40 μm in the median diameter and 1.3 μm or less in the maximum particle size. The organic polyhalide dispersion was filtered through 3.0 μm-pore size polypropylene filter to remove foreign matters such as residues for retention.

<<Preparation of Phthalazine Compound-1 Solution>>

8 kg of modified polyvinyl alcohol MP203, manufactured by Kuraray Co., Ltd. was dissolved in 174.57 kg of water. Then, 3.15 kg of sodium trisopropylnaphthalensulfonate solution (20% by mass) and 14.28 kg phthalazine compound-1 (6-isopropyl phthalazine) solution (70% by mass) were added thereto to prepare phthalazine compound-1 (5% by mass).

(Preparation of Mercapto Compound Solution)

<<Preparation of Mercapto Compound Solution-1>>

Seven grams of mercapto compound-1(1-(3-sulfonyl)-5-mercapototetrazole sodium) was dissolved in 993 g of water to give aqueous solution (0.7% by mass).

<<Preparation of Aqueous Solution of Mercapto Compound-2>>

Twenty Grams of Mercapto Compound-2

(1-(3-methyureido)-5-mercaptotetrazole sodium) was dissolved in 980 g of water to give aqueous solution (2.0% by mass).

(Preparation of Pigment-1 Dispersion)

Sixty four grams of C.I. Pigment Blue 60 and 6.4 g of Demol N manufactured by Kao Corporation was dissolved in 250 g of water and mixed well to obtain a slurry. Zirconia beads, 800 g, (mean grain size of 0.5 mm) was provided and put together with the slurry into a vessel. The mixture was dispersed with a ¼ g sand grinder mill (manufactured by Imex) for 25 hours to obtain the pigment-1 dispersion. A pigment particle contained in the thus obtained pigment dispersion was 0.21 μm in the median diameter.

(Preparation of SBR Latex Solution)

SBR latex with Tg=22° C. was prepared as follows:

Ammonium persulfate was used as a polymerization starter and anion surfactant was used as an emulsifier to cause styrene 70.0 by weight ratio, butadiene 27.0 mass and acrylic acid 3.0 mass to undergo emulsification and polymerization. The resultant was aged for 8 hours at 80° C., and then cooled to 40° C. Ammonia water and surfactant (brand name: Sundett BL, manufactured by Sanyo Chemical Industries Ltd.) were added thereto to adjust pH to 7.0 and the concentration to 0.22%. Further, 5% sodium hydroxide solution was added to adjust pH to 8.3 and then ammonia water was added to adjust pH to 8.4.

In this instance, the mole ratio of Na+ ion to NH4+ ion was 1:2.3. Further, 0.15 ml of 7% sodium benzoisothiazolinone solution was added to the resultant to prepare SBR latex solution.

(SBR latex: latex of -St (70.0)-Bu (27.0) AA (3.0)) with the following properties: Tg, 22° C.; Mean particle size, 0.1 μm; concentration, 43% by mass; equilibrium moisture content at 25° C. 60% RH, 0.6% by mass; ion conductivity, 4.2 mS/cm (determined at 25° C. for latex bulk solution (43% by mass) by using a diagometer (brand name: CM-30S, manufactured by Toa Corporation); pH, 8.4. SBR latexes with different Tg can be prepared similarly through appropriate change in the ratio of styrene to butadiene.

(Preparation of Coating Liquid-1 (for Emulsion Layer, Photosensitive Layer)

One thousand grams of aliphatic acid silver dispersion prepared as above, 276 ml of water, 33 g of pigement-1 dispersion, 21 g of organic polyhalide-1 dispersion, 58 g of organic polyhalide -2 dispersion, 173 g of phthalizine compound-1 solution, 1082 g of SBR latex (Tg: 22° C.), 2995 g of reducing agent-1 dispersion, 5.7 g of development accelerator -1 dispersion, 9 ml of mercapto compound-1 aqueous solution and 27 ml of mercapto compound-2 aqueous solution were added sequentially, and 117 g of silver halide mixed emulsion A was added immediately before coating and mixed well to prepare a coating liquid for the emulsion layer. The thus prepared coating liquid was fed directly to a coating die for coating.

The viscosity of the coating liquid for the above emulsion layer was determined with B-type viscometer (Tokyo Keiki) to find 25 [mPa·s] at 40° C. (No. 1 rotor, 60 rpm).

RFS fluid spectrometer (manufactured by Rheometrics Far East Ltd.) was used to determine the viscosities of the coating liquid at 25° C. at the shear rate of 0.1, 1, 10, 100 and 1000 [1/second], which were respectively 230, 60, 46, 24 and 18 [mPa·S].

(Preparation of Coating Liquid for Emulsion Side Intermediate Layer)

1000 g of polyvinyl alcohol (brand name: PVA-205, manufactured by Kuraray), 163 g of pigment-1 dispersion, 33 g of blue dye compound-1 solution (Kayafect turquoise RN Liquid 150, Nihon Kayaku Co., Ltd.), 27 ml of 5% aqueous solution of disodium sulfosuccinate (2-ethyhexyl), 4200 ml of 19% by mass solution of methylmethacrylate/styrene/buthylacrylate/hydroxyethyl methacrylate/acrylic acidcopolymer (copolymerization ratio: 57/8/28/5/2) latex, 27 ml of 5% by mass aqueous solution of Aerozol OT manufactured by American Cyanamid 135 ml of 20% by mass aqueous solution of diammonium phthalate were added to water to give a total quantity of 10,000 g. Further, NaOH was added thereto to adjust the pH to 7.5 to prepare the coating liquid for the intermediate layer, which was fed to the coating die so as to give a coating quantity of 8.9 ml/m$^2$.

The viscosity of the coating liquid determined with B-type viscometer at 40° C. (No. 1 rotor, 60 rpm) was 58 [mPa·s].

(Preparation of Coating Liquid for Emulsion Side First Protective Layer)

100 g of inert gelatin and 10 mg of benzoisothiazolinone were dissolved in 840 ml of water, and 180 g of 19% by mass methylmethacrylate/styrene/buthylacrylate/hydroxyethylmethacrylate/acrylic acid copolymer (copolymerization ratio: 57/8/28/5/2) latex solution, 46 ml of 15% by mass phthalic acid methanol solution and 5.4 ml of 5% by mass aqueous solution of disodium sulfosuccinate (2-ethyhexyl) were added to prepare the coating liquid. Immediately before coating, 40 ml of 4% by mass chrome alum was mixed with the coating liquid by using a static mixer, which was fed to the coating die so as to give a coating quantity of 26.1 ml/m$^2$.

The viscosity of the coating liquid determined with B-type viscometer at 40° C. (No. 1 rotor, 60 rpm) was 20 [mPa·s].

(Preparation of Coating Liquid for Emulsion Side Second Protective Layer)

100 g of inert gelatin and 10 mg of benzoisothiazolinone were dissolve in 800 ml of water, and 180 g of 19% by mass methylmethacrylate/styrene/buthylacrylate/hydroxyethylmethacrylate/acrylic acidcopolymer (copolymerization ratio: 57/8/28/5/2) latex solution, 40 ml of 15% by mass phthalic acid methanol solution, 5.5 ml of 1% by mass fluorosurfactant (F-29) solution, 5.5 ml of 1% by mass fluorosurfactant (F-26) solution, 28 ml of 5% by mass aqueous solution of disodium sulfosuccinate (2-ethyhexyl), 4 g of polymethylmethacrylate micro-particle (0.7 μm mean particle size) and 21 g of polymethylmethacrylate micro-particle (4.5 μm mean particle size) were mixed to obtain the coating liquid for the surface protective layer. Thus prepared liquid was fed to the coating die so as to give a coating quantity of 8.3 ml/m$^2$.

The viscosity of the coating liquid determined with B-type viscometer at 40° C. (No. 1 rotor, 60 rpm) was 19 [mPa·s].

(Preparation of Photothermographic Material 1-1)

Both sides of the support coated with 175 μm-thick polyethylene terephthalate prepared on a two-axis drawing were respectively subjected to corona treatment. Then, the back layer coating liquid-A1 and the back side protective layer coating liquid-A1 were applied at the same time on the back side of the above prime coat support so as to give the respective gelatin coating quantities of 0.52 g/m$^2$ and 1.7 g/m$^2$ and dried to prepare the back layers.

A multi-coating was given by slide bead coating method to the surface opposite to the back side in the order of the prime coat layer, emulsion layer, intermediate layer, first protective layer and second protective layer starting from the layer closer to the support to prepare the photothermographic material 1-1. In this instance, the emulsion layer and intermediate layer were adjusted to 31° C., the first protective layer was to 36° C., and the second protective layer was to 37° C.

The following shows the coating quantities (g/m$^2$) for the individual compounds for the emulsion layer.

| | |
|---|---|
| Silver behenate | 5.58 |
| Pigment (C.I. Pigment Blue 60) | 0.036 |
| Polyhalide-1 | 0.12 |
| Polyhalide-2 | 0.37 |
| Phthalazine compound-1 | 0.19 |
| SBR latex | 9.98 |
| Reducing agent compound-1 | 1.41 |
| Development accelerator-1 | 0.025 |
| Mercapto compound-1 | 0.002 |
| Mercapto compound-2 | 0.012 |
| Silver halide (as Ag) | 0.091 |

The coating and drying were conducted as follows.

The coating was carried out at the feeding rate of 160 m/minute, clearance between the tip of the coating die and the support maintained at 0.10 to 0.30 mm and pressure at the decompression chamber set less by 196 to 882 Pa in relation to atmospheric pressure. The support was subjected to ion aeration to remove static electricity.

At the subsequent chilling stage, the coating liquid was cooled through aeration at dry-bulb temperature of 10 to 20° C. It was fed under non-contacting conditions and dried by using a coiled type non-contacting drier through aeration at a dry-bulb temperature of 23 to 45° C. and wet-bulb temperature of 15 to 21° C.

After drying, the liquid was adjusted for moisture at 25° C. and 40 to 60% RH, and then heated so that the surface reached 70 to 90° C. After heating, the surface was cooled to 25° C.

The photothermographic material 1-1 was prepared as described above.

(Preparation of the Photothermographic Material 1-2 to 1-8)

The samples of the photothermographic material 1-2 to 1-8 of the invention were prepared in the same manner as in preparing the photothermographic material 1-1 except that back layer coating liquid-A2 to A5 and back side protective layer coating liquids-A2 to A5 were used as shown in Table 2 although in preparing the photothermographic material 1-1, back layer coating liquid-A1 and back side protective layer coating liquid-A1 were used at the same time to effect the multilayered coating.

Table 1 covers details of the gelatins regarding the raw materials, production methods, whether they were treated with ion exchange resin or not and calcium content. The calcium content was determined by atom absorption spectrophotometry, more particularly, the calcium content was measured by referring to individual diluted gelatin solutions prepared by thermal degradation by addition of nitric acid and calcium chloride solution (dehydrate salt) as calibration solution.

The degree of matting expressed by Bekk smoothness of thus obtained photothermographic materials 1-1 to 1-8 was found to be 550 seconds for the image forming layer side and 130 seconds for the back side. The surface of the image forming layer side was found to be pH 6.0, and the surface of the back side was found to be pH 6.6.

[Evaluation of Over-Time Storage Stability]

The prepared samples were cut by half and wrapped at 25° C. and 40% RH for 2 weeks in the following packaging materials to make the following evaluation.

[Packaging Material]

PET 10 μm/PE 12 μm/aluminum foil 9 μm/Ny 15 μm/3% carbon-containing PE 50 μm

Oxygen permeability: 0 ml/atm·m$^2$·day (25° C.)

Moisture permeability: 0 g/atm·m$^2$·day (25° C.)

<Evaluation of Curl Property>

Undeveloped cut-in-half samples were individually placed on a flat table, with the back side maintained on the surface, and allowed to stand at an ambient temperature of 32° C. and 10% moisture for 24 hours.

The 4 corners of each sample curled upward then were measured for height to obtain the mean value of heights curled upward at the 4 corners.

A curl value (the height curled upward), less than 4 mm, is a satisfactory level, 4 to 8 mm is a level acceptable for actual use and 8 mm or greater is a level posing problems in conveyance.

<Evaluation of Reflection Gloss Irregularity>

Under a commercially available 3-wavelength fluorescent lamp, observation was made for the back side of each sample. Ten testers evaluated the samples by referring to the following 3 level criteria for the degree of reflection gloss irregularity toned depending on interference by reflected light of the fluorescent lamp to obtain the mean value, which was used for evaluation score of each sample.

| Evaluation score | Criteria |
|---|---|
| 3 | Satisfactory level with no reflection gloss irregularity found at all. |
| 2 | Level of not giving practical problems, although a slight irregularity found depending on an angle of observation. |
| 1 | Unacceptable level as undeveloped image film, with irregularities found all over the entire back side. |

<Evaluation of Cissing>

Evaluation was made for undeveloped films of individual samples about 10 m$^2$ surface to count the number of cissing defects.

Table 2 shows the number of the defects.

TABLE 1

| Name of Gelatin | Raw material | Production method | Treatment with ion exchange resin | Calcium content (ppm) |
|---|---|---|---|---|
| G1 | Beef bones | Lime treatment | Treated | 30 |
| G2 | Beef bones | Lime treatment | Not treated | 2790 |
| G3 | Beef bones | Lime treatment | Not treated | 3610 |

TABLE 2

| Sample No. | Gelatin for back layer | Gelatin for back side protective layer | Total coating quantity of gelatin for back layer and back side protective layer ($g/m^2$) | Coating quantity of alkaline earth metals ($mol/m^2$) | Reflection gloss irregularity | No. of cissing | Curl (mm) | Remarks |
|---|---|---|---|---|---|---|---|---|
| 1-1 | G1 | G1 | 2.22 | Ca; $1.3 \times 10^{-6}$ | 1.5 | 10 | 3.3 | Control |
| 1-2 | G1 | G1 | 3.2 | Ca; $1.3 \times 10^{-6}$ | 2.8 | 15 | 6.8 | Control |
| 1-3 | G1 | G1 | 2.22 | Ca; $4.3 \times 10^{-5}$ | 2 | 1 | 3.1 | Present invention |
| 1-4 | G1 | G1 | 3.2 | Ca; $1.1 \times 10^{-4}$ | 3 | 1 | 6.2 | Present invention |
| 1-5 | G1 | G1 | 2.22 | Ca; $1.1 \times 10^{-4}$ | 3 | 0 | 3 | Present invention |
| 1-6 | G1 | G1 | 2.22 | Ca; $2.1 \times 10^{-4}$ | 3 | 0 | 3.5 | Present invention |
| 1-7 | G1 | G1 | 2.22 | Ca; $6.0 \times 10^{-4}$ | 2.7 | 0 | 2.7 | Present invention |
| 1-8 | G1 | G1 | 2.22 | Ca; $1.1 \times 10^{-4}$ | 3 | 0 | 3.5 | Present invention |
| 1-9 | G1 | G2 | 2.22 | Ca; $1.2 \times 10^{-4}$ | 3 | 0 | 3.4 | Present invention |
| 1-10 | G1 | G3 | 2.22 | Ca; $1.5 \times 10^{-4}$ | 3 | 0 | 2.9 | Present invention |

As apparent from the results of Table 2, the samples 1-3 to 1-10 having the non-photosensitive back side layer that contain alkaline earth metals at a total quality of $1\times10^{-5}$ to $1\times10^{-3}$ $mol/m^2$ are less in the degree of reflection gloss irregularity, the number of cissing defects and the curl value, and found to be preferable.

Table 3 covers the surface tension and viscosity of the coating liquids for the back layer and back side protective layer (each of which was determined at solution temperature on coating).

TABLE 3

| Sample No. | Surface tension (mN/m) Back layer | Surface tension (mN/m) Back surface protective layer | Surface tension difference between back layer and back side protective layer (mN/m) | Viscosity (cP) Back layer | Viscosity (cP) Back side protec-tive layer | Remarks |
|---|---|---|---|---|---|---|
| 1-1 | 30.2 | 30.7 | −0.5 | 35 | 28.4 | Control |
| 1-2 | 30.2 | 32.2 | −2 | 35 | 33.9 | Control |
| 1-3 | 30.2 | 28.5 | 1.7 | 35 | 26.7 | Present invention |
| 1-4 | 30.2 | 29 | 1.2 | 35 | 30.9 | Present invention |
| 1-5 | 30.2 | 27.8 | 2.4 | 35 | 25.2 | Present invention |
| 1-6 | 30.2 | 27.1 | 3.1 | 35 | 23.5 | Present invention |
| 1-7 | 30.2 | 27.5 | 2.7 | 35 | 22.3 | Present invention |
| 1-8 | 30.2 | 27.3 | 2.9 | 35 | 25.6 | Present invention |
| 1-9 | 30.2 | 27.4 | 2.8 | 35 | 22.8 | Present invention |
| 1-10 | 30.2 | 27.1 | 3.1 | 35 | 25.4 | Present invention |

As apparent from the results of Table 3, such samples were less in the degree of reflection gloss irregularity and the number of the cissing defects that the surface tension of the coating liquid for the back side protective layer, a layer most distant from the support, was at least 2 mN/m less than the surface tension of the coating liquid for the back layer and the viscosity of the coating liquid for the back side protective layer and the coating liquid for the back layer was 20 to 60 cP at coating temperature.

Example 2

<<Preparation of the Photothermographic Material 1-11 to 1-18 of the Invention>>

The photothermographic materials 1-11 to 1-14 of the invention were prepared in the same manner as in preparing the photothermographic material 1-1, except that the fluorosurfactant shown in Table 4 was added to the back side protective layer of the sample 1-1 of the Example 1 so as to give 2.5 mg/m$^2$.

The photothermographic materials 1-15 to 1-18 of the invention were prepared in the same manner as in preparing the photothermographic materials 1-3 except that the fluorosurfactant shown in Table 4 was added to the back side protective layer of the sample 1-3 of the Example 1 so as to give 2.5 mg/m$^2$.

TABLE 4

| Sample No. | Fluorosurfactant for back side protective layer | Surface tension of back side protective layer | Surface tension difference between back layer and back side protective layer (mN/m) | Coating quantity of alkaline earth metals (mol/m$^2$) | Reflection gloss irregularity | No. of cissing | Curl (mm) | Remarks |
|---|---|---|---|---|---|---|---|---|
| 1-1 | — | 30.7 | −0.5 | Ca; $1.3 \times 10^{-6}$ | 1.5 | 10 | 3.3 | Control |
| 1-11 | FN-1 | 29.2 | 1 | Ca; $1.3 \times 10^{-6}$ | 1.8 | 8 | 3.2 | Control |
| 1-12 | F-3 | 29.5 | 0.7 | Ca; $1.3 \times 10^{-6}$ | 1.6 | 8 | 3.1 | Control |
| 1-13 | F-26 | 29.1 | 1.1 | Ca; $1.3 \times 10^{-6}$ | 1.7 | 7 | 3.2 | Control |
| 1-14 | F-29 | 29 | 1.2 | Ca; $1.3 \times 10^{-6}$ | 1.7 | 7 | 3.3 | Control |
| 1-3 | — | 28.5 | 1.7 | Ca; $4.3 \times 10^{-5}$ | 2 | 1 | 3.1 | Present invention |
| 1-15 | FN-1 | 28.1 | 2.1 | Ca; $4.3 \times 10^{-5}$ | 2.5 | 0 | 2.9 | Present invention |
| 1-16 | F-3 | 27.9 | 2.3 | Ca; $4.3 \times 10^{-5}$ | 2.8 | 0 | 3 | Present invention |
| 1-17 | F-26 | 27.2 | 3 | Ca; $4.3 \times 10^{-5}$ | 3 | 0 | 3.1 | Present invention |
| 1-18 | F-29 | 27.3 | 2.9 | Ca; $4.3 \times 10^{-5}$ | 3 | 0 | 2.9 | Present invention |

As apparent from the results of Table 4, such samples were less in the degree of reflection gloss irregularity and the number of the cissing defects that the preferable fluorosurfactant was added to the coating liquid for the back side protective layer, a layer most distant from the support and the surface tension was at least 2 mN/m less than the surface tension of the coating liquid for the back layer.

The following are chemical structures of the compounds used in the Example of the invention.

Blue dye compound-1

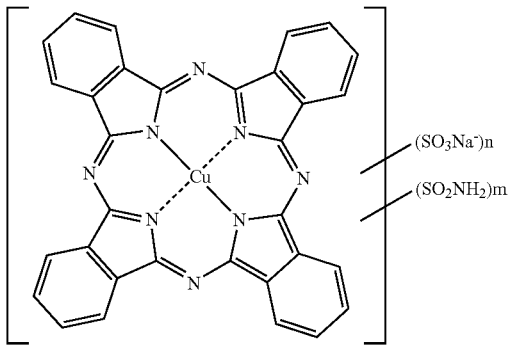

n = 0.5 ~ 2.0
m = 0.5 ~ 2.5

Spectral sensitization pigment A

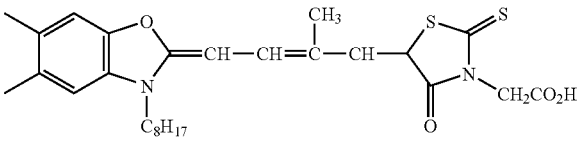

-continued

Spectral sensitization pigment B

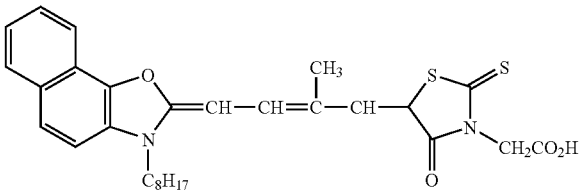

Tellurium sensitizer C

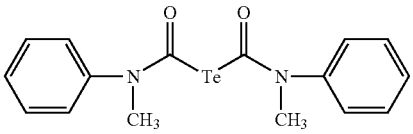

Base precursor compound-1

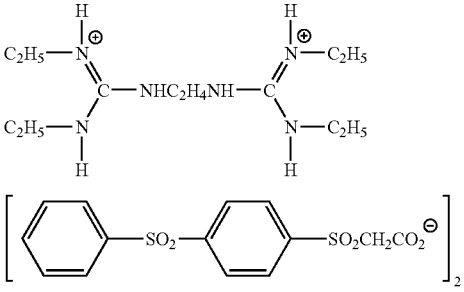

-continued

Cyanine dye compound-1

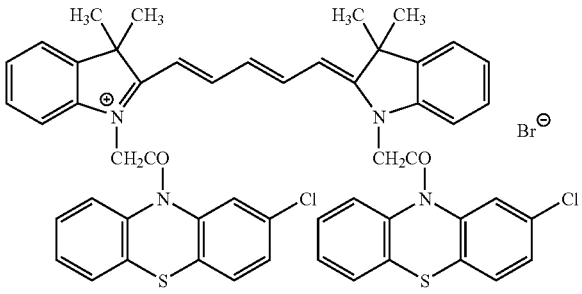

(Reducing agent complex-1)

Complex of

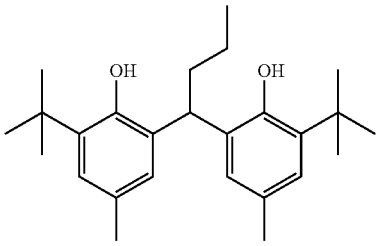

and

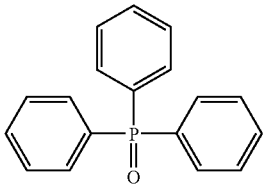

at the ratio of 1:1

(polyhalide-1)

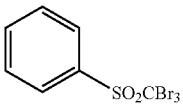

(polyhalide-2)

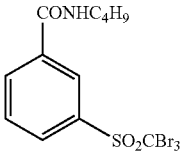

(Phthalazine compound-1)

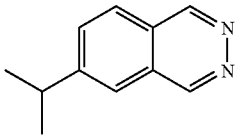

(Development accelerator-1)

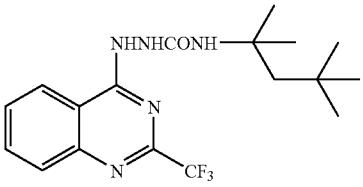

Example 3

(Preparation of PET support), (corona surface treatment) and (preparation of the coating liquid for the photosensitive layer prime coat) were carried out in the same manner as described in the above Example 1.

(Preparation of Coating Liquid for Back Side)

<<Preparation of Solid Micro-Particle Dispersions (a) of Base Precursor>>

The solid micro-particle dispersions for base precursor (a) was prepared in the same manner as described in preparing the solid micro-particle dispersions (a) of base precursor of the above Example 1.

<<Preparation of Dye Solid Micro-Particle Dispersion>>

The dye solid micro-particle dispersion was prepared in the same manner as in preparing the dye solid micro-particle dispersion of the Example 1.

<<Preparation of Back Layer Coating Liquid-B>>

Gelatin G4 (Table 5) 36 g; 1 mol/litter caustic soda 2.2 g; monodispersion polymethylmethacrylate micro-particle (mean particle size of 8 μm, standard deviation of particle size of 0.4) 2.4 g; benzoisothiazolinone 0.08 g; the above dye solid micro-particle dispersion 35.9 g; the above solid micro-particle dispersion (a) of base precursor 74.2 g; polyethylene sodium sulfonate 0.6 g; blue dye compound-2 0.21 g; acrylic acid/ethyacrylatecopolymer latex (copolyermization ratio 5/95) 8.2 g; N,N-ethylene bis (vinylsulfone acetoamide) 2.9 g were mixed with water to give a total quantity of 855 ml, which was designated as back layer coating liquid-B.

<<Preparation of Back Side Protective Layer Coating Liquid-B>>

A vessel was maintained at 40° C., and gelatin G4 (Table 5) 40 g; liquid paraffin emulsion as liquid paraffin 1.5 g; benzoisothiazolinone 35 mg; 5% aqueous solution of disodium sulfosuccinate (ethylhexyl) 10 ml; polystyrene sodium sulfonate 0.60 g; 2% aqueous solution of fluorosurfactant (F-1) 5.4 ml; 2% aqueous solution of fluorosurfactant (F-2) 5.4 ml; acrylic acid/ethylacrylatecopolymer latex (copolymerization ratio 5/95) 6.0 g; and N,N-ethylene bis (vinylsulfone acetoamide) 1.0 g were mixed, to which 1 mol/liter caustic soda was added to adjust pH to 6.9 and water was added to give a total quantity of 977 ml solution. Thus prepared solution was used as a coating liquid for back side protective layer-B.

(Preparation of Silver Halide Emulsion)

<<Preparation of silver halide emulsion 1>>, <<preparation of silver halide emulsion 2>>, <<preparation of silver halide emulsion 3>>, <<preparation of mixed emulsion A for coating liquid>>, <<preparation of aliphatic acid silver dispersion A>>, <<preparation of reducing agent complex-1 dispersion>> and <<preparation of development accelerator-1>> were made in the same manner as described in the above Example 1.

(Preparation of Polyhalide)

<<Preparation of organic polyhalide-1 dispersion>> and <<preparation of organic polyhalide-2 dispersion>> were made in the same manner as described in the above Example 1.

<<Preparation of phthalazine compound-1 solution>> was made in the same manner as described in the above Example 1.

(Preparation of Mercapto Compound)

<<Preparation of mercapto compound-1 solution)) and <<preparation of mercapto compound-2 solution>> were made in the same manner as described in the above Example 1.

(Preparation of pigment-1 dispersion), (preparation of SBR latex solution), (SBR latex:-St(70.0)-Bu(27.0)-AA (3.0)-latex) and (preparation of emulsion layer (photosensitive layer) coating liquid-1) were made in the same manner as described in the above Example 1.

(Preparation of Coating Liquid for Emulsion Side Intermediate Layer)

1000 g of polyvinyl alcohol PVA-205 (manufactured by Kuraray), 272 g of 5% by mass pigment dispersion, 4200 ml of 19% by mass solution of methylmethacrylate/styrene/buthylacrylate/hydroxyethylmethacrylate/acrylic acidcopolymer (copolymerization ratio: 64/9/20) latex, 27 ml of 5% aqueous solution of disodium sulfosuccinate (2-ethyhexyl), 27 ml of 5% by mass aqueous solution of Aerozol OT (American Cyanamid), and 135 ml of 20% by mass aqueous solution of diammonium phthalate were added to water to give a total quantity of 10,000 g. Further, NaOH was added thereto to adjust the pH to 7.5 to prepare the coating liquid for the intermediate layer, which was fed to the coating die so as to give a coating quantity of 9.1 ml/m$^2$.

The viscosity of the coating liquid determined with B-type viscometer at 40° C. (No. 1 rotor, 60 rpm) was 58 [mPa·s].

(Preparation of Coating Liquid for Emulsion Side First Protective Layer)

64 g of inert gelatin was dissolved in 840 ml of water, and 112 g of 19% by mass methylmethacrylate/styrene/buthylacrylate/hydroxyethylmethacrylate/acryl acidcopolymer (copolymerization ratio: 64/9/20/5/2) latex solution, 30 ml of 15% by mass phthalic acid methanol solution, 23 ml of 10% by mass 4-methyl phthalate solution, 5.4 ml of 5% by mass aqueous solution of disodium sulfosuccinate (2-ethyhexyl), 28 ml of 0.5 mol/liter concentration sulfuric acid solution, 5 ml of 5% by mass aqueous solution of Aerozol OT (American Cyanamid), 0.5 g of phenoxy ethanol and 0.1 g of benzoisothiazolinone were mixed and added to water to give a total quantity of 750 g coating liquid. Immediately before coating, 26 ml of 4% by mass chrome alum was mixed with the coating liquid by using a static mixer, which was fed to the coating die so as to give a coating quantity of 18.6 ml/m$^2$. The viscosity of the coating liquid determined with B-type viscometer at 40° C. (No. 1 rotor, 60 rpm) was 20 [mPa·s].

(Preparation of Coating Liquid for Emulsion Side Second Protective Layer)

80 g of inert gelatin was dissolved in water, and 102 g of 27.5% by mass methylmethacrylate/styrene/buthylacrylate/hydroxyethylmethacrylate/acryl acidcopolymer (copolymerization ratio: 64/9/20/5/2) latex solution, 5.4 ml of 2% by mass fluorosurfactant (F-1) solution, 5. 4 ml of 2% by mass aqueous solution of fluorosurfactant (F-2), 28 ml of 5% by mass aqueous solution of disodium sulfosuccinate (2-ethyhexyl), 23 ml of 5% by mass aqueous solution of Aerozol OT (American Cyanamid), 4 g of polymethylmethacrylate micro-particle (0.7 μm mean particle size), 21 g of polymethylmethacrylate micro-particle (4.5 μm mean particle size), 1.6 g of 4-methyl phthalate, 4.8 g of phthalic acid, 44 ml of 0.5 mol concentration sulfuric acid and 10 mg of benzoisothiazolinone were mixed and added to water to give a total quantity of 650 g solution. Immediately before coating, 445 ml of aqueous solution containing 4% by mass chrome alum and 0.67% by mass phthaic acid was mixed by using a static mixer to obtain the coating liquid for surface protective layer, which was fed to the coating die so as to give a coating quantity of 8.3 ml/m$^2$.

The viscosity of the coating liquid determined with B-type viscometer at 40° C. (No. 1 rotor, 60 rpm) was 19 [mPa·s].

(Preparation of Photothermographic Material 2-1)

Both sides of the support coated with 175 μm-thick polyethylene terephthalate prepared on a two-axis drawing were respectively subjected to corona treatment. Then, the back layer coating liquid-B and the back side protective layer coating liquid-B were subjected to multilayered coating at the same time on the back pane of the above prime coat support so as to give the respective gelatin coating quantities of 0.52 g/m$^2$ and 1.7 g/m$^2$ and dried to prepare the back layers.

A multilayered-coating was given by slide bead coating method to the surface opposite to the back side in the order of the prime coat layer, emulsion layer, intermediate layer, first protective layer and second protective layer starting from the layer closer to the support to prepare the photothermographic material 2-1. In this instance, the emulsion layer and intermediate layer were adjusted to 31° C., the first protective layer was to 36° C., and the second protective layer was to 37° C.

The following shows the coating quantities (g/m$^2$) for the individual compounds of the emulsion layer.

| | |
|---|---|
| Silver behenate | 5.58 |
| Pigment (C.I. Pigment Blue 60) | 0.036 |
| Polyhalide-1 | 0.12 |
| Polyhalide-2 | 0.37 |
| Phthalazine compound-1 | 0.19 |
| SBR latex | 9.98 |
| Reducing agent compound-1 | 1.41 |
| Development accelerator-1 | 0.025 |
| Mercapto compound-1 | 0.002 |
| Mercapto compound-2 | 0.012 |
| Silver halide (as Ag) | 0.091 |

The coating and drying were conducted as follows.

The coating was carried out at the feeding rate of 160 m/minute, clearance between the tip of the coating die and the support maintained at 0.10 to 0.30 mm and pressure at the decompression chamber set less by 196 to 882 Pa in relation to atmospheric pressure. The support was subjected to ion aeration to remove static electricity before coating.

At the subsequent chilling stage, the coating liquid was cooled through aeration at dry-bulb temperature of 10 to 20° C. It was fed under non-contacting conditions and dried by using a coiled-type non-contacting drier through aeration at dry-bulb temperature of 23 to 45° C. and wet-bulb temperature of 15 to 21° C.

After drying, the liquid was adjusted for moisture at 25° C. and 40 to 60% RH, and then heated so that the surface reached 70 to 90° C. After heating, the surface was cooled to 25° C.

The photothermographic material 2-1 was prepared as follows.

(Preparation of the Photothermographic Materials 2-2 to 2-18)

These samples were prepared in the same manner as in preparing the photothermographic material 2-1 except that the latex species of the back layer coating liquid and the latex species of the coating liquid for the back side protective layer were changed so as to give the compositions shown in Table 6 when the back layer coating liquid-B and back side protective layer coating liquid-B were subjected to multilayered coating in preparing the photothermographic material 2-1 and that the coating quantity of the coating liquid for the back side protective layer used in the sample 2-5 was only changed in preparing the samples 2-6 and 2-7.

Further, the samples of 2-2 to 2-4 and 2-7 to 2-16 were prepared in the same manner as in preparing the photothermographic material 2- 1, except that the gelatin coating quantity of the image forming side layer was changed only for the gelatin contained in the coating liquid of the emulsion first protective layer and the second protective layer so as to give the weight as shown in Table 6. The ratio of the gelatin coating quantity of the coating liquid for the emulsion first protective layer and the second protective layer was the same as the ratio used in the samples 2-1 to 2-16.

Table 5 shows the raw materials, production methods and isoelectric points for the gelatins.

The degree of matting expressed by Bekk smoothness of Thus obtained photothermographic materials 2-1 to 2-18 was found to be 550 seconds for the image forming layer side and 130 seconds for the back side. The surface of the image forming layer side was found to be pH 6.0, and the surface of the back layer was found to be pH 6.6.

[Evaluation of Over-Time Storage Stability]

The prepared samples were cut by half and warped at 25° C. and 40% RH for 2 weeks in the following packaging materials to make the following evaluation.

[Packaging Material]

PET 10 μm/PE 12 μm/aluminum foil 9 μm/Ny 15 μm/3% carbon-containing PE 50 μm

Oxygen permeability: 0 ml/atm·$m^2$·day (25° C.)

Moisture permeability: 0 g/atm·$m^2$·day (25° C.)

<Evaluation of Color Remaining>

The samples were exposed and heat-developed for a total of 14 seconds over 4 panel heaters respectively set at 112° C., 119° C., 121° C. and 121° C. with Fuji Medical Dry Laser Imager-FM-DP L (equipped with a 660-nm semiconductor laser device, maximum output of 60 mWIIIB). Thus obtained images were determined for color remaining of the back layer dye. Table 6 shows the evaluation criteria given in relative values on the basis of the sample 2-1 whose color remaining was designated as 100. The smaller value shows a lower color remaining.

The color remaining was measured using a densitometer (X-Rite310 manufactured by X-Rite).

A site 1 cm apart from the edge of each sample of the photosensitive material was measured for cyano color density of every 10 pieces of the samples under transmitted light. Table 6 shows the relative values on the basis of the mean value (the mean value of the sample 2-1 was defined as 100) obtained by calculating the mean value of the cyano color remaining on the back side from 10 site determinations for each sample, with the cyano density defined as zero when the back side was removed.

TABLE 5

| Name of gelatin | Raw material | Production method | Isoelectric point |
|---|---|---|---|
| G4 | Beef bones | Lime treatment | 4.80 |
| G5 | Beef bones | Combined use of caustic soda and acid treatment | 6.60 |
| G6 | Beef bones | Combined use of lime treatment and acid treatment | 7.30 |

TABLE 6

| Sample No. | Latex for back layer/Tg | Latex for back side protective layer/Tg | Coating quantity of gelatin for back side: B | Coating quantity of gelatin for image forming layer: E | Gelatin coating quantity ratio: B/E | Color remaining property | Remarks |
|---|---|---|---|---|---|---|---|
| 2-1 | EA(95)AA(5)/ −20° C. | EA(95)AA(5)/ −20° C. | 2.22 | 2.14 | 1.04 | 100 | Control |
| 2-2 | EA(95)AA(5)/ −20° C. | EA(95)AA(5)/ −20° C. | 2.22 | 1.20 | 1.85 | 99 | Control |
| 2-3 | B-6/18° C. | B-6/18° C. | 2.22 | 1.20 | 1.85 | 101 | Present invention |
| 2-4 | B-6/18° C. | B-6/18° C. | 2.22 | 1.75 | 1.25 | 74 | Present invention |
| 2-5 | B-6/18° C. | B-6/18° C. | 2.22 | 2.14 | 1.04 | 56 | Present invention |
| 2-6 | B-6/18° C. | B-6/18° C. | 1.60 | 2.14 | 0.75 | 63 | Present invention |
| 2-7 | B-6/18° C. | B-6/18° C. | 1.60 | 2.90 | 0.55 | 87 | Present invention |
| 2-8 | B-6/18° C. | B-6/18° C. | 2.22 | 2.90 | 0.77 | 68 | Present invention |
| 2-9 | B-6/18° C. | B-9/40° C. | 2.22 | 2.90 | 0.77 | 53 | Present invention |
| 2-10 | B-6/18° C. | B-12/70° C. | 2.22 | 2.90 | 0.77 | 75 | Present invention |

TABLE 6-continued

| Sample No. | Latex for back layer/Tg | Latex for back side protective layer/Tg | Coating quantity of gelatin for back side: B | Coating quantity of gelatin for image forming layer: E | Gelatin coating quantity ratio: B/E | Color remaining property | Remarks |
|---|---|---|---|---|---|---|---|
| 2-11 | B-6/18° C. | B-14/50° C. | 2.22 | 2.90 | 0.77 | 50 | Present invention |
| 2-12 | B-1/61° C. | B-1/61° C. | 2.22 | 1.75 | 1.25 | 83 | Present invention |
| 2-13 | B-3/47° C. | B-3/47° C. | 2.22 | 1.75 | 1.25 | 80 | Present invention |
| 2-14 | B-4/14° C. | B-4/14° C. | 2.22 | 1.75 | 1.25 | 80 | Present invention |
| 2-15 | B-9/40° C. | B-9/40° C. | 2.22 | 1.75 | 1.25 | 71 | Present invention |
| 2-16 | B-12/70° C. | B-12/70° C. | 2.22 | 1.75 | 1.25 | 82 | Present invention |

As apparent from the results of Table 6, the samples 2-4 to 2-16 in which polymer latex with −10° C. or higher and 120° C. or less were used and the gelatin coating quantity (back side/image forming side) was 0.5 to 1.5 were found excellent in color remaining.

Example 4

<<Preparation of the Photothermographic Materials of the Invention 2-17 to 2-22>>

The photothermographic materials of the invention 2-17 to 2-22 were prepared in the same manner as in preparing the photothermographic materials 2-11 except that the coating quantity of latex for the back layer and back side protective layer as well and the gelatin species for the back layer were changed as shown in Table 7.

As apparent from the results of Table 7, the samples in which the coating quantity of polymer latex on the back side was 20 to 40% by mass in relation to gelatin coating quantity and polymer latex content of the back layer was higher than the polymer latex content of back side protective layer or the samples having gelatine specied for the back layer at isoelectric points of 5.0 to 9.5 were found particularly excellent in color remaining.

The following are the chemical structures of the compounds used in the Example of the invention.

Spectral sensitization dye A, spectral sensitization dye B, tellurium sensitizer C, base precursor compound, cyanine dye compound-1, reducing agent complex-1, polyhalide-1, polyhalide-2, phthalazine compound-1, and development accelerator-1 were the same as those described in the above Examples 1 and 2.

TABLE 7

| Sample No. | Gelatin for back layer/ Tg | Ratio of latex quantity for back layer to gelatin quantity for back layer (%) | Ratio of latex quantity for back side protective layer to gelatin quantity for back side protective layer (%) | Ratio of total latex quantity for back side to total gelatin quantity for back | Color remaining property | Remarks |
|---|---|---|---|---|---|---|
| 2-8 | G4 | 22.8 | 15 | 16.8 | 68 | Present invention |
| 2-17 | G4 | 22.8 | 30 | 28.3 | 62 | Present invention |
| 2-18 | G4 | 45.6 | 30 | 33.7 | 56 | Present invention |
| 2-19 | G5 | 22.8 | 30 | 28.3 | 51 | Present invention |
| 2-20 | G6 | 22.8 | 30 | 28.3 | 48 | Present invention |
| 2-21 | G5 | 45.6 | 30 | 33.7 | 45 | Present invention |
| 2-22 | G6 | 45.6 | 30 | 33.7 | 45 | Present invention |

Blue dye compound-2

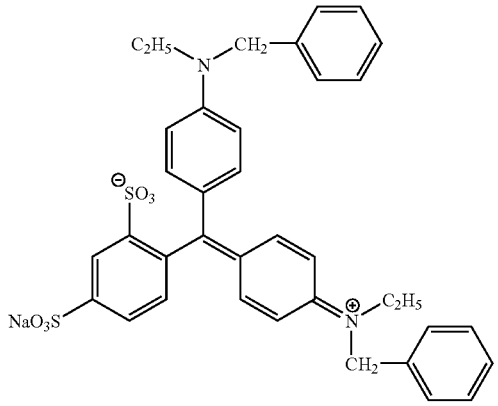

(F-1)

$CF_3—(CF_2)_n—CH_2CH_2SCH_2CH_2CO_2Li$

Mixture with n = 5 to 11

(F-2)

$CF_3—(CF_2)_n—CH_2CH_2O—(CH_2CH_2O)_m—H$

Mixture with n = 5 to 11, m = 5 to 15

Example 5

(Preparation of PET support) and (corona treatment surface) were carried out in the same manner as described in the above Example 1.

(Preparation of Prime Coat Support)

| <<Prescription (1) prime coat liquid for photosensitive layer>> | |
|---|---|
| PES resin A-520 (30% by mass solution) manufactured by Takamatsu Oil and Fat Co., Ltd. | 59 g |
| Polyethylene glycol mono-nonylphenyl ether (Mean ethylene oxide number = 8.5) 10% by mass solution | 5.4 g |
| MP-1000, micro-particle, particle size 0.4 μm (Soken Chemical and Engineering Co., Ltd.) | 0.91 g |
| Distilled water | 935 ml |
| Prescription (2) (back side first layer) | |
| Styrene butadienecopolymer latex (40% by mass on dry solid basis. Styrene butadiene mass ratio = 68/32) | 158 g |
| 2,4-dichloro 6-hydroxy-S-triazine sodium, 8% by mass aqueous solution | 20 g |
| 8% by mass aqueous solution | 20 g |
| 1% by mass aqueous solution of lauryl benzene sulfonic sodium | 10 ml |
| Distilled water | 854 ml |
| Prescription (3) (back side second layer) | |
| $SnO^2$/SbO (9/1 mass ratio, mean particle size 0.038 μm, 17% by mass dispersion) | 84 g |
| Gelatin (10% by mass aqueous solution) | 89.2 g |
| Metolose TC-5 (2% by mass aqueous solution), manufactured by Shin-Etsu Chemical Co., Ltd.) | 8.6 g |
| MP-1000, Soken Chemical and Engineering Co., Ltd. | 0.01 g |
| 1% by mass aqueous solution of dodecylbenzene sulfonic sodium | 10 ml |
| NaOH (1% by mass) | 6 ml |
| Proxel, manufactured by ICI) | 1 ml |
| Distilled water | 805 ml |

Both sides of the support coated with 175 μm-thick polyethylene terephthalate prepared on a two-axis drawing were respectively subjected to corona treatment, then, the prescription of prime coat liquid (1) was coated on one side of the support (image forming layer) with a wire bar so as to give 6.6 ml/$m^2$ (for one side) in terms of wet coated quantity and dried at 180° C. for 5 minutes, then the prescription of prime coat liquid (2) was coated on the other side of the support (back side) with a wire bar so as to give 5.7 ml/$m^2$ in terms of wet coat quantity and dried at 180° C. for 5 minutes, and the prescription of prime coat liquid (3) was coated on the back of the support (back side) with a wire bar so as to give 7.7 ml/$m^2$ in terms of wet coat quantity and dried at 180° C. for 6 minutes to fabricate the prime coat support.

(Preparation of Back Side Coating Liquid)

<<Preparation of solid micro-particle dispersion solution (a) for base precursor>> and <<preparation of dye solid micro-particle dispersion>> were made in the same manner as described in the above Example 1.

<<Preparation of Back Layer Coating Liquid-C>>

Gelatin G7 (Table 8) 36 g; 1 mol/liter caustic soda 2.2 g; monodispersion polymethylmethacrylate micro-particle (mean particle size 8 μm, standard deviation of particle size, 0.4 μm) 2.4 g; benzoisothiazolinone, 0.08 g; the above dye solid micro-particle dispersion, 35.9 g; the solid micro-particle dispersion (a) of the above base precursor, 74.2 g; polystyrene sodium sulphonate, 0.6 g; blue dye compound-2, 0.21 g; acrylic acid/ethylacrylatecopolymer latex (copolymerization ratio 5/95), 8.2 g; and N,N-ethylene bis (vinyl suflone acetoamide), 2.9 g were mixed with water to give a total quantity of 855 ml. Thus prepared solution was used as a coating liquid for the anti-halation layer.

<<Preparation of Coating Liquid for Back Side Protective Layer-C>>

The vessel was maintained at 40° C., and gelatin G7 (Table 8) 40 g; liquid paraffin emulsion as liquid paraffin 1.5 g; benzothiazolinone, 35 mg; t-octylphenoxyethoxyethane sodium sulphonate 0.5 g; polystyrene sodium sulfonate, 0.27 g; 2% aqueous solution of fluorosurfactant (F-3), 5.4 ml; 2% aqueous solution of fluorosurfactant (F-4), 5.4 ml; acrylic acid/ethylacrylatecopolymer latex (copolymerization ratio 5/95), 6.0 g; and N,N-ethylene bis (vinyl suflone acetoamide), 1.0 g were mixed, and 1 mol/l caustic soda was added to adjust pH to 6.9. Then, water was added thereto to give a total quantity of 977 ml. Thus prepared solution was used as a coating liquid for back side protective layer-C.

(Preparation of Silver Halide Emulsion)

<<Preparation of silver halide emulsion 1>>, <<preparation of silver halide emulsion 2>>, <<preparation of silver halide emulsion 3>>, <<preparation of mixed emulsion A for coating liquid>> and <<preparation of aliphatic silver dispersion A>> were made in the same manner as described in the above Example 1.

<<Preparation of Aliphatic Acid Silver Dispersion B>>

<Preparation of Recrystalized Behenic Acid>

100 kg of behenic acid (brand name: Edenor C22-85R, manufactured by Henkel) was mixed with 1200 kg of isopropyl alcohol and dissolved at 50° C. The resultant was filtered through 10 μm-filter and then cooled down to 30° C. to cause recrystallization. The mixture was controled to be cooled at 3° C. for every hour on recrystallization. Thus obtained crystalline substance was subjected to centrifugal filtration and washed with 100 kg of isopropyl alcohol, and then dried. The obtained crystal was esterified to determine GC-FID, finding that behenic acid was contained in 96% in addition to lignoceric acid of 2% and arachidic acid of 2%.

<Preparation of Aliphatic Acid Silver Dispersion B>

88 kg of recrsytalline behenic acid, 422 liter of distilled water, 49.2 liter of NaOH solution (5 mol/liter concentration) and 120 liter of t-butyl alcohol were mixed and allowed to react at 75° C. for 1 hour by stirring to obtain sodium behenic acid solution B. Separately, 40.4 kg of silver nitrate was dissolved in water to prepare 206.2 liter of silver nitrate solution (pH 4.0), which was maintained at 10° C. A reaction vessel containing 635 liter of distilled water and 30 liter of t-butyl alcohol was maintained at 30° C., to which the sodium behenic acid solution B and silver nitrate aqueous solution were added in a whole quantity at a constant flow rate for 93 minutes and 15 seconds and 90 minutes respectively, with sufficient stirring. In this instance, care was taken so that only silver nitrate solution was added for 11 minutes after start of such addition, and only sodium behenic acid solution B was added for 14 minutes and 15 seconds after completed addition of silver nitrate solution. Ambient temperatures were controlled so that the liquid was maintained constantly at 30° C. inside the reaction vessel. Sodium behenic acid solution B was added through a double-layered pipe system, through the outer layer of which warm water was circulated to keep warm, so that the solution temperature at the outlet was maintained at 75° C. at the tip of the nozzle for adding the aqueous solution. Silver nitrate solution was added through a double-layered pipe system, through the outer layer of which cold water was circulated to keep the temperature constant. The positions at which sodium behenic acid solution B and silver nitrate aqueous solution were added in a symmetrical position in relation to the center of the axis of the stirrer. The height was also adjusted in deciding the position so as not to contact with the reaction solution.

After addition of sodium behenic acid solution B, the resultant was allowed to stand for 20 minutes, with the temperature maintained as it was. Then, the temperature was elevated to 35° C. in 30 minutes and the resultant was aged for 210 minutes. Immediately after the completed aging, the resultant was subjected to centrifugal filtration the solid, which was washed with water until the conductivity of filtrate reached 30 μS/cm. Aliphatic acid silver salt was obtained through these processes. The separated solid was not subjected to drying but maintained as wet cake.

Evaluation with the electron microscopic photography was made for the configuration of thus obtained silver behenate particle, observing that it was scaly crystal having a=0.21 μm, b=0.4 μm and c=0.4 μm on average, mean aspect ratio of 2.1, mean sphere equivalent diameter of 0.51 μm and coefficient variation of the sphere equivalent diameter of 11%. (a, b and c were defined in the text).

19.3 kg of polyvinyl alcohol (product name: PVA-217) and water were added to the wet cake (equivalent to 260 kg of dry solid) to give a total quantity of 1000 kg. The resultant was converted into slurry by using a dissolver blade and preliminarily dispersed by using a pipeline mixer (PM-10 model, manufactured by Mizuho Industrial Co., Ltd.)

Then, thus preliminarily dispersed bulk solution was treated 3 times by using a disperser (product name: Microfluidizer-M-610, manufactured by Microfluidex International Corporation, use of Z model interaction chamber), with the pressure of the disperser adjusted to 1150 kg/cm$^2$, to obtain silver behenate dispersion. In the cooling operation, coiled heat exchangers were fixed before and after the interaction chamber respectively to adjust the temperature of coolant so that the dispersion temperature was at 18° C.

(Preparation of Reducing Agent Dispersion)

<<Preparation of reducing agent complex -1 dispersion>> was made in the same manner as described in the above Example 1.

<<Preparation of Reducing Agent-2 Dispersion>>

10 kg of reducing agent-2

(6,6'-di-t-butyl-4,4'-dimethyl-2,2'-butylidenediphenol) and 16 kg of aqueous solution (10% by mass) of modified polyvinyl alcohol (Poval MP203, manufactured by Kuraray Co., Ltd.) were added to 10 kg of water and mixed well to prepare a slurry. The slurry was fed with a diaphragm pump and subjected to 3-hour and 30-minute dispersion by using a horizontal sand mill (UVM-2: manufactured by Imex) in which zirconia beads (0.5 mm in mean diameter) were packed, and then 0.2 g of benzoisothiazolinone sodium and water were added to adjust the concentration of the reducing agent to 25% by mass. The dispersion was subjected to heat treatment at 60° C. for 5 hours to obtain the reducing agent-2 dispersion. A reducing agent particle contained in the Thus obtained reducing agent dispersion was 0.40 μm in the median diameter and 1.5 μm or less in the maximum particle size. The reducing agent dispersion was filtered through 3.0 μm-pore size polypropylene filter to remove foreign matters such as residues for subsequent retention.

<<Preparation of Hydrogen Bond Compound-1 Dispersion>>

10 kg of hydrogen bond compound-1 (tri-(4-t-butylphenyl) phosphine oxide) and 16 kg of aqueous solution (10% by mass) of modified polyvinyl alcohol (Poval MP203, manufactured by Kuraray Co., Ltd.) were added to 10 kg of water and mixed well to prepare a slurry. The slurry was fed with a diaphragm pump and subjected to 3-hour and 30-minute dispersion by using a horizontal sand mill (UVM-2: manufactured by Imex) in which zirconia beads (0.5 mm in mean diameter) were packed, and then 0.2 g of benzoisothiazolinone sodium and water were added to adjust the concentration of the hydrogen bond compound to 25% by mass. The dispersion was subjected to heat treatment at 80° C. for 1 hour to obtain the hydrogen bond compound 1 dispersion. A hydrogen bond compound particle contained in the thus obtained hydrogen bond compound dispersion was 0.35 μm in the median diameter and 1.5 μm or less in the maximum particle size. The hydrogen bond compound dispersion was filtered through 3.0 μm-pore size polypropylene filter to remove foreign matters such as residues for subsequent retention.

<<Preparation of development accelerator-1 dispersion>> was made in the same manner as described in the above Example 1.

The solid dispersion of the development accelerator-2 and of color tone modifier-1 was prepared to obtain a 20% by mass dispersion solution in the same manner as in preparing the development accelerator- 1.

(Preparation of Polyhalide)

<<Preparation of organic polyhalide-1 dispersion>> and <<preparation of organic polyhalide-2 dispersion>> were made in the same manner as in preparing the above Example 1.

<<Preparation of phthaladine compound-1 solution>> was prepared in the same manner as described in the above Example 1.

(Preparation of Mercapto Compound)

<<Preparation of mercapto compound-1 solution>> and <<preparation of mercapto compound-2 solution>> were prepared in the same manner as described in the above Example 1.

(Preparation of pigment-1 dispersion), (preparation of SBR latex solution) and (SBR latex:-St(70.0)-Bu(27.0)-AA(3.0)-latex) were prepared in the same manner as described in the above Example 1.

(Preparation of Coating Liquid-1 for (Emulsion Layer (Photosensitive Layer))

The coating liquid-1 for emulsion layer (photosensitive layer) was prepared in the same manner as described in the above Example 1.

Zircocium content in the coating liquid was 0.38 mg per gram of silver.

<<Preparation of Coating Liquid-2 Emulsion Layer (Photosensitive Layer)>>

1000 g of aliphatic acid silver dispersion obtained above, 276 ml of water, 35 g of pigment-1 dispersion, 32 g of organic polyhalide-1 dispersion, 46 g of organic polyhalide-2 dispersion, 173 g of phthalazine compound-1 solution, 1082 g of SBR latex (Tg: 20° C.) solution, 153 g of reducing agent-2 dispersion, 55 g of hydrogen bond compound-1 dispersion, 4.8 g of development accelerator-1 dispersion, 5.2 g of development accelerator-2 dispersion, 2.1 g of color tone modifier-1 dispersion and 8 ml of mercapto compound-2 solution were sequentially added. 140 g of silver halide emulsion A was added to the mixture and mixed well. Immediately before coating, the coating liquid for the emulsion layer was directly fed to the coating die for coating.

The viscosity of the coating liquid for the above emulsion layer was determined with B-type viscometer (Tokyo Keiki) to find 40 [mPa·s] at 40° C. (No. 1 rotor, 60 rpm).

RFS fluid spectrometer (manufactured by RHEOMETRICS FAR EAST LTD.) was used to determine the viscosities of the coating liquid at 25° C. at the shear rate of 0.1, 1, 10, 100 and 1000 [1/second], which were respectively 530, 144, 96, 51, and 28 [mPa·S].

Zircocium content in the coating liquid was 0.25 mg per gram of silver.

(Preparation of Coating Liquid for Emulsion Side Intermediate Layer)

1000 g of polyvinyl alcohol, PVA-205, (manufactured by Kuraray), 272 g of 5% by mass pigment dispersion, 4200 ml of 19% by mass solution of methylmethacrylate/styrene/buthylacrylate/hydroxyethylmethacrylate/acrylic acidcopolymer (copolymerization ratio: 64/9/20/5/2) latex, 27 ml of 5% by mass aqueous solution of Aerozol OT (American Cyanamid), 135 ml of 20% by mass aqueous solution of diammonium phthalate were added to water to give a total quantity of 10,000 g. Further, NaOH was added thereto to adjust the pH to 7.5 to prepare the coating liquid for the intermediate layer, which was fed to the coating die so as to give a coating quantity of 9.1 ml/m$^2$.

The viscosity of the coating liquid determined with B-type viscometer at 40° C. (No. 1 rotor, 60 rpm) was 58 [mPa·s].

(Preparation of Coating Liquid for Emulsion Side First Protective Layer)

64 g of inert gelatin was dissolved in water, and 112 g of 19% by mass methylmethacrylate/styrene/buthylacrylate/hydroxymethacrylate/acryl acid copolymer (copolymerization ratio: 64/9/20/5/2) latex solution, 30 ml of 15% by mass phthalic acid methanol solution, 23 ml of 10% by mass 4-methyl phthalate solution, 28 ml of 0.5 mol/L concentration sulfuric acid solution, 5 ml of 5% by mass aqueous solution of Aerozol OT manufactured by American Cyanamid, 0.5 g of phenoxy ethanol and 0.1 g of benzoisothiazolinone were mixed and added to water to give a total quantity of 750 g coating liquid. Immediately before coating, 26 ml of 4% by mass chrome alum was mixed with the coating liquid by using a static mixer, which was fed to the coating die so as to give a coating quantity of 18.6 ml/m$^2$.

The viscosity of the coating liquid determined with B-type viscometer at 40° C. (No. 1 rotor, 60 rpm) was 20 [mPa·s].

(Preparation of Coating Liquid for Emulsion Side Second Protective Layer)

80 g of inert gelatin was dissolved in water, and 102 g of 27.5% by mass methylmethacrylate/styrene/buthylacrylate/hydroxymethacrylate/acrylic acid copolymer (copolymerization ratio: 64/9/20/5/2) latex solution, 5.4 ml of 2% by mass fluorosurfactant (F-3) solution, 5.4 ml of 2% by mass fluorosurfactant (F-4) solution, 23 ml of 5% by mass aqueous solution of Aerozol OT manufactured by American Cyanamid, 4 g of polymethylmethacrylate micro-particle (0.7 μm mean particle size), 21 g of polymethylmethacrylate micro-particle (4.5 μm mean particle size), 1.6 g of 4-methyl phthalate, 4.8 g of phthalic acid, 44 ml of 0.5 mol concentration sulfuric acid and 10 mg of benzoisothiazolinone were mixed and added to water to give a total quantity of 650 g solution. Immediately before coating, 445 ml of aqueous solution containing 4% by mass chrome alum and 0.67% by mass phthaic acid was mixed by using a static mixer to obtain the coating liquid for surface protective layer, which was fed to the coating die so as to give a coating quantity of 8.3 ml/m$^2$.

The viscosity of the coating liquid determined with B-type viscometer at 40° C. (No. 1 rotor, 60 rpm) was 19 [mPa·s].

(Preparation of Photothermographic Material 3-1)

The back layer coating liquid-C and the back side protective layer coating liquid-C were applied at the same time on the back pane of the above prime coat support so as to give the respective gelatin coating quantities of 0.52 g/m$^2$ and 1.7 g/m$^2$ and dried to prepare the back layers.

A multi-coating was given by slide bead coating method to the surface opposite to the back side in the order of the emulsion layer, intermediate layer, first protective layer and second protective layer starting from the prime coat layer to prepare the samples of photothermographic material. In this instance, the emulsion layer and intermediate layer were adjusted to 31° C., the first protective layer was to 36° C., and the second protective layer was to 37° C.

The following shows the coating quantities (g/m$^2$) for the individual compounds for the emulsion layer.

| | |
|---|---|
| Silver behenate | 5.58 |
| Pigment (C.I. Pigment Blue 60) | 0.036 |
| Polyhalide-1 | 0.12 |
| Polyhalide-2 | 0.37 |
| Phthalazine compound-1 | 0.19 |
| SBR latex | 9.98 |
| Reducing agent compound-1 | 1.41 |
| Development accelerator-1 | 0.025 |
| Mercapto compound-1 | 0.002 |
| Mercapto compound-2 | 0.012 |
| Silver halide (as Ag) | 0.091 |

The coating and drying were conducted as follows.

The coating was carried out at the feeding rate of 160 m/minute, clearance between the tip of the coating die and the support maintained at 0.10 to 0.30 mm and pressure at the decompression chamber set less by 196 to 882 Pa in relation to atmospheric pressure. The support was subjected to ion aeration to remove static electricity.

At the subsequent chilling stage, the coating liquid was cooled through aeration at a dry-bulb temperature of 10 to 20° C. It was fed under non-contacting conditions and dried by using a coiled-type non-contacting drier through aeration at a dry-bulb temperature of 23 to 45° C. and wet-bulb temperature of 15 to 21° C. After drying, the liquid was adjusted for moisture at 25° C. and 40 to 60% RH, and then heated so that the surface reached 70 to 90° C. After heating, the surface was cooled to 25° C.

As explained, the photothermographic material 3-1 was prepared.

(Preparation of Photothermographic Materials 3-2 to 3-10 of the Invention)

The samples of the photothermographic material 3-2 to 3-10 of the invention were prepared in the same manner as in preparing the photothermographic material 3-1 except that the gelatin and polymer with the temperature of −10° C. or higher and 120° C. or less (polymer latex) contained in the back layer coating liquid-C and back side protective layer coating liquid C were changed as shown in Table 9 in preparing the photothermographic material 3-1.

Table 8 shows raw materials, production methods and isoelectric points of the gelatins.

The degree of matting expressed by Bekk smoothness of Thus obtained photothermographic material 3-1 to 3-10 was found to be 550 seconds for the photosensitive side side and 130 seconds for the back side. The film surface of the photosensitive side side was found to be pH 6.0, and the surface of the back layer was found to be pH 6.6.

(Evaluation of Over-Time Storage Stability)

The prepared samples were cut in half and wraped at 25° C. and 40% RH in the following packaging materials, stored for 2 weeks at ambient temperatures to make the following evaluation.

[Packaging Material]

PET 10 μm/PE 12 μm/aluminum foil 9 μm/Ny 15 μm/3% carbon-containing PE 50 μm

Oxygen permeability: 0 ml/atm·m$^2$·day (25° C.)

Moisture permeability: 0 g/atm·m$^2$·day (25° C.)

<Evaluation of Color Remaining>

The samples were exposed and heat-developed for a total of 14 seconds over 4 panel heaters respectively set at 112° C., 119° C., 121° C. and 121° C. with Fuji Medical Dry Laser Imager-FM-DPL (equipped with a 660 nm semiconductor laser device, maximum output of 60 mW (III B). Thus obtained images were determined for color remaining of the back layer dye at Dmin area (minimum density area). Table 9 shows the evaluation criteria given in relative values on the basis of the sample 3-1 whose color remaining was designated as 100. The smaller value shows a lower color remaining.

<Evaluation of Thermal Stability of the Back Layer Dye>

The samples sealed at 25° C. and 40% RH were stored for 20 days in a storage tester whose temperature was set at 40° C. And, the thermal stability was evaluated by referring to the percentage of the absorption measured at the standard wavelength 660 nm of the dye after heating in relation to the absorption measured at the same wavelength before storage. Table 9 shows the test results of individual samples.

TABLE 8

| Name of Gelatin | Raw material | Production method | Isoelectric point |
|---|---|---|---|
| G7 | Beef bones | Lime treatment | 4.80 |
| G8 | Beef bones | Combined use of lime treatment and acid treatment | 6.50 |
| G9 | Pig skin | Combined use of lime treatment and acid treatment | 7.10 |

TABLE 9

| Sample No. | Gelatin for back layer | Latex species for back layer/Tg | Latex species for back side protective layer | Color remaining property | Thermal-stability of back side absorption |
|---|---|---|---|---|---|
| 3-1 | G7 | EA(95)AA(5)/ −20° C. | EA(95)AA(5)/ −20° C. | 100 (Standard) | 80% |
| 3-2 | G7 | EA(95)AA(5)/ −20° C. | B-14/50° C. | 85 | 85% |
| 3-3 | G7 | B-14/50° C. | B-14/50° C. | 85 | 96% |
| 3-4 | G7 | B-4/14° C. | B-14/50° C. | 55 | 95% |
| 3-5 | G7 | B-6/18° C. | B-14/50° C. | 50 | 96% |
| 3-6 | G7 | B-8/31° C. | B-14/50° C. | 55 | 98% |
| 3-7 | G8 | B-4/14° C. | B-14/50° C. | 35 | 90% |
| 3-8 | G8 | B-6/18° C. | B-14/50° C. | 25 | 92% |
| 3-9 | G8 | B-12/70° C. | B-14/50° C. | 30 | 96% |
| 3-10 | G9 | B-4/14° C. | B-14/50° C. | 25 | 90% |
| 3-11 | G9 | B-6/18° C. | B-14/50° C. | 20 | 93% |
| 3-12 | G9 | B-11/60° C. | B-14/50° C. | 30 | 98% |

As apparent from the results of Table 9, the samples 3-2 to 3-12 were found to be better in color remaining and the thermal stability of absorption of the anti-halation dye than the sample 3-1 having the conventional anti-halation layer.

<Preparation of the Phototerhmographic Material 4-2 to 4-12>

The samples of the photothermographic materials 4-2 to 4-12 were prepared in the same manner as in preparing the samples of photothermographic material 3-2 to 3-12 except that the coating liquid-1 for the emulsion layer was changed to the coating liquid-2 for the emulsion layer and fluorosurfactants F-3 and F-4 for the back side protective layer and emulsion side protective layer were respectively changed to F-5 and F-6 in preparing the photothermographic material-3.

The following shows the coating quantities (g/m$^2$) of the individual compounds for the emulsion layer.

| | |
|---|---|
| Silver behenate | 5.27 |
| Pigment (C.I. Pigment Blue 60) | 0.036 |
| Polyhalide-1 | 0.17 |
| Polyhalide-2 | 0.28 |
| Phthalazine compound-1 | 0.18 |
| SBR latex | 9.43 |
| Reducing agent compound-2 | 0.77 |
| Hydrogen bond compound-1 | 0.28 |
| Development accelerator-1 | 0.019 |
| Development accelerator-2 | 0.020 |
| Color tone modifier-1 | 0.008 |
| Mercapto compound-2 | 0.003 |
| Silver halide (as Ag) | 0.091 |

The samples 4-2 to 4-10 were found to be excellent in color remaining and the thermally stable absorption of the dye, as with the example.

The following shows the chemical structures of the compound used in the invention. The cyanine dye compound-1, phthaladine compound-1, development accelerator-1, reducing agent-1, polyhalide-1 and polyhalide-2 were the same as those used in the above Example 1 and 2, and blue dye compound-2 was the same as that used in the above Example 3 and 4.

Yellow dye compound-1

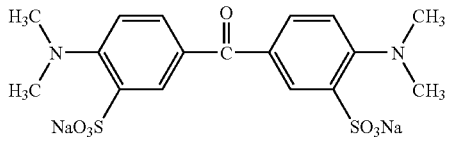

(Development accelerator-2)

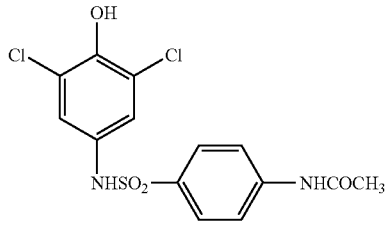

(Development accelerator-3)

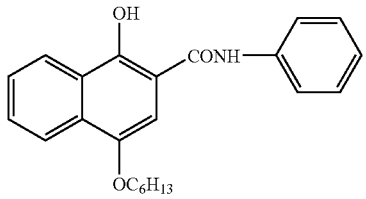

(Color tone modifier-1)

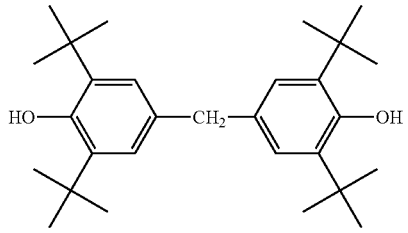

-continued (Reducing agent-2)

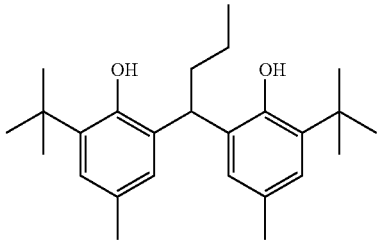

(Hydrogen bond compound)

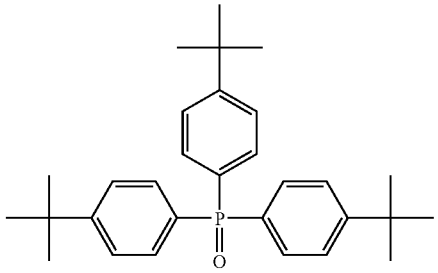

(Mercapto compound-1)

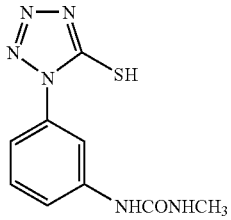

(Mercapto compound-2)

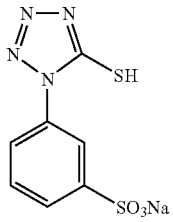

(F-3)

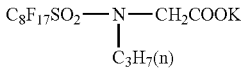

(F-4)

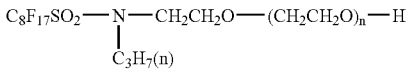

n = 15 (mean)

(F-5)

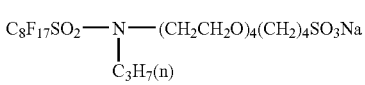

(F-6)

An object of the invention is to provide a photothermographic material having reduced reflection gloss irregularities and fewer cissing defects on a non-photosensitive back side.

The invention also provides a photothermographic material having reduced curl at the edge of the photosensitive material upon thermal development and also exhibits a discoloring effect by a discolorable dye even at the edge, thus providing the photothermographic material suitable for medical diagnosis, industrial diagnosis, industrial photography, printing and COM uses.

The photothermographic material of the invention is characterized in that the absorbance of a dye contained therein for improving the sharpness and graininess upon image exposure is lost rapidly upon thermal development but stably retained during storage of the photothermographic material, thus finding applications in medical diagnosis, industrial diagnostic, industrial photography, printing and COM areas.

What is claimed is:

1. A black-and-white silver image-forming photothermographic material comprising, on one side of a support, an image forming layer containing at least a photosensitive silver halide, a non-photosensitive organic silver salt, a reducing agent and a binder, and, on the other side of the support, a non-photosensitive back side layer, wherein the non-photosensitive back side layer contains at least gelatin as a binder, and a total quantity of magnesium and/or calcium element contained in the non-photosensitive back side layer is $1\times10^{-5}$ mol/m$^2$ to $1\times10^{-3}$ mol/m$^2$.

2. The black-and-white silver image-forming photothermographic material of claim 1, wherein a coating quantity of gelatin contained in a binder of the non-photosensitive back side layer is 1.0 g/m$^2$ to 3.0 g/m$^2$.

3. The black-and-white silver image-forming photothermographic material of claim 1, wherein a binder of the non-photosensitive back side layer contains gelatin in an amount of 50% by mass to 100% by mass based on the mass of the binder of the non-photosensitive back side layer.

4. The black-and-white silver image-forming photothermographic material of claim 1, wherein the non-photosensitive back side layer is formed by coating two or more layers at the same time and subsequently drying the layers.

5. The black-and-white silver image-forming photothermographic material of claim 1, wherein in the non-photosensitive back side layer, a coating liquid for forming an outermost layer, which is a most distant layer from the support, contains gelatin in an amount of 3.0% by mass to 10.0% by mass based on the mass of the coating liquid for forming the outermost layer.

6. The black-and-white silver image-forming photothermographic material of claim 5, wherein a surface tension of the coating liquid for forming the outermost layer is at least 2 mN/m less than a surface tension of a coating liquid for forming a layer adjacent to the outermost layer.

7. The black-and-white silver image-forming photothermographic material of claim 5, wherein a viscosity of a coating liquid for forming the outermost layer is 20 cP to 60 cP at a coating temperature.

8. The black-and-white silver image-forming photothermographic material of claim 6, wherein a viscosity of the coating liquid for forming the layer adjacent to the outermost layer is 20 cP to 60 cP at a coating temperature.

9. A photothermographic material comprising, on one side of a support, an image forming layer containing at least a photosensitive silver halide, a non-photosensitive organic silver salt, a reducing agent and a binder, and, on the other side of the support, an optically functional back layer containing at least one dye that can be discolored by thermal development processing, wherein at least one of the optically functional back layer and a layer adjacent thereto contains at least one polymer having a glass transition temperature of −10° C. to 120° C., the at least one polymer having a glass transition temperature of −10° C. to 120° C. is a latex of a styrene-butadiene copolymer, and the polymer in the back layer is in a range of 10% to 50% by mass based on gelatin in the back layer.

10. The photothermographic material of claim 9, wherein the optically functional layer contains the at least one polymer having a glass transition temperature of −10° C. to 120° C.

11. The photothermographic material of claim 9, wherein the optically functional layer contains a base precursor.

12. The photothermographic material of claim 9, wherein at least one of the optically functional layer and the layer adjacent thereto contains gelatin.

* * * * *